US009975350B2

(12) United States Patent
Ishidate

(10) Patent No.: US 9,975,350 B2
(45) Date of Patent: May 22, 2018

(54) LIGHT SCANNING APPARATUS

(71) Applicant: CANON KABUSHIKI KAISHA, Tokyo (JP)

(72) Inventor: Takehiro Ishidate, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/160,270

(22) Filed: May 20, 2016

(65) Prior Publication Data

US 2016/0347083 A1 Dec. 1, 2016

(30) Foreign Application Priority Data

May 29, 2015 (JP) ..... 2015-110404
May 29, 2015 (JP) ..... 2015-110405

(51) Int. Cl.
*B41J 2/47* (2006.01)
*G03G 15/04* (2006.01)
*G03G 15/043* (2006.01)

(52) U.S. Cl.
CPC ..... *B41J 2/471* (2013.01); *G03G 15/043* (2013.01); *G03G 15/0409* (2013.01)

(58) Field of Classification Search
CPC ..... B41J 2/471; G06G 15/04036
USPC ..... 347/134, 241, 242, 245; 359/640; 399/216
See application file for complete search history.

(56) References Cited

U.S. PATENT DOCUMENTS 5,877,884 A 3/1999 Yanagisawa ..... 359/198
6,466,246 B2 * 10/2002 Fujimoto ..... B41J 2/473 347/242
8,325,212 B2 12/2012 Tomioka ..... 347/243
8,947,478 B2 2/2015 Ishidate et al. ..... 347/137
(Continued)

FOREIGN PATENT DOCUMENTS

JP H10-239611 A 9/1998
JP 3184370 B2 7/2001
(Continued)

OTHER PUBLICATIONS

U.S. Appl. No. 14/989,467, filed Jan. 6, 2016.
U.S. Appl. No. 15/000,854, filed Jan. 19, 2016.

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

A light scanning apparatus, including: a light source; a rotary polygon mirror configured to deflect a light beam emitted from the light source; a plurality of optical members configured to guide the light beam, which is deflected by the rotary polygon mirror, to a photosensitive member; a drive motor configured to rotate the rotary polygon mirror; an optical box to which the light source is attached, the optical box containing the rotary polygon mirror, the drive motor, and the optical members; and a dynamic vibration absorber mounted inside the optical box and configured to be vibrated by vibrations of the optical box, wherein the plurality of optical members are supported on a bottom portion of the optical box, and the dynamic vibration absorber is disposed on the bottom portion of the optical box at a position between at least two adjacent optical members among the plurality of optical members.

9 Claims, 39 Drawing Sheets

(56) References Cited

U.S. PATENT DOCUMENTS

| | | | | |
|---|---|---|---|---|
| 9,086,645 | B2 | 7/2015 | Otoguro et al. | G03G 15/0435 |
| 9,195,063 | B2 | 11/2015 | Ishidate et al. | G02B 26/125 |
| 9,316,992 | B2 | 4/2016 | Ishidate et al. | G03G 15/80 |
| 2010/0091083 | A1* | 4/2010 | Itami | B41J 2/471 347/261 |
| 2011/0316958 | A1* | 12/2011 | Johno | B41J 2/473 347/224 |
| 2015/0277082 | A1 | 10/2015 | Otoguro et al. | G02B 7/181 |
| 2015/0293350 | A1 | 10/2015 | Sato et al. | G02B 26/129 |

FOREIGN PATENT DOCUMENTS

| | | |
|---|---|---|
| JP | 2003-075760 | 3/2003 |
| JP | 3739463 B2 | 1/2006 |
| JP | 2010-048956 | 3/2010 |

* cited by examiner

LIGHT SCANNING APPARATUS

BACKGROUND OF THE INVENTION

Field of the Invention

The present invention relates to a light scanning apparatus. In particular, the present invention relates to a light scanning apparatus to be provided in an electrophotographic image forming apparatus such as a digital copying machine, a laser beam printer, and a facsimile apparatus.

Description of the Related Art

Hitherto, in a light scanning apparatus to be used in an electrophotographic image forming apparatus, a light beam emitted from a light source is deflected by a rotary polygon mirror and condensed by a scanning imaging optical system toward a photosensitive member to form light spots on the photosensitive member. The light scanning apparatus is configured to scan the photosensitive member with the light spots to form a latent image on the photosensitive member. The formed latent image is developed with a developer (toner) into a toner image. The toner image is transferred to a recording sheet and fixed on the recording sheet. After that, the recording sheet is delivered. A drive motor configured to drive the rotary polygon mirror to rotate and optical members such as lenses and mirrors are generally mounted inside a housing (hereinafter referred to as "optical box") of the light scanning apparatus.

One of items of the light scanning apparatus that affect the productivity in image output from an image forming apparatus main body (hereinafter referred to also as "main body") is a rotational speed of the drive motor configured to drive the rotary polygon mirror to rotate. In other words, as a measure for enhancing the productivity in image output from the main body, the drive motor is required to have higher rotational speed. However, the increase in rotational speed of the drive motor causes a centrifugal force to act on the rotary polygon mirror through rotation of the rotary polygon mirror, with the result that vibration energy synchronized with the rotation period of the drive motor is propagated from the rotary polygon mirror over the entire optical box via the drive motor. This causes vibration of the optical members such as lenses and mirrors supported in the optical box, leading to beam vibration synchronized with the rotation period of the drive motor in the light spots formed on the photosensitive member, and eventually causing pixel deviation, density unevenness, and other image deterioration. Further, there has been a problem in that the vibration energy propagated over the entire optical box vibrates the entire light scanning apparatus at various amplitudes ranging from small to large amplitudes, resulting in occurrence of noise. Particularly in recent years, development has been made to keep long-term durability performance of an oil bearing type drive motor even under use at high speed rotation. Therefore, in recent years, a drive motor capable of driving at high rotation speed up to almost 50,000 rpm can be manufactured although a related-art drive motor has been configured to drive at a rotational speed of about 30,000 rpm. On the other hand, the energy of the above-mentioned centrifugal force increases as the square of the rotational speed of the drive motor. Therefore, the vibration has a small influence on images at the rotational speed of the related-art rotary polygon mirror, but it is presumed that the problem may become more conspicuous in the future due to a further increase in the rotational speed of the rotary polygon mirror.

In order to solve the problems as described above, for example, there has been proposed such structure that vibration caused concomitantly with rotation of a drive motor is reduced by mounting, on an optical box, a viscoelastic member made of rubber or other material and a dynamic vibration absorber formed of a weight mounted to the viscoelastic member (see, for example, Japanese Patent No. 3,184,370). The dynamic vibration absorber as used herein refers to a device having a function of reducing a vibration level. In other words, a dynamic vibration absorber having a relatively smaller size than a vibration source and also having a characteristic frequency which is substantially equal to a frequency of the vibration source is installed in a system A for which reduction in a level of vibration from the vibration source is desired, to thereby enable reduction of the vibration level of the system A. The characteristic frequency of the dynamic vibration absorber is substantially equal to a vibration source frequency, and hence the dynamic vibration absorber efficiently absorbs vibration energy of the vibration source and vibrates itself to consume the energy, thereby being capable of reducing the vibration level of the system A.

As a further developed mode, there has been proposed that an existing component provided in a light scanning apparatus is used as a member forming a dynamic vibration absorber (see, for example, Japanese Patent No. 3,739,463). As minimum required constituent elements, the dynamic vibration absorber has two elements including "spring element" and "mass element," which determine the characteristic frequency of the dynamic vibration absorber. In Japanese Patent No. 3,739,463, a part (e.g., an upper cover) of an optical box of a light scanning apparatus is made elastically deformable and used in place of the "spring element," and the "mass element (e.g., a weight)" is mounted to this part to form the dynamic vibration absorber. Through the use of the existing component provided in the light scanning apparatus as the "spring element," an effect of reducing the number of components forming the dynamic vibration absorber can be obtained.

As described above, through the use of a dynamic vibration absorber, the dynamic vibration absorber consumes vibration energy of a drive motor. Therefore, it can be consequently expected that vibration energy propagating to optical members and an optical box is reduced to suppress image deterioration and noise. However, the vibration suppression effect can be expected from the mode proposed in Japanese Patent No. 3,184,370, but it is hard to say that the performance of the dynamic vibration absorber can be sufficiently demonstrated. Targets of vibration suppression in the light scanning apparatus are optical members such as lenses and mirrors configured to guide and condense scanning beams onto a photosensitive member. In order to suppress vibration, the most effective and optimum system for vibration reduction may exist in consideration of a mode specific to the light scanning apparatus in mounting the optical members to the optical box. However, this point is not taken into account in the Japanese Patent No. 3,184,370. Further, in recent years, to meet demands for downsizing of an image forming apparatus main body, not only a drive motor which is a vibration source, but also optical members such as lenses and mirrors, and light paths of light beams guided to the optical members are often densely disposed in a light scanning apparatus. Therefore, when arranging a dynamic vibration absorber, in addition to a high vibration suppression effect, attention is also required to be paid to the small-size structure and arrangement which enable coexistence with the optical members and the light paths without increasing the size of the light scanning apparatus more than necessary.

Further, according to Japanese Patent No. 3,739,463, a part of the optical box is formed to be elastically deformable and used as the spring element. Accordingly, vibration energy which is transmitted from the drive motor to the optical box is consumed by the dynamic vibration absorber, thereby enabling suppression of vibration in the optical members and other members without newly providing a spring element. The suppression of vibration in the optical members such as lenses and mirrors can reduce the amplitude of the above-mentioned beam vibration synchronized with the rotation period of the drive motor, and hence image deterioration such as pixel deviation and density unevenness can be mitigated. In Japanese Patent No. 3,739,463, a part of the optical box is used as the spring element of the dynamic vibration absorber. In general, when the dynamic vibration absorber maximally exerts its effect, the amplitude of the dynamic vibration absorber itself is the largest in the system, thereby suppressing the amplitude of a member subjected to reduction of vibration. In other words, with this structure, the dynamic vibration absorber can suppress vibration of the optical members, whereas an amplitude of a part of the optical box used as the dynamic vibration absorber increases. The optical box is typically positioned outside a part configured to hold constituent members of the light scanning apparatus. Therefore, in the structure in which the optical box serving as a spring element of the dynamic vibration absorber has a large amplitude, there is a problem in that the amplitude of vibration of the optical box caused by vibration of the drive motor causes unevenness in density of air around the optical box, thus leading to occurrence of noise.

SUMMARY OF THE INVENTION

The present invention has been made in view of the circumstances as described above, and it is an object of the present invention to reduce, with the simple structure, image deterioration and noise due to vibration caused concomitantly with rotation of a drive motor.

In order to solve the above-mentioned problems, the present invention includes the following features.

According to one embodiment of the present invention, there is provided a light scanning apparatus, comprising: a light source; a rotary polygon mirror configured to deflect a light beam emitted from the light source; a plurality of optical members configured to guide the light beam, which is deflected by the rotary polygon mirror, to a photosensitive member; a drive motor configured to rotate the rotary polygon mirror; an optical box to which the light source is attached, the optical box containing the rotary polygon mirror, the drive motor, and the plurality of optical members; and a dynamic vibration absorber mounted inside the optical box and configured to be vibrated by vibrations of the optical box, wherein the plurality of optical members are supported on a bottom portion of the optical box, and wherein the dynamic vibration absorber is disposed on the bottom portion of the optical box at a position between at least two adjacent optical members among the plurality of optical members.

According to another embodiment of the present invention, there is provided a light scanning apparatus, comprising: a drive unit configured to rotate a rotary polygon mirror configured to deflect a light beam emitted from a light source; a circuit board to which the drive unit is attached; an optical box containing the circuit board; a plurality of fixing portions provided to erect from a bottom portion of the optical box and having a plurality of bearing surfaces configured to fix the circuit board; and a mass mounted to a vibratable area in a portion of the circuit board, which is fixed to the plurality of fixing portions, other than portions in contact with the plurality of bearing surfaces, the mass being constructed in accordance with a drive frequency of the drive unit, at which an amplitude of vibration by the drive unit becomes a predetermined amplitude.

Further features of the present invention will become apparent from the following description of exemplary embodiments with reference to the attached drawings.

DESCRIPTION OF THE EMBODIMENTS

Embodiments of the present invention are described below in detail with reference to the drawings.

First Embodiment

[Overview of Image Forming Apparatus]

Figure 1A:
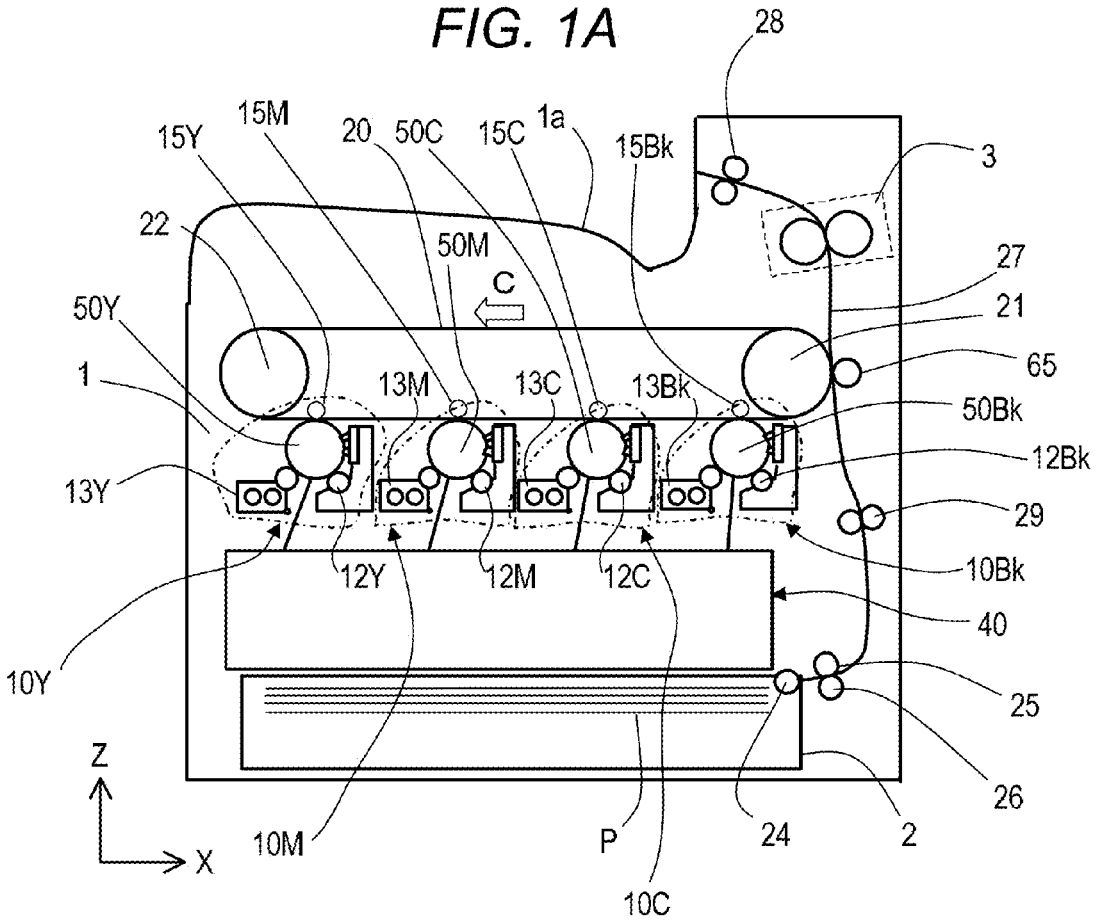
FIG. 1A is a schematic cross-sectional view for illustrating the overall structure of image forming apparatus according to first to third embodiments of the present invention.

The structure of an image forming apparatus according to a first embodiment of the present invention is described below. FIG. 1A is a schematic structure view for illustrating the overall structure of a tandem color laser beam printer according to this embodiment. The laser beam printer (hereinafter simply referred to as "printer") includes four image-forming engines 10Y, 10M, 10C, and 10Bk (indicated by chain lines) configured to form toner images of yellow (Y), magenta (M), cyan (C), and black (Bk), respectively. Further, the printer includes an intermediate transfer belt 20 to which the toner images are transferred from the respective image-forming engines 10Y, 10M, 10C, and 10Bk, and is configured to form a color image through transfer of the toner images, which are transferred to the intermediate transfer belt 20, to a recording sheet P serving as a recording medium. Symbols Y, M, C, and Bk representing the respective colors are hereinafter omitted except in necessary cases. In the following description, a rotational axis direction of a rotary polygon mirror 45 to be described later is referred to as a Z-axis direction, a main scanning direction which is a light beam scanning direction or a longitudinal direction of a reflecting mirror to be described later is referred to as a Y-axis direction, and a direction perpendicular to the Y-axis and the Z-axis is referred to as an X-axis direction.

The intermediate transfer belt 20 is formed to have an endless shape, is looped around a pair of belt conveyor rollers 21 and 22, and is configured to rotate in a direction indicated by the arrow C so that the toner images formed in the image-forming engines 10 for the respective colors are transferred thereto. A secondary transfer roller 65 is disposed at a position facing the belt conveyor roller 21 of the roller pair through intermediation of the intermediate transfer belt 20. When the recording sheet P passes between the secondary transfer roller 65 and the intermediate transfer belt 20, the toner images are transferred from the intermediate transfer belt to the recording sheet P. The above-mentioned four image-forming engines 10Y, 10M, 10C, and 10Bk are disposed in parallel under the intermediate transfer belt 20, and are configured to transfer the toner images formed in accordance with image information of the respective colors to the intermediate transfer belt 20 (this process is hereinafter referred to as "primary transfer"). These four image-forming engines 10 are disposed in an order of the yellow image-forming engine 10Y, the magenta image-forming engine 10M, the cyan image-forming engine 10C, and the black image-forming engine 10Bk along a turning direction of the intermediate transfer belt 20 (direction of the arrow C).

A light scanning apparatus 40 configured to expose photosensitive drums 50 serving as photosensitive members provided in the respective image-forming engines 10 in accordance with image information is disposed below the image-forming engines 10. Detailed illustration and description of the light scanning apparatus 40 are omitted in FIG. 1A, and the light scanning apparatus 40 is described later with reference to FIG. 1B and FIG. 2. The light scanning apparatus 40 is shared among all the image-forming engines 10Y, 10M, 10C, and 10Bk, and includes four semiconductor lasers (not shown) each configured to emit a laser beam modulated in accordance with image information of each color. The light scanning apparatus 40 further includes the rotary polygon mirror 45 configured to deflect a light beam so that each photosensitive drum 50 is scanned in its axial direction (Y-axis direction) with the light beam corresponding to the photosensitive drum 50, and a drive motor 41 configured to drive the rotary polygon mirror 45 to rotate. Each light beam deflected by the rotary polygon mirror 45 is guided by optical members disposed inside the light scanning apparatus 40 onto each photosensitive drum 50, which is exposed to each light beam.

Each image-forming engine 10 includes the photosensitive drum 50 and a charging roller 12 configured to charge the photosensitive drum 50 to a uniform potential. Each image-forming engine 10 further includes a developing device 13 which is a developing unit configured to form a toner image through development of an electrostatic latent image formed on the photosensitive drum 50 as a result of exposure to light beam irradiation. The developing device 13 is configured to develop the electrostatic latent image on the photosensitive drum 50 with toner.

A primary transfer roller 15 is disposed at a position facing the photosensitive drum 50 of each image-forming engine 10 so that the intermediate transfer belt 20 is sandwiched between the photosensitive drum 50 and the primary transfer roller 15. The primary transfer roller 15 is configured to transfer the toner image on the photosensitive drum 50 to the intermediate transfer belt 20 under application of a transfer voltage.

On the other hand, the recording sheet P is fed from a sheet feed cassette 2 accommodated in a lower part of a printer housing 1 to the inside of the printer, more specifically to a secondary transfer position at which the intermediate transfer belt 20 is in contact with the secondary transfer roller 65 serving as a transfer unit. At an upper part of the sheet feed cassette 2, a pickup roller 24, which is configured to pull out the recording sheet P accommodated in the sheet feed cassette 2, and a sheet feed roller 25 are arranged in line. Further, a retard roller 26 configured to prevent feeding of more than one recording sheet P is disposed at a position facing the sheet feed roller 25. A conveyance path 27 of the recording sheet P inside the printer is formed to be substantially perpendicular along a right side surface of the printer housing 1. The recording sheet P pulled out from the sheet feed cassette 2 positioned at a bottom portion of the printer housing 1 is elevated along the conveyance path 27 to be sent to registration rollers 29 configured to control a timing of entry of the recording sheet P to the secondary transfer position. Then, the toner image is transferred to the recording sheet P at the secondary transfer position, and the recording sheet P is then sent to a fixing unit 3 (indicated by a broken line) disposed downstream in a conveyance direction. Then, the recording sheet P having the toner image fixed thereon by the fixing unit 3 passes between discharge rollers 28 to be delivered onto a sheet discharge tray 1*a* disposed at an upper part of the printer housing 1.

In forming a color image with the thus configured color laser beam printer, first, the light scanning apparatus 40 exposes the photosensitive drum 50 of each image-forming engine 10 at a predetermined timing in accordance with image information of each color. In this way, a latent image is formed on the photosensitive drum 50 of each image-forming engine 10 in accordance with the image information. In order to obtain good image quality, it is required that the latent image to be formed by the light scanning apparatus 40 be reproduced at a predetermined position on the photosensitive drum 50 with a high degree of accuracy, and that a light beam for forming the latent image always have a desired value of light intensity in a stable manner.

[Structure of Light Scanning Apparatus]

Figure 1B:
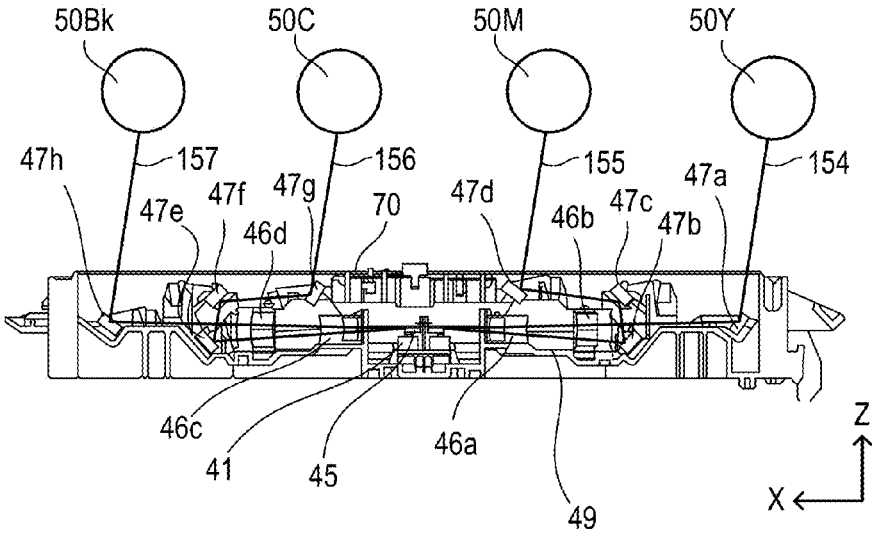
FIG. 1B is a cross-sectional view of a light scanning apparatus.

FIG. 1B is a schematic view for illustrating an overview of optical members mounted to the light scanning apparatus 40. Light source units 44 (see FIG. 2 to be described later) each including a light source configured to emit a light beam (laser light) are disposed on an outer peripheral portion of the light scanning apparatus 40. The rotary polygon mirror 45, which is configured to deflect the light beam, and the drive motor 41 are disposed inside the light scanning apparatus 40. The rotary polygon mirror 45 has a plurality of (four or more) reflection surfaces configured to reflect light beams. Further, fθ lenses 46*a* to 46*d* and reflecting mirrors 47*a* to 47*h* configured to guide respective light beams onto the photosensitive drums 50 are disposed in the light scanning apparatus 40. On a surface (bottom surface) of a bottom portion 49*a* of an optical box 49, a plurality of optical members including at least one pair of fθ lenses 46 and at least one pair of reflecting mirrors 47 are disposed so as to face each other with respect to the rotary polygon mirror 45.

A light beam 154 (also referred to as "Y scanning beam 154") corresponding to a photosensitive drum 50Y that has been emitted from a light source unit 44Y (see FIG. 2) is deflected by the rotary polygon mirror 45 to enter the fθ lens 46*a*. The light beam 154 having passed through the fθ lens 46*a* is reflected by the reflecting mirror 47*a* after having entered and passed through the fθ lens 46*b*. The light beam 154 reflected by the reflecting mirror 47*a* passes through a transparent window (not shown) and scans the photosensitive drum 50Y.

A light beam 155 (also referred to as "M scanning beam 155") corresponding to a photosensitive drum 50M that has been emitted from a light source unit 44M (see FIG. 2) is deflected by the rotary polygon mirror 45 to enter the fθ lens 46*a*. The light beam 155 having passed through the fθ lens 46*a* is reflected by the reflecting mirrors 47*b*, 47*c*, and 47*d* after having entered and passed through the fθ lens 46*b*. The light beam 155 reflected by the reflecting mirror 47*d* passes through a transparent window (not shown) and scans the photosensitive drum 50M.

A light beam 156 (also referred to as "C scanning beam 156") corresponding to a photosensitive drum 50C that has been emitted from a light source unit 44C (see FIG. 2) is deflected by the rotary polygon mirror 45 to enter the fθ lens 46*c*. The light beam 156 having passed through the fθ lens 46*c* enters the fθ lens 46*d*, and the light beam 156 having passed through the fθ lens 46*d* is reflected by the reflecting mirrors 47*e*, 47*f*, and 47*g*. The light beam 156 reflected by the reflecting mirror 47*g* passes through a transparent window (not shown) and scans the photosensitive drum 50C.

A light beam 157 (also referred to as "K scanning beam 157") corresponding to a photosensitive drum 50Bk that has been emitted from a light source unit 44K (see FIG. 2) is deflected by the rotary polygon mirror 45 to enter the fθ lens 46*c*. The light beam 157 having passed through the fθ lens 46*c* is reflected by the reflecting mirror 47*h* after having entered and passed through the fθ lens 46*d*. The light beam 157 reflected by the reflecting mirror 47*h* passes through a transparent window (not shown) and scans the photosensitive drum 50Bk.

[Overview of Light Scanning Apparatus]

Figure 2:
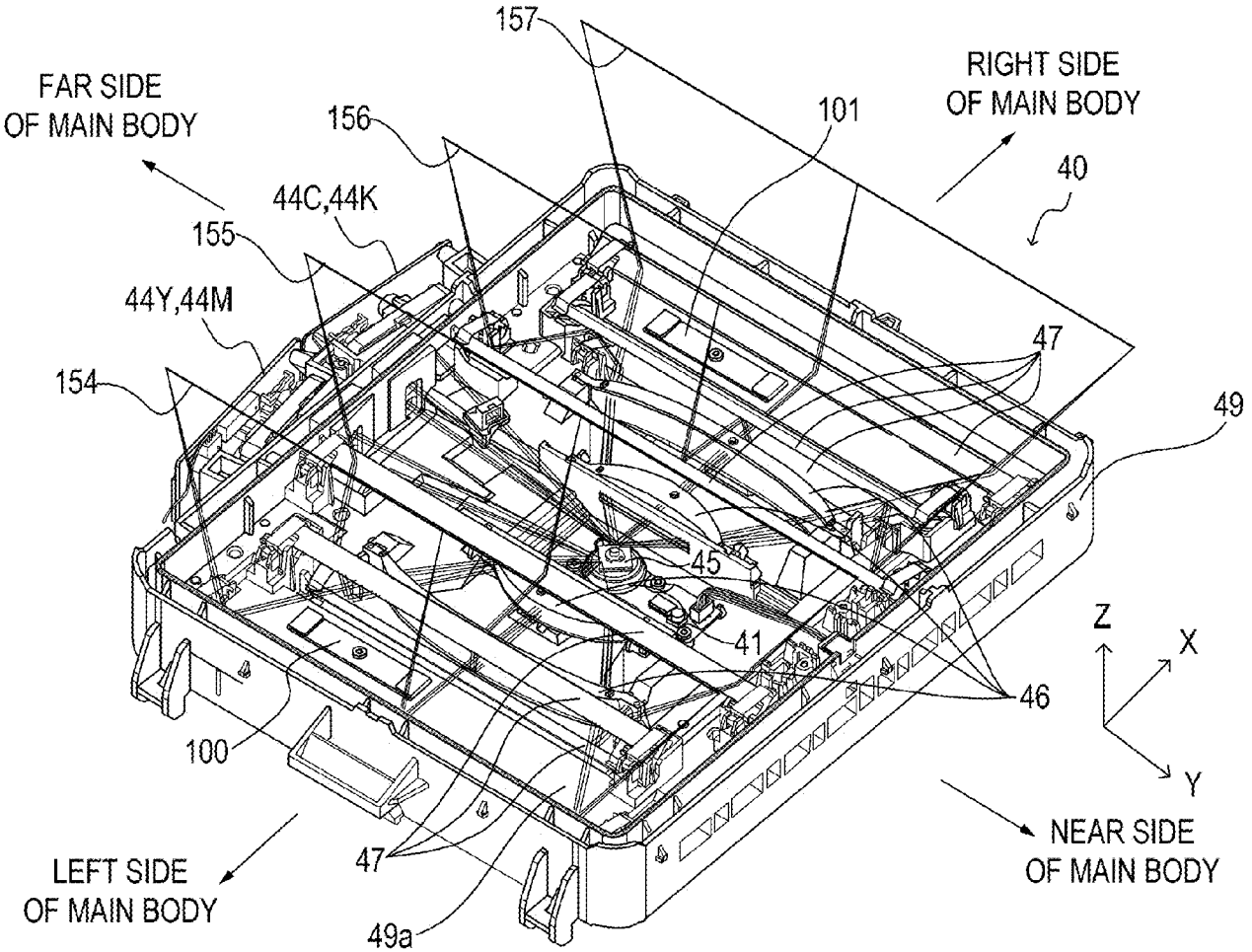
FIG. 2 is a perspective view for illustrating the light scanning apparatus according to the first embodiment.

FIG. 2 is a perspective view for illustrating an overview of the light scanning apparatus 40 disposed in the printer (hereinafter referred to also as "main body") illustrated in FIG. 1A. The light scanning apparatus 40 of FIG. 2 is illustrated in a state in which an upper cover 70 is removed from the optical box 49 illustrated in FIG. 1B. Arrows in FIG. 2 indicate directions of the printer illustrated in FIG. 1A. More specifically, in FIG. 2, "NEAR SIDE OF MAIN BODY" indicates the front side of the main body illustrated in FIG. 1A; "LEFT SIDE OF MAIN BODY" and "RIGHT SIDE OF MAIN BODY" indicate the left side and the right side of the main body illustrated in FIG. 1A, respectively; and "FAR SIDE OF MAIN BODY" indicates the back side of the printer illustrated in FIG. 1A. Typical light beam paths in laser light paths including optical axes of scanning lenses are indicated as the Y scanning beam 154, the M scanning beam 155, the C scanning beam 156, and the K scanning beam 157 in an order from the left side in FIG. 2. The photosensitive drum 50Y of the above-mentioned image-forming engine 10Y is exposed to the Y scanning beam 154. The photosensitive drum 50M of the image-forming engine 10M, the photosensitive drum 50C of the image-forming engine 10C, and the photosensitive drum 50Bk of the image-forming engine 10Bk are likewise exposed to the M scanning beam 155, the C scanning beam 156, and the K scanning beam 157, respectively. In the following, the image-forming engines 10Y, 10M, 10C, and 10Bk are referred to as Y station (also abbreviated as Yst), M station (also abbreviated as Mst), C station (also abbreviated as Cst), and K station (also abbreviated as Kst), respectively. In FIG. 2 and the following description, the fθ lenses 46*a* to 46*d* and the reflecting mirrors 47*a* to 47*h* in FIG. 1B are referred to simply as the fθ lenses 46 and reflecting mirrors 47, respectively.

The light source units 44 each including the light source configured to emit laser light is disposed on the outer peripheral portion of the optical box 49 of the light scanning apparatus 40. The optical box 49 further includes the rotary polygon mirror 45 configured to reflect and deflect the laser light emitted from the light source units 44, the drive motor 41 configured to support and rotate at high speed the rotary polygon mirror 45, the plurality of fθ lenses 46 through which the laser light passes, and the reflecting mirrors 47. The fθ lenses 46 and the reflecting mirrors 47 serving as optical members are disposed as a scanning imaging optical system that is necessary to guide light beams (referred to also as "laser scanning light") deflected by the rotary polygon mirror 45 onto the photosensitive drums 50 of the respective image-forming engines 10 serving as photosensitive members to form optical images. The light source units 44 include the light source units 44Y and 44M for the Y and M stations on the left side in FIG. 2 and the light source units 44C and 44K for the C and K stations on the right side in FIG. 2.

The following feature is illustrated in FIG. 2. That is, a YM-side dynamic vibration absorber 100 (referred to also as "dynamic vibration absorber 100") and a CK-side dynamic vibration absorber 101 (referred to also as "dynamic vibration absorber 101"), which are made of metal, are installed on the optical box 49 to be fastened and fixed to the optical box 49 with screws, respectively. The pair of dynamic vibration absorbers 100 and 101 are installed so as to face each other, with the rotary polygon mirror 45 located therebetween. The dynamic vibration absorbers 100 and 101 are fixed to the bottom surface of the bottom portion 49*a* of the optical box 49 to which the optical members are fixed. Each of the dynamic vibration absorbers 100 and 101 is disposed so that its longitudinal direction is substantially parallel to a longitudinal direction of the fθ lenses 46 and the reflecting mirrors 47. There is no causal relationship between an orientation of the dynamic vibration absorbers in their longitudinal direction and a vibration reduction effect obtained by the dynamic vibration absorbers, but the arrangement of the optical members arranged in the optical box is not affected when the longitudinal direction of the dynamic vibration absorbers is set to be parallel to the longitudinal direction of the fθ lenses 46 and the reflecting mirrors 47. As a result, the light scanning apparatus 40 can have a compact size.

In addition, as described later, in each dynamic vibration absorber according to this embodiment, a drive frequency of the drive motor 41 which is a target vibration frequency can be set to be coincident with a characteristic frequency of the dynamic vibration absorber by changing an arm length in the longitudinal direction. In each dynamic vibration absorber, a higher vibration reduction effect is obtained by setting the characteristic frequency of the dynamic vibration absorber itself to be coincident with the vibration frequency. Therefore, arrangement in which the longitudinal direction of the dynamic vibration absorbers is parallel to the longitudinal direction of the fθ lenses and the reflecting mirrors 47 increases a degree of freedom in design, and hence the arm length of each of the dynamic vibration absorbers can be adjusted. As a result, the dynamic vibration absorbers can achieve the vibration reduction effect even in a wide vibration frequency range. The setting of the longitudinal direction of the dynamic vibration absorbers to be parallel to the longitudinal direction of the fθ lenses 46 and the reflecting mirrors 47 can reduce a risk that the dynamic vibration absorbers interfere with the scanning beams passing through the fθ lenses 46 and the reflecting mirrors 47 to cause image failure on the photosensitive drums 50. This is because each scanning beam in the light scanning apparatus 40 has an angle in the Z-axis direction, and a shorter distance occupied by each dynamic vibration absorber on an X-Y plane in an optical axis direction leads to a shorter distance of overlap between the scanning beam and the dynamic vibration absorber. In the dynamic vibration absorbers according to this embodiment, the arm length may be set so that the characteristic frequency is set to be coincident with a drive frequency from the image forming apparatus main body. More specifically, the image forming apparatus main body includes various motors such as a drive motor configured to rotate the rollers for conveying recording sheets and a drive motor configured to rotate the photosensitive drums. Vibration in those drive motors is transmitted to the light scanning apparatus fixed to the image forming apparatus main body. The arm length in each of the dynamic vibration absorbers according to this embodiment may be set on the basis of the vibration frequency from the image forming apparatus main body as described above.

[Shape of Dynamic Vibration Absorber and Method of Fixing to Optical Box]

Next, a shape of the dynamic vibration absorbers 100 and 101 and a method of fixing the dynamic vibration absorbers to the optical box 49 are described with reference to FIG. 3A and FIG. 3B. FIG. 3A is a perspective view for illustrating a peripheral portion of the CK-side dynamic vibration absorber 101 in FIG. 2 on an enlarged scale. FIG. 3A is an illustration of how the CK-side dynamic vibration absorber 101 is mounted to the optical box 49. The structure of the YM-side dynamic vibration absorber 100 and a method of mounting the YM-side dynamic vibration absorber 100 to the optical box 49 are the same as those for the CK-side dynamic vibration absorber 101. Accordingly, the CK-side dynamic vibration absorber 101 is used in the following description. As described above, the CK-side dynamic vibration absorber 101 is fastened to the optical box 49 with a screw. Therefore, a screw hole 151 is formed in the middle of the CK-side dynamic vibration absorber 101. Folded portions 104 and elastic arms 105 are described later. The optical box 49 has a convex bearing surface 102 and a screw hole 107 (see FIG. 4A) formed on a radially inner side of the convex bearing surface 102. When the CK-side dynamic vibration absorber 101 is fastened to the optical box 49, the CK-side dynamic vibration absorber 101 is first placed on the convex bearing surface 102 and then a fastening screw 103 is caused to pass through the screw hole 151 to fasten the CK-side dynamic vibration absorber 101 to the optical box 49 with the screw. In this step, the diameter of the screw hole 151 is equal to the screw diameter of the fastening screw 103. Accordingly, the CK-side dynamic vibration absorber 101 is positioned in the optical box 49 with a high degree of accuracy through fitting at the time of fastening with the screw.

According to this embodiment, there is no restriction in a direction of rotation of the CK-side dynamic vibration absorber 101 about the axis of the fastening screw 103 when the CK-side dynamic vibration absorber 101 is to be fixed to the optical box 49. The optical box 49 and the CK-side dynamic vibration absorber 101 do not need to have a shape for rotation stop when, for example, an abutment jig for restricting the direction of rotation of the CK-side dynamic vibration absorber 101 is prepared at the time of fastening with the screw in assembling. In particular, it is necessary for the characteristic frequency of a dynamic vibration absorber to be the same as or approximate to the frequency of a vibration source in order to enhance the vibration absorption efficiency of the dynamic vibration absorber. Therefore, unnecessary contact with the optical box 49 that may change the characteristic frequency of the dynamic vibration absorber is to be avoided as much as possible, and contact between the optical box 49 and the CK-side dynamic vibration absorber 101 is intentionally made only at the convex bearing surface 102. When the restriction in the direction of rotation of the dynamic vibration absorber 101 with respect to the optical box 49 is necessary, a method to be described later in a second embodiment of the present invention may be employed.

[Structure of Fastening of Dynamic Vibration Absorber to Optical Box]

Figure 4A:
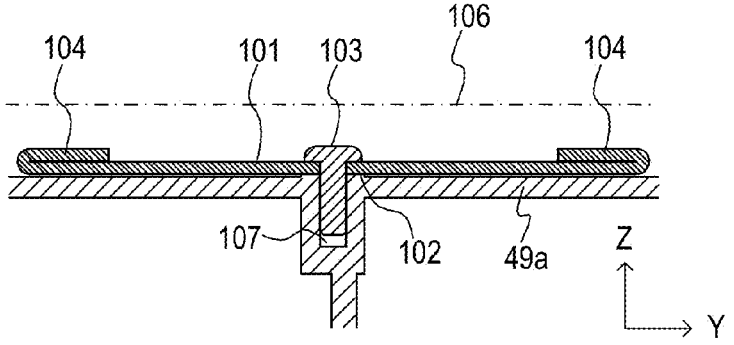
FIG. 4A is a cross-sectional view of the dynamic vibration absorber according to the first embodiment.

FIG. 4A is a cross-sectional view of the structure in which the CK-side dynamic vibration absorber 101 is fastened to the optical box 49 with the screw, for illustrating a cross section of the CK-side dynamic vibration absorber 101 taken along the longitudinal direction including a central axis of the fastening screw 103. As can be seen from FIG. 4A, the CK-side dynamic vibration absorber 101 is in contact with the optical box 49 only at the convex bearing surface 102 and is fixed to the optical box 49 with the fastening screw 103. The CK-side dynamic vibration absorber 101 and the optical box 49 are disposed so that a small clearance (gap) is provided between the CK-side dynamic vibration absorber 101 and the optical box 49, and the CK-side dynamic vibration absorber 101 is not in contact with the optical box 49 at portions other than the convex bearing surface 102. As a feature of the CK-side dynamic vibration absorber 101, the CK-side dynamic vibration absorber 101 includes the folded portions 104 (folded back by so-called hemming and hereinafter referred to as "hemmed portions 104") at both end portions in the longitudinal direction of the CK-side dynamic vibration absorber 101, and the folded portions 104 are formed by folding back the end portions by 180 degrees. A relation between the hemmed portions 104 and the characteristic frequency of the CK-side dynamic vibration absorber 101 is described later. In FIG. 4A, a scanning beam 106 (corresponding to the K scanning beam 157 in FIG. 2) passes above the CK-side dynamic vibration absorber 101 (Z-axis positive direction). However, the dynamic vibration absorber 101 is installed along the bottom surface of the optical box 49, and its height does not reach a height of the laser light path. Therefore, the dynamic vibration absorber 101 does not interfere with the scanning beam 106, nor does the dynamic vibration absorber 101 interfere with laser scanning on the photosensitive drum 50.

[Structure of Elastic Arm]

Figure 4B:
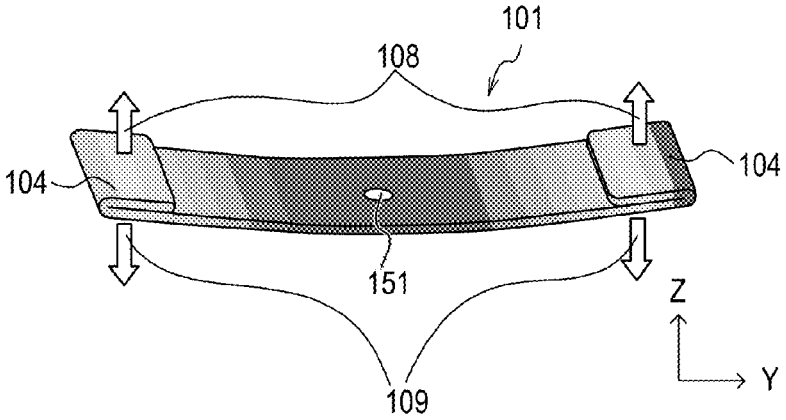
FIG. 4B is an analysis diagram for illustrating a characteristic mode of the dynamic vibration absorber according to the first embodiment.

FIG. 4B is a diagram for illustrating a simulation analysis result as to in what characteristic mode the CK-side dynamic vibration absorber 101 installed in the optical box 49 vibrates. In FIG. 4B, the dynamic vibration absorber 101 is only illustrated, and the fastening screw 103 and the optical box 49 are not illustrated. As can be seen from FIG. 4B, both ends of the dynamic vibration absorber 101 are deformed in the same direction (upward displacements 108 in FIG. 4B) with respect to the screw hole 151 for fastening the CK-side dynamic vibration absorber 101 to the optical box 49, in other words, with respect to a middle portion in contact with the optical box 49. Downward displacements 109 in FIG. 4B indicate that both ends of the dynamic vibration absorber 101 are deformed downward after the upward displacements 108 with respect to the middle portion. The CK-side dynamic vibration absorber 101 thus has a characteristic mode in which both end portions periodically repeat up-and-down motions in the same directions with respect to a portion formed in the middle for fastening to the optical box 49 with the screw.

In the characteristic mode illustrated in FIG. 4B, both ends of the dynamic vibration absorber 101 repeat the up-and-down motions in the same phase. However, this is cantilever vibration in the primary bending mode based on the portion of contact with the optical box 49 as is apparent in consideration of a deformation mode only on one side.

The primary bending mode is the simplest and basic vibration mode and is a characteristic mode in which vibration occurs at the lowest frequency as compared to other higher-order modes. In order to obtain the effect of the dynamic vibration absorber, it is necessary that the characteristic frequency in the primary bending mode with respect to the portion of contact with the optical box 49 in the middle of the CK-side dynamic vibration absorber 101 (this portion is also the portion for fastening with the screw) be set to be coincident with a rotational frequency of the drive motor 41.

Figure 3B:
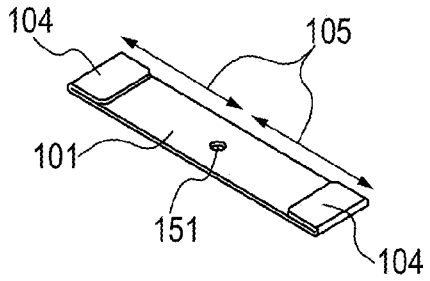
FIG. 3B is a perspective view of the dynamic vibration absorber according to the first embodiment.
Figure 3A:
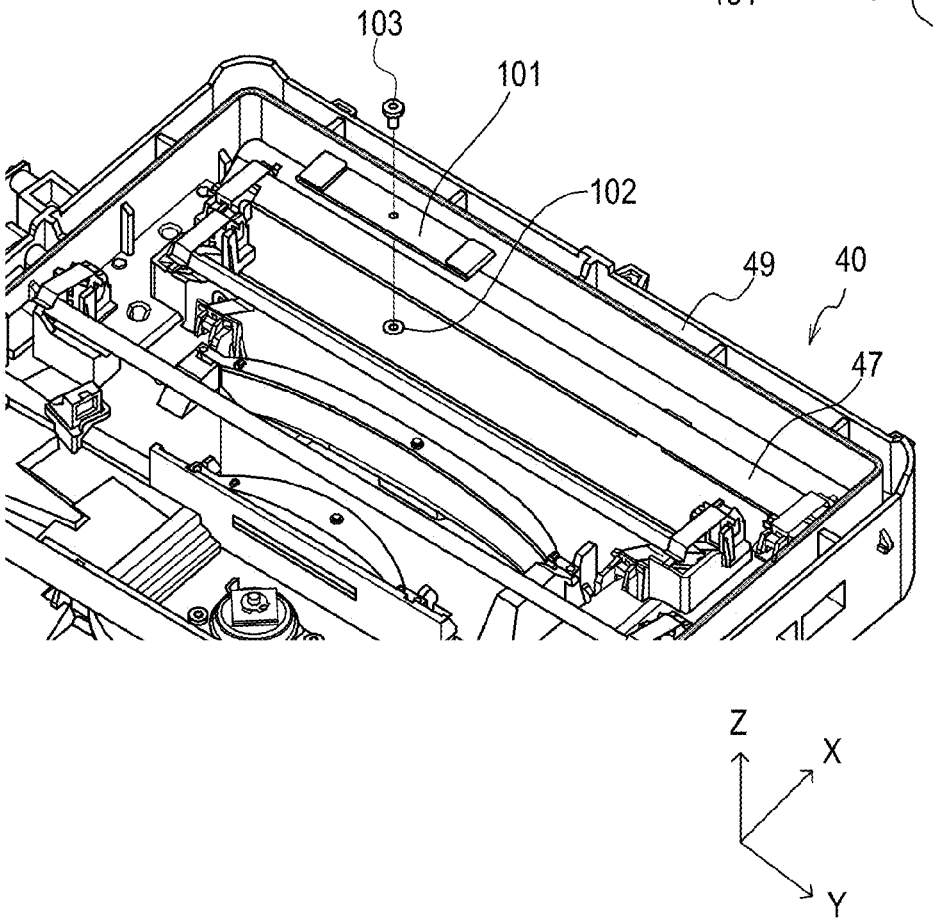
FIG. 3A is a perspective view for illustrating mounting of a dynamic vibration absorber according to the first embodiment.

In addition to the length of the elastic arms 105 illustrated in FIG. 3B, their width or thickness, or a material of the dynamic vibration absorber may be changed to change the characteristic frequency of the CK-side dynamic vibration absorber 101 in the primary bending mode. These factors can be easily determined by calculation or simulation. As compared to the case where hemming is not performed, a mass is added to the end portions and hence the hemmed portions 104 formed at both end portions of the CK-side dynamic vibration absorber 101 can have the same characteristic frequency as in the case where hemming is not performed, even under a state in which the length in the longitudinal direction is reduced.

Figure 4C:
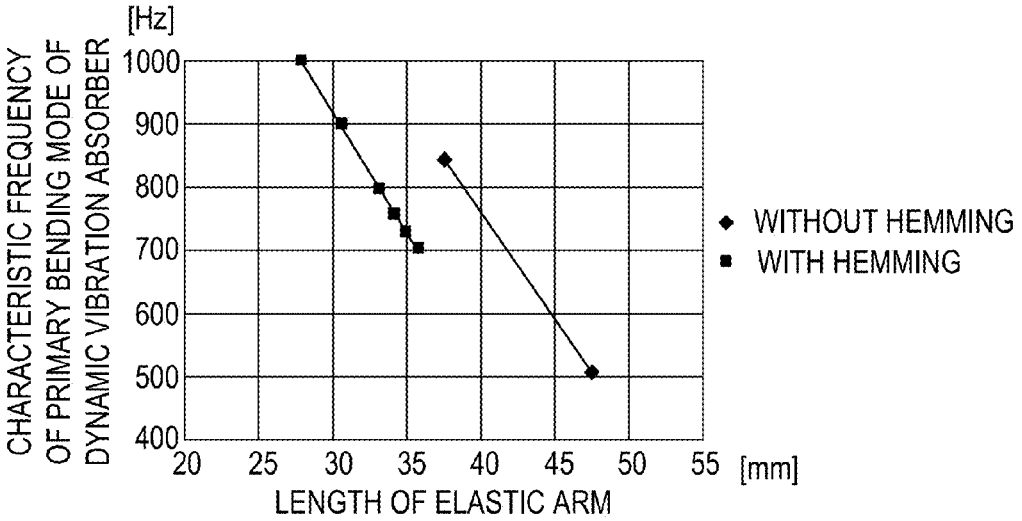
FIG. 4C is a graph for showing a relation between a length of an elastic arm and a characteristic frequency of the dynamic vibration absorber according to the first embodiment.

FIG. 4C is a graph for showing a relation between the length of the elastic arms 105 of the dynamic vibration absorber and the characteristic frequency of the dynamic vibration absorber in the primary bending mode. In FIG. 4C, there are two graphs for showing a case where the elastic arms 105 of the dynamic vibration absorber are hemmed (plotted by squares) and a case where the elastic arms 105 of the dynamic vibration absorber are not hemmed (plotted by rhombuses). In FIG. 4C, the horizontal axis represents a length [unit: mm] of the elastic arm 105 on one side, and the vertical axis represents the characteristic frequency [unit: Hz (Hertz)] of the dynamic vibration absorber in the primary bending mode. As shown in the graph, the characteristic frequency in the primary bending mode can be tuned in a wide range in accordance with the length of the elastic arms 105. For example, it is understood that the characteristic frequency in the primary bending mode can be tuned to a range of from about 500 Hz to about 850 Hz with no hemming, while the characteristic frequency in the primary bending mode can be tuned to a range of from about 700 Hz to about 1,000 Hz with hemming.

As can be seen from FIG. 4C, with no hemming, the elastic arm 105 needs a length of 42 mm to obtain the dynamic vibration absorber at 700 Hz (42,000 rpm in terms of motor rotational speed), for example, but the length of the elastic arm 105 can be reduced to 36 mm by merely hemming the end portion. In other words, the dynamic vibration absorber having the same characteristic frequency can be obtained with a shape shorter by 12 mm (=(42 mm−36 mm)×2) in terms of the elastic arms on both sides. The optical box 49 includes the fθ lenses 46, the reflecting mirrors 47, fastening members configured to hold the lenses and mirrors, and laser light paths disposed therein, and downsizing of the dynamic vibration absorbers has the effect of improving the degree of freedom in design.

In a general dynamic vibration absorber, a viscous (damper) member made of rubber or other material may be inserted between the dynamic vibration absorber and the optical box, but this embodiment has a feature also in the simple structure in which the dynamic vibration absorber is directly fastened to the optical box with a screw. When the viscous member is inserted as in the former case, a vibration reduction effect is obtained in a relatively wide frequency range with respect to a target vibration frequency. However, the concept of this embodiment is to set the characteristic frequency in the primary bending mode to be coincident with the vibration frequency of the drive motor 41. Therefore, when the viscous member is inserted, the characteristic frequency in the primary bending mode is considerably reduced, and an optimal design value of the dynamic vibration absorber may not be obtained due to a target vibration frequency as high as 700 Hz (42,000 rpm). Insertion of the viscous member is effective in a wide frequency range as described above, whereas the vibration reduction effect may be reduced.

In view of the above, in a case where the target vibration frequency of the drive motor 41 is clearly determined as in the light scanning apparatus, the structure of this embodiment having a higher vibration reduction effect is more preferred than insertion of the viscous member for covering a wide frequency range. In addition, when no viscous member is used, there is less influence of deterioration of a viscous member over time, and an optimal design value is also obtained by simulating a simple primary bending mode as described above. These are also advantages obtained by directly fastening the dynamic vibration absorber to the optical box 49.

Further, the dynamic vibration absorber 101 according to this embodiment has the structure in which the elastic arms 105 are formed on both sides rather than one side with respect to the screw fastening portion. This structure can have the following effects. More specifically, in the case where the elastic arm 105 is formed only on one side, the single arm vibrates in the primary bending mode, and hence vibration energy consumption in the dynamic vibration absorber is reduced to half as compared to the case where the elastic arms 105 are formed on both sides, thereby reducing the vibration reduction effect on the light scanning apparatus 40. When an attempt is made using the single elastic arm to achieve energy consumption equivalent to that of the case where the elastic arms 105 are formed on both sides to avoid the above-mentioned problem, it is necessary to increase the size (length) of the elastic arm, with the result that the size of the dynamic vibration absorber becomes substantially equal to that of the structure in which the elastic arms are formed on both sides. However, the increase in the length of the elastic arm 105 considerably reduces the characteristic frequency in the primary bending mode, thereby leading to loss of coincidence with the target vibration frequency of the drive motor 41. As a result, the vibration reduction effect is considerably impaired. Therefore, an increase in thickness of the elastic arm 105 of the dynamic vibration absorber 101 or other countermeasures are to be taken, and the dynamic vibration absorber 101 may have a larger size than the dynamic vibration absorber having the structure in which the elastic arms are formed on both sides. Therefore, in a comparison based on the same vibration energy consumption, the dynamic vibration absorber having the structure in which the arms are formed on both sides is more suitable for space saving than that having the structure in which the arm is formed on one side, and particularly causes less interference with scanning beams in view of the characteristic of the light scanning apparatus.

[Vibration Reduction Effect Obtained by Dynamic Vibration Absorber]

(1) Vibration Level of Light Scanning Apparatus when No Dynamic Vibration Absorber is Installed Next, the vibration reduction effect obtained by the dynamic vibration absorber according to this embodiment is described. First, a vibration level of the light scanning apparatus 40 in a state in which no dynamic vibration absorber is installed (this state is hereinafter referred to also as "initial state") is described with reference to FIG. 5. In this embodiment, the rotational speed of the drive motor 41 is set to 42,000 rpm (frequency: 700 Hz), and acceleration is used as a physical property value representing the vibration level in the following description. The unit of the acceleration is $mm/s^2$. However, the acceleration is only used for the relative comparison of the effect of the dynamic vibration absorber and hence is totally normalized by a common value. The following description is given as the "vibration level" because the acceleration value itself on the light scanning apparatus increases or decreases depending on the unbalance amount of the drive motor 41 and hence the acceleration numeric value itself has no meaning in the purpose of the description of the vibration reduction effect. Although not illustrated, the light scanning apparatus 40 itself is fixed by the same method as in the case of fixing to the image forming apparatus.

Figure 5:
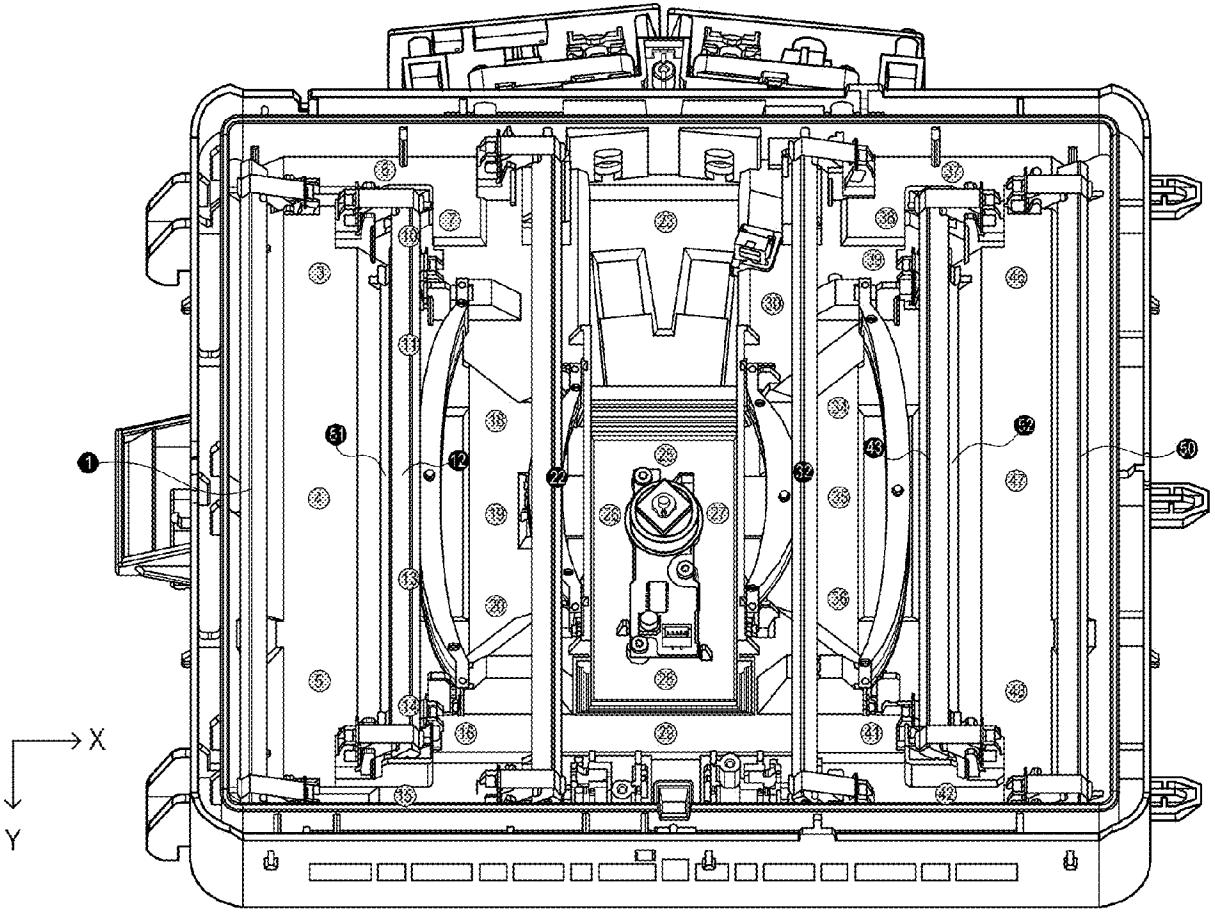
FIG. 5 is a view for illustrating vibration level measurement points in an initial state according to the first embodiment.

FIG. 5 is a view for illustrating vibration level measurement points in respective members on the optical box 49 when the drive motor 41 is driven at the above-mentioned rotational speed. In FIG. 5 and its subsequent figures, symbols are omitted for ease of identifying the measurement points except in case of necessity. In the figures, numbers in white circles (○) (hereinafter referred to as "circled numbers") indicate the respective acceleration (vibration level) measurement points. Points indicated by numbers in black circles (●) (hereinafter referred to as "white numbers") are measurement points at the reflecting mirrors 47 where the vibration levels are particularly high among the respective members on the optical box 49, and there are eight points. Among those points, four points are indicated as Yst mirror (white number 1), Mst mirror 1 (white number 51), Mst mirror 2 (white number 12), and Mst mirror 3 (white number 22) from the left side to the central portion in FIG. 5. The other four points are indicated as Cst mirror 3 (white number 32), Cst mirror 2 (white number 43), Cst mirror 1 (white number 52), and Kst mirror (white number 50) from the central portion to the right side in FIG. 5. The vibration levels at those reflecting mirrors 47 are particularly picked up for relative comparison of the dynamic vibration absorber installation effect in the following description.

Figure 6A:
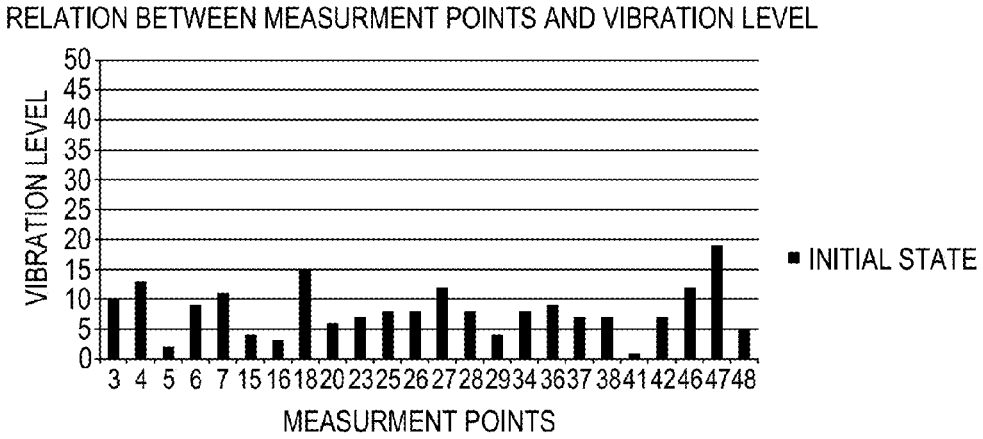
FIG. 6A and FIG. 6B are graphs for showing a vibration level at each measurement point in the initial state according to the first embodiment.
Figure 6B:
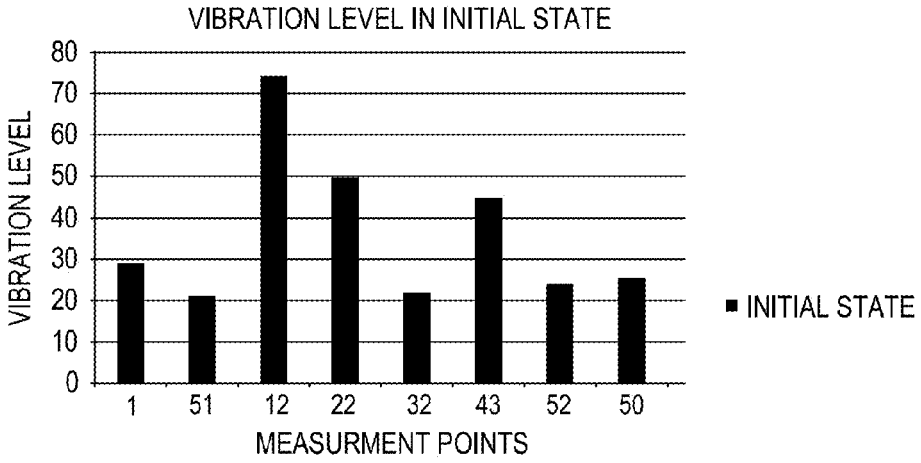

FIG. 6A is a bar graph for showing a relation between the respective measurement points on the optical box 49 in the initial state and the vibration levels at the respective measurement points. The vertical axis and the horizontal axis represent the vibration levels and the measurement points (numerals are measurement point numbers in FIG. 5), respectively. As can be seen from FIG. 6A, centrifugal force energy generated by the drive of the drive motor 41 due to the unbalance amount of the drive motor 41 propagates over the entire area of the optical box 49 to forcibly generate acceleration (i.e., vibration indicated by the vibration level) at the respective measurement points. It is characteristic that the acceleration (vibration level) distribution in the optical box 49 is not generally large in the vicinity of the drive motor 41 (measurement points 25 to 28) but high acceleration portions are distributed even at relatively distant portions (e.g., measurement points 3, 4, 46, and 47). The reason therefor is described later. FIG. 6B is a bar graph for showing the vibration levels at the white number measurement points 1, 51, 12, 22, 32, 43, 52, and 50 in FIG. 5. In comparison with FIG. 6A, it is understood that the vibration levels are particularly high at the reflecting mirrors 47 having the measurement points indicated in FIG. 6B. As can be seen from FIG. 5, FIG. 6A, and FIG. 6B, the vibration energy of the drive motor 41 propagated to the entire area of the optical box 49 is propagated to the various reflecting mirrors 47 mounted on the optical box 49 by spring urging. Then, it is understood that the vibration levels are relatively higher at the measurement points set at the reflecting mirrors 47 than at other measurement points except for those at the reflecting mirrors 47 of the optical box 49.

Figure 6C:
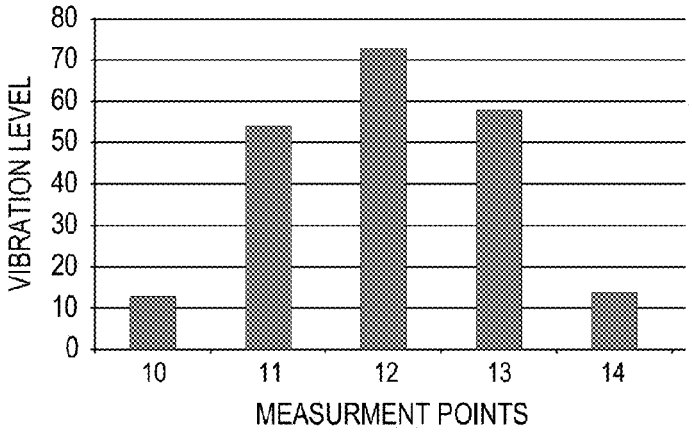
FIG. 6C is a graph for showing a vibration level distribution in a longitudinal direction of reflecting mirrors in the initial state according to the first embodiment.

FIG. 6C is a bar graph for showing a vibration level distribution in a longitudinal direction of Mst mirror 2 focusing on the vibration mode of Mst mirror 2 which is the reflecting mirror 47 including the measurement points 10 to 14. As can be seen from FIG. 6C, the vibration level is the largest at the middle portion (measurement point 12) in the longitudinal direction of the reflecting mirror 47 and decreases as approaching to both end portions (measurement points 10 and 14) supported by the optical box 49. Although a description is omitted, the other reflecting mirrors 47 also vibrate in the same vibration mode because the optical box 49 supports the reflecting mirrors 47 at both end portions of the reflecting mirrors 47. Laser scanning light passes as illustrated in FIG. 2 inside the supported portions (in the Y-axis direction) at both ends of each reflecting mirror 47, and the reflecting mirror 47 inevitably has the structure of being supported at both end portions. In other words, both end portions of the reflecting mirror 47 are supported by the optical box 49 in view of the function thereof, and hence the reflecting mirror 47 inevitably has the primary bending vibration mode in which the middle portion is a maximum amplitude portion. Therefore, as described later, as for scanning beam vibration caused by vibration of the reflecting mirror 47, the middle portion tends to have the largest vibration amount in the main scanning direction (Y-axis direction) of the reflecting mirror 47.

Figure 7:
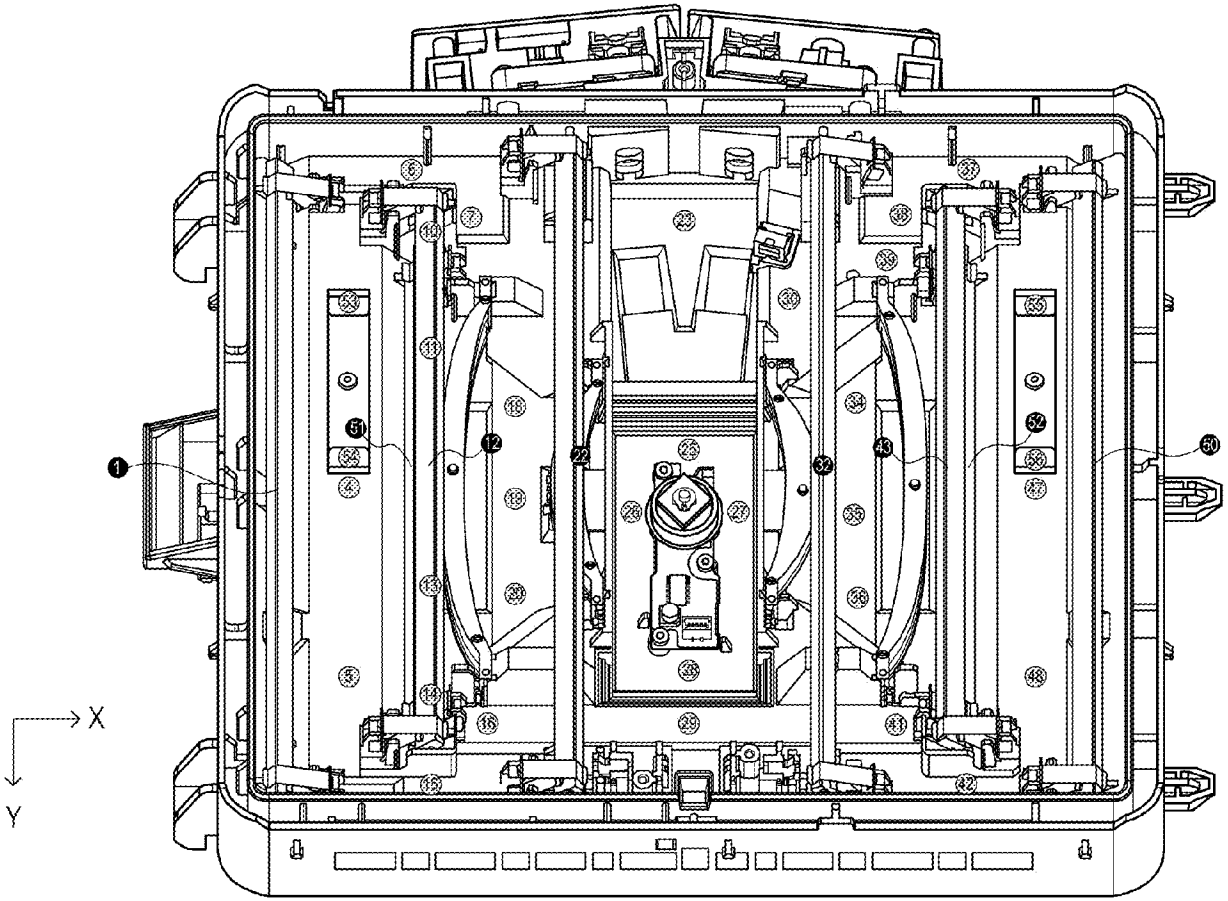
FIG. 7 is a view for illustrating vibration level measurement points in a case where the dynamic vibration absorbers are installed according to the first embodiment.

(2) Vibration Level of Light Scanning Apparatus when Dynamic Vibration Absorber is Installed Next, FIG. 7 is an illustration of respective measurement points on the optical box 49 at the time of driving of the drive motor 41 with the dynamic vibration absorbers 100 and 101 installed at the positions illustrated in FIG. 2 in comparison with the above-mentioned initial state. The positions and numbers of the respective measurement points in FIG. 7 correspond to the measurement points indicated in FIG. 5. The dynamic vibration absorbers 100 and 101 are added in FIG. 7, and hence measurement points 53 and 54 are added at both end portions of the YM-side dynamic vibration absorber 100 and measurement points 55 and 56 are added to both end portions of the CK-side dynamic vibration absorber 101, whereas the measurement points 3 and 46 are deleted.

Figure 8A:
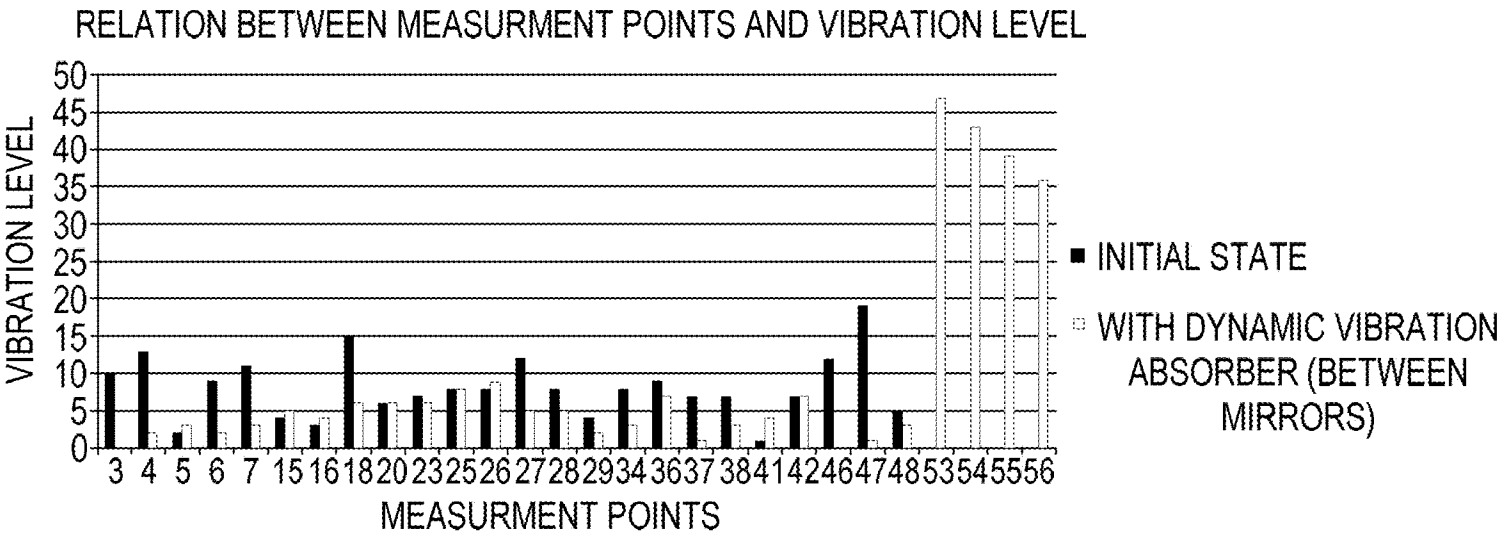
FIG. 8A and FIG. 8B are graphs for showing the vibration level at each measurement point in the initial state and that in the case where the dynamic vibration absorbers are installed according to the first embodiment.
Figure 8B:
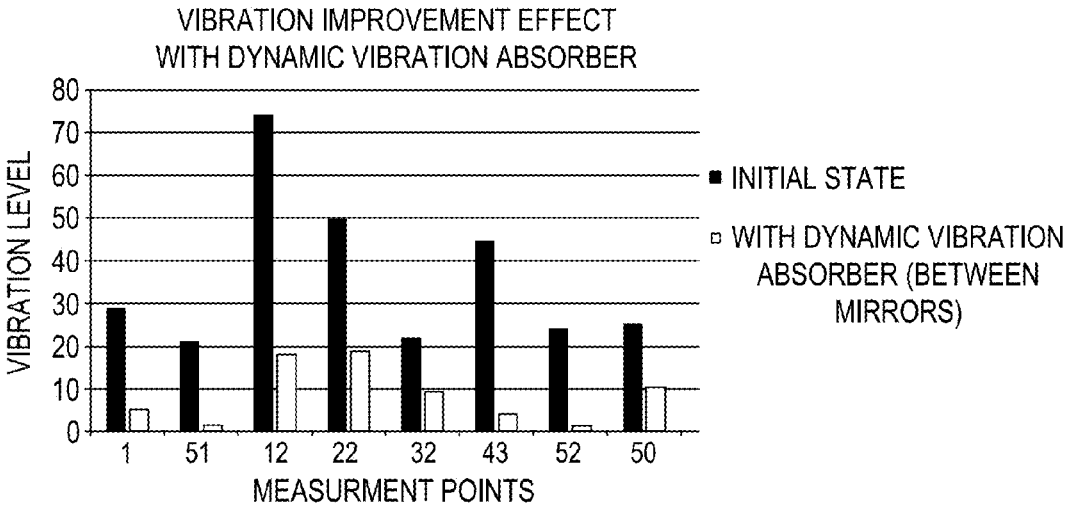

FIG. 8A is a bar graph in which the vibration levels at the respective measurement points on the optical box 49 in the structure of FIG. 7 at the time of driving of the drive motor 41 under the same conditions as in FIG. 5 are compared with the vibration levels in the initial state as measured in FIG. 5. In FIG. 8A, the vertical axis and the horizontal axis represent the vibration levels and the measurement points (numerals are measurement point numbers in FIG. 5 and FIG. 7), respectively. Two bars are indicated for each measurement point, and the bar on the left side represents the vibration level in the initial state in which no dynamic vibration absorber is installed, while the bar on the right side represents the vibration level measured when the dynamic vibration absorbers 100 and 101 are installed between the mirrors. In FIG. 7, the dynamic vibration absorbers 100 and 101 are installed at the measurement points 3 and 46 in FIG. 5, and hence the bar on the right side is not shown. Meanwhile, in FIG. 7, the YM-side dynamic vibration absorber 100 and the CK-side dynamic vibration absorber 101 are installed at the positions of the measurement points 3 and 46 in FIG. 5, respectively, and the measurement points 53 to 56 are added to both end portions of the dynamic vibration absorbers 100 and 101. As in FIG. 8A, FIG. 8B is a bar graph in which the vibration levels in the initial state at the eight measurement points 1, 51, 12, 22, 32, 43, 52, and 50 each indicating particularly high acceleration (vibration level) in the initial state are compared with the vibration levels measured when the dynamic vibration absorbers 100 and 101 are installed. In FIG. 8B, the vertical axis and the horizontal axis represent the vibration levels and the measurement points, respectively. Two bars are indicated for each measurement point, and the bar on the left side represents the vibration level in the initial state in which no dynamic vibration absorber is installed, while the bar on the right side represents the vibration level measured when the dynamic vibration absorbers 100 and 101 are installed between the mirrors.

First, in FIG. 8A, the acceleration at both end portions of the YM-side dynamic vibration absorber 100 and the CK-side dynamic vibration absorber 101 (at the measurement points 53 to 56) is the largest in the optical box 49. This is because the length of the elastic arms 105 of the dynamic vibration absorbers 100 and 101 is adjusted to set the characteristic frequency in the primary bending mode be coincident with the rotational frequency (700 Hz (42,000 rpm)) of the drive motor 41 as described above, thereby causing resonance of the dynamic vibration absorbers 100 and 101. More specifically, the dynamic vibration absorbers 100 and 101 are synchronized with their own free vibration to absorb periodically exerted vibration energy of the drive motor 41, thereby generating a large amplitude and consuming the absorbed energy as kinetic energy. It is a matter of course that the dynamic vibration absorbers 100 and 101 are not involved in laser scanning unlike the optical members such as the fθ lenses 46 and the reflecting mirrors 47 and hence do not affect laser scanning regardless of increase in the amplitude. Meanwhile, the effect of consuming vibration energy of the drive motor 41 through vibration of the dynamic vibration absorbers 100 and 101 is considerably large and, as can be seen from FIG. 8A, the vibration energy propagating over the entire optical box 49 is considerably reduced. Then, as can be seen from FIG. 8B, the vibration energy propagating to the reflecting mirrors 47 is also reduced by the dynamic vibration absorbers 100 and 101, and the vibration level at the reflecting mirrors 47 that is high in the initial state is also considerably reduced.

[Reduction Effect of Scanning Beam Vibration Amount Obtained by Dynamic Vibration Absorber]

Figure 8C:
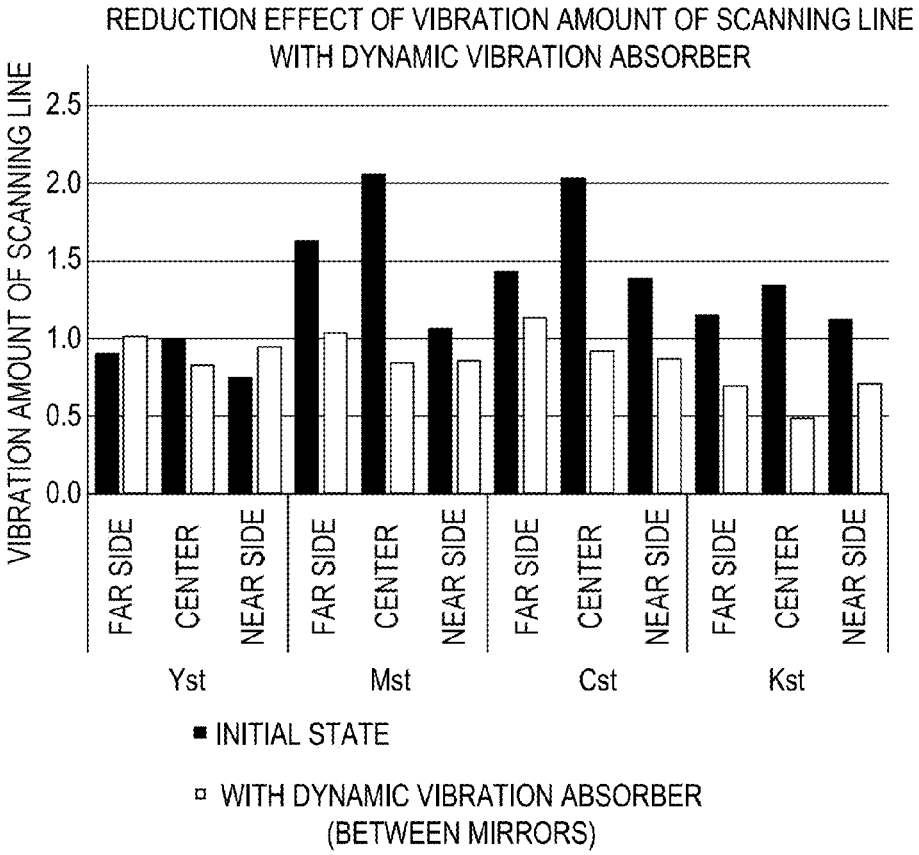
FIG. 8C is a graph for showing a maximum amplitude of scanning beam vibration in the initial state and that in the case where the dynamic vibration absorbers are installed according to the first embodiment.

FIG. 8C is a bar graph for showing maximum amplitudes in scanning beam vibration in the Z-axis direction of laser scanning light in the initial state and in the case where the dynamic vibration absorbers 100 and 101 are installed. In FIG. 8C, the vertical axis represents a scanning beam vibration amount, and the horizontal axis represents measurement points of the scanning beam vibration in the respective stations (sts) including the yellow station (Yst), the magenta station (Mst), the cyan station (Cst), and the black station (Kst), in other words, measurement points on the reflecting mirrors 47 through which the scanning beams are directed toward the respective stations. Each reflecting mirror 47 has three measurement points including a near side, a center, and a far side of the main body, and the scanning beam vibration amounts shown are normalized with respect to a Yst center value in the initial state for relative comparison. As described above, in the initial state, each reflecting mirror 47 which is in the primary bending vibration mode has a large displacement at the center in the longitudinal direction of the reflecting mirror 47, and hence the scanning beam vibration amount is also increased at the center as compared to the near side and the far side. It can be observed that the scanning beam vibration amounts in Mst and Cst, where three reflecting mirrors 47 are used, tend to be larger than Yst and Kst, where only one reflecting mirror 47 is used. In contrast, installation of the dynamic vibration absorbers 100 and 101 considerably reduces the vibration level in the reflecting mirrors 47 as described above, and hence it is understood that the scanning beam vibration amount is considerably reduced at a large number of the measurement points. Further, in each station, the displacement which is large in the initial state at the center is reduced to a level equal to or lower than the levels on the near side and the far side. This indicates that installation of the dynamic vibration absorbers 100 and 101 allows the vibration level to be reduced to a level hardly causing excitation in the primary bending vibration mode of the reflecting mirrors 47.

As can be seen from FIG. 8C, when the dynamic vibration absorbers 100 and 101 are installed, vibration amounts of the scanning beams for the respective stations are substantially at the same level. From this, it is presumed that scanning beam vibration still remaining after reduction of the vibration level through installation of the dynamic vibration absorbers 100 and 101 is caused by rotation of the drive motor 41 itself with the unbalance amount so as to generate face tilting of the rotary polygon mirror 45. According to this embodiment, the two dynamic vibration absorbers including the YM-side dynamic vibration absorber 100 and the CK-side dynamic vibration absorber 101 are installed in the optical box 49. However, the present invention is not limited thereto. One dynamic vibration absorber may be installed as long as a sufficient vibration reduction effect can be confirmed.

[First Example of Installation Position of Dynamic Vibration Absorber]

Next, locations (positions) where the dynamic vibration absorbers are to be installed on the optical box 49 are described. As described above, the vibration reduction mechanism using a dynamic vibration absorber involves setting the frequency of a vibration source to be coincident with the characteristic frequency of the dynamic vibration absorber, to thereby allow the dynamic vibration absorber to efficiently absorb vibration energy of the vibration source and vibrate itself to consume the energy. As a feature of the light scanning apparatus 40, each of the optical members such as the fθ lenses 46 and the reflecting mirrors 47 may often have the structure of being supported by at least both end portions thereof, that is, the two points generally as in this embodiment. This is because the optical members each have an elongated shape to scan the photosensitive drums 50 with laser light in their longitudinal direction (main scanning direction), and it is desirable to fix the optical members to the optical box 49 at their both end portions to stably fasten the optical members to the optical box 49 in a balanced manner. As described above, both end portions of each optical member are thus pressed against and fixed to an accuracy bearing surface for the optical member provided on the optical box 49 by a spring. Then, as described above, the vibration energy of the drive motor 41 is propagated to the optical members through the accuracy bearing surface of the optical box 49 on which both end portions of the optical members are supported.

In view of those facts, in order to reduce vibration energy to be transmitted to an optical member, a location which is effective for the accuracy bearing surfaces at both end portions in the longitudinal direction of the optical member, that is, a location between the two accuracy bearing surfaces is desirable as the location where the dynamic vibration absorber is to be installed. This is because, when the dynamic vibration absorber is installed on an outer side from the accuracy bearing surfaces at both end portions of the optical member, this installation may be effective for one bearing surface on the near side but, as for the vibration energy to be transmitted through the other accuracy bearing surface, the vibration reduction effect may not be exerted due to a long distance from the dynamic vibration absorber.

The above description relates to a measure for an installation position of the dynamic vibration absorber in the longitudinal direction of each optical member, but the following measures are taken as for the optical axis direction. More specifically, as a method of reducing vibration of the plurality of optical members with high efficiency, the dynamic vibration absorber is installed between adjacent reflecting mirrors 47 at a space between both end bearing surfaces (bearing surfaces at both ends), between adjacent fθ lenses 46 at a space between both end bearing surfaces, or between a reflecting mirror 47 and an fθ lens 46 adjacent to each other at a space between both end bearing surfaces of the reflecting mirror 47 and also both end bearing surfaces of the fθ lens 46. Vibration of the plurality of optical members adjacent to each other can be thus reduced by one dynamic vibration absorber.

Figure 9:
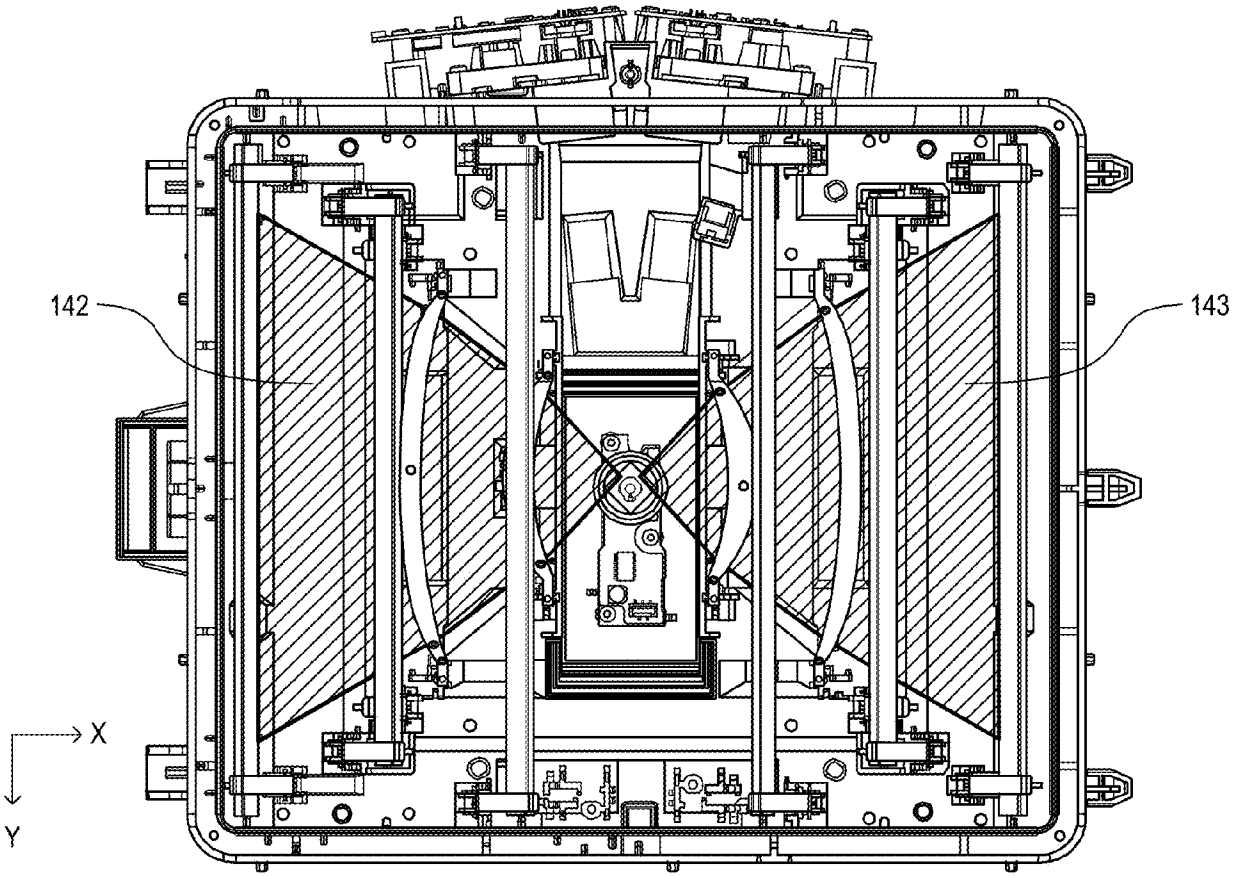
FIG. 9 is a top view for illustrating main scanning light beam paths in the light scanning apparatus according to the first embodiment.
Figure 10:
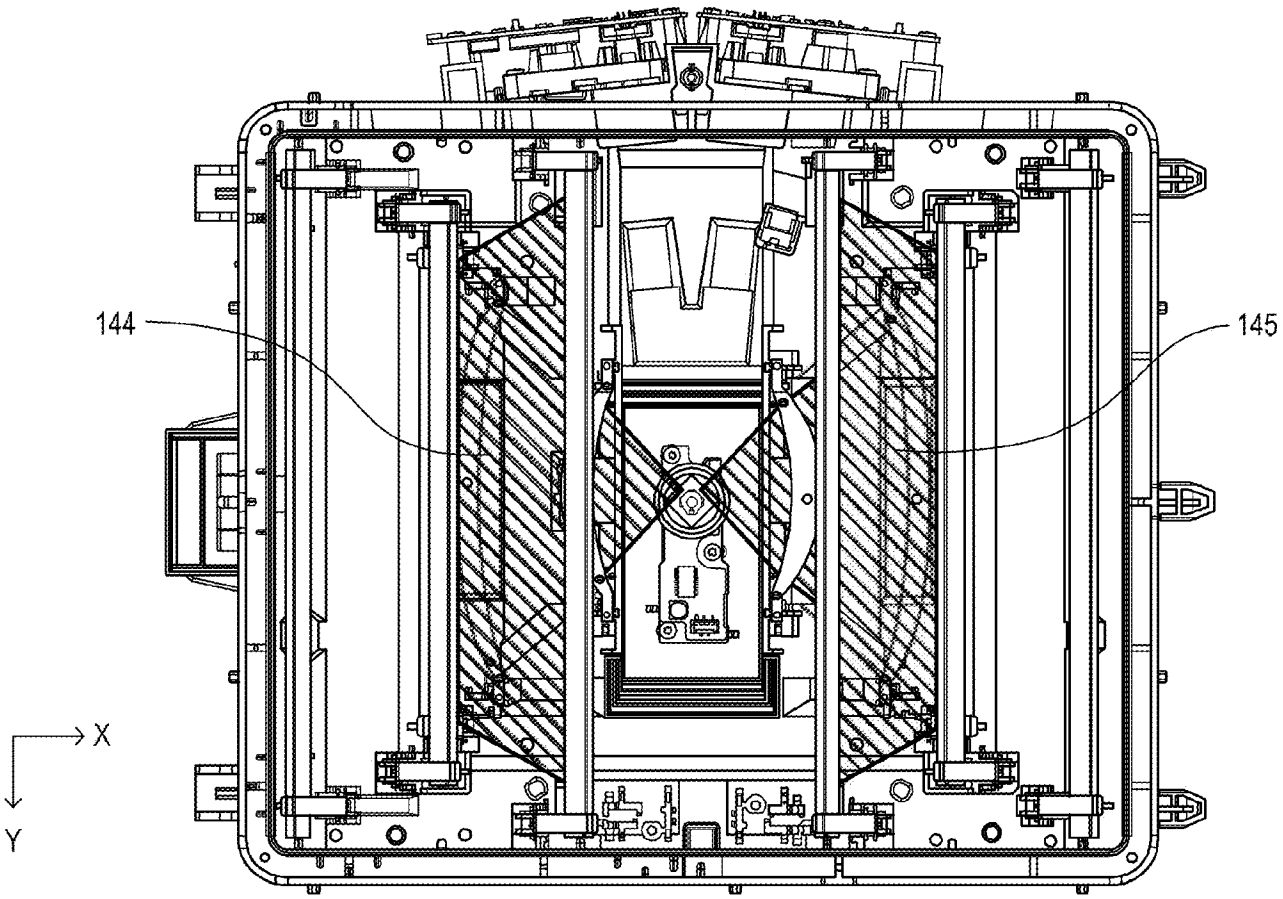
FIG. 10 is a top view for illustrating main scanning light beam paths in the light scanning apparatus according to the first embodiment.

In other words, a region where the above-mentioned dynamic vibration absorber is installed is equivalent to a region which includes a light beam path in the main scanning direction (referred to also as "main scanning light beam path") and an installation position of the dynamic vibration absorber in an overlapping manner. Therefore, an optical path region of the main scanning light beam path according to the embodiment is now defined. FIG. 9 is a view for illustrating optical path regions, indicated by hatching, through which a Yst main scanning light beam path 142 and a Kst main scanning light beam path 143 pass, respectively. FIG. 10 is a view for illustrating optical path regions, indicated by hatching, through which an Mst main scanning light beam path 144 and a Cst main scanning light beam path 145 pass, respectively. In FIG. 9 and FIG. 10, each main scanning light beam path is substantially equivalent to a region formed by connecting supported portions at both ends of the plurality of optical members.

Figure 11:
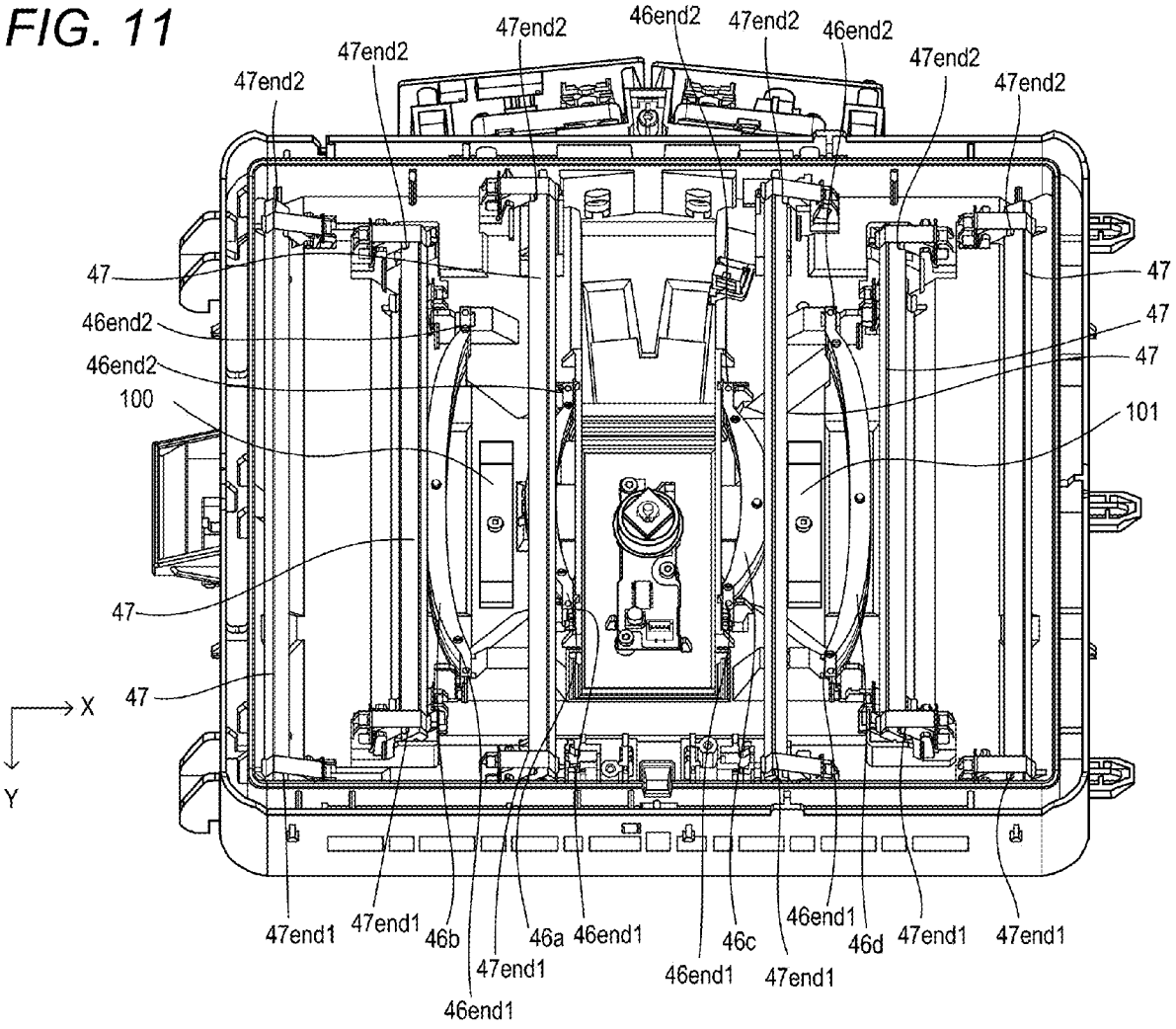
FIG. 11 is a perspective view for illustrating installation positions of the dynamic vibration absorbers according to the first embodiment.
Figure 12:
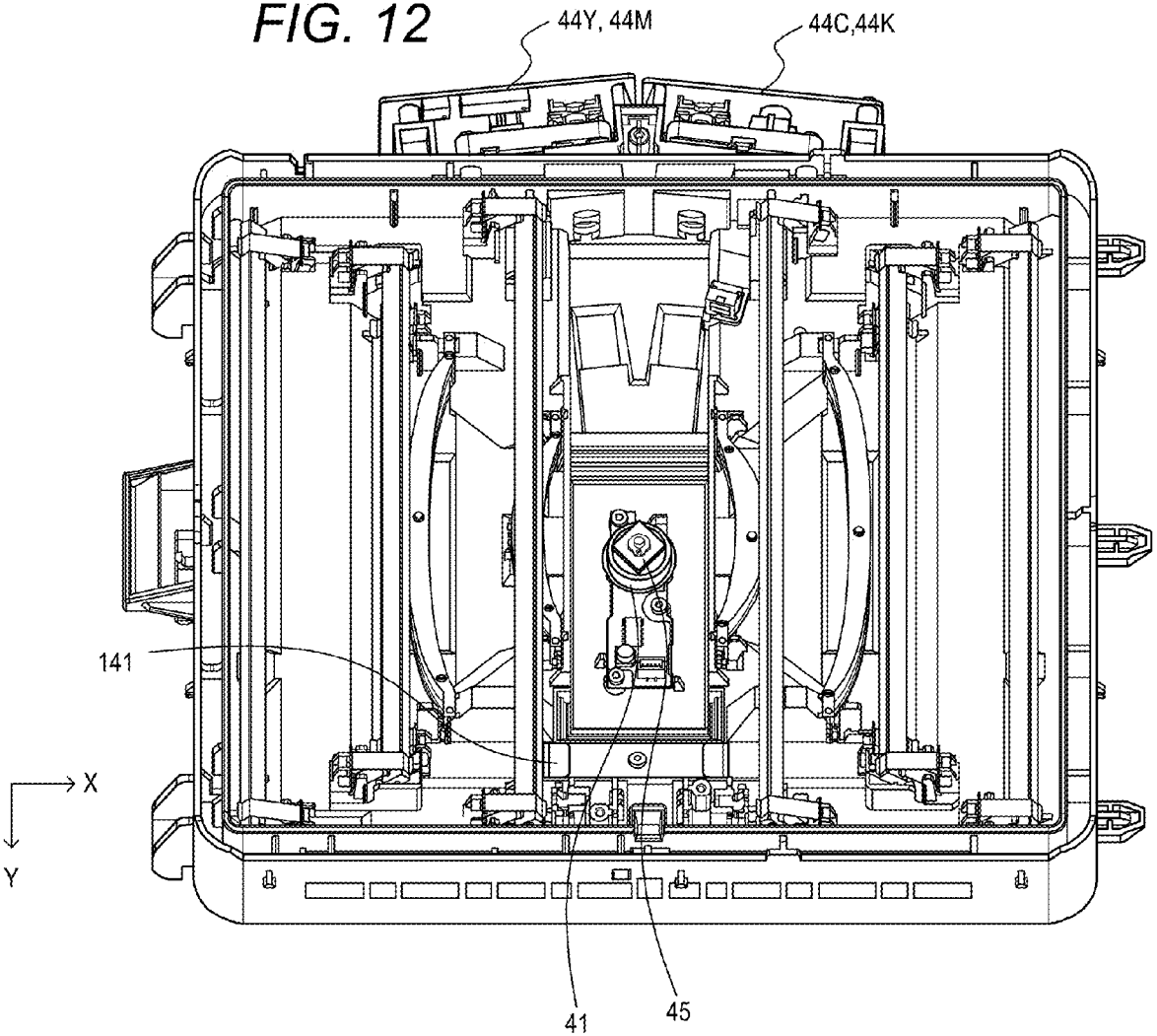
FIG. 12 is a perspective view for illustrating an installation position of the dynamic vibration absorber according to the first embodiment.

Differences in the vibration reduction effect of the optical members between a case where the dynamic vibration absorbers are installed within the main scanning light beam paths 142 to 145 and a case where the dynamic vibration absorbers are installed outside the main scanning light beam paths 142 to 145 are described below with reference to FIG. 2 and FIG. 11 to FIG. 13. As described above, FIG. 2 is an illustration of an example in which the YM-side dynamic vibration absorber 100 and the CK-side dynamic vibration absorber 101 are installed between the fθ lens 46 and the Yst final reflecting mirror 47 (or between the Yst and Kst final reflecting mirrors 47), respectively. In contrast, FIG. 11 is an illustration of an example in which the YM-side dynamic vibration absorber 100 is installed between YM-side fθ lenses 46*a* and 46*b*, and the CK-side dynamic vibration absorber 101 is installed between CK-side fθ lenses 46*c* and 46*d*. Each of the dynamic vibration absorbers 100 and 101 is disposed between (on an inner side of) both end portions 47end1 and 47end2 in the longitudinal direction of each reflecting mirror 47. Further, each of the dynamic vibration absorbers 100 and 101 is disposed between (on an inner side of) both end portions 46end1 and 46end2 in the longitudinal direction of each fθ lens 46. As can be seen from FIG. 2 and FIG. 11, the dynamic vibration absorbers are installed within the main scanning light beam paths illustrated in FIG. 9 and FIG. 10. In contrast, according to FIG. 12, a dynamic vibration absorber 141 is installed on an opposite side to the light source units 44 across the drive motor 41 (on a side closer to an upright wall portion on an opposite side to another upright wall portion on which the light source units 44 are mounted). In other words, FIG. 12 is an illustration of an example in which the dynamic vibration absorber 141 is installed outside the main scanning light beam paths illustrated in FIG. 9 and FIG. 10.

Figure 13:
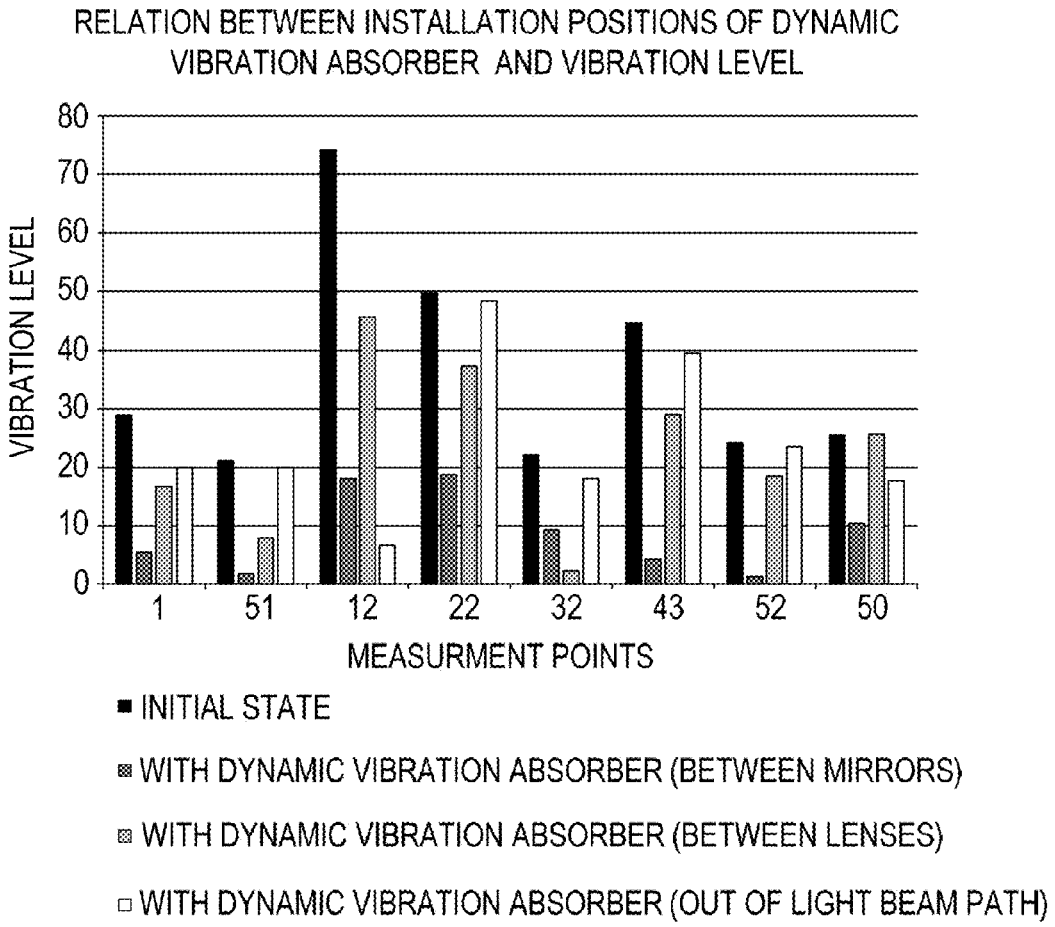
FIG. 13 is a graph for showing a relation between installation positions of the dynamic vibration absorbers according to the first embodiment and a vibration level of each reflecting mirror.

FIG. 13 is a bar graph in which the vibration levels are compared for each installation position of the dynamic vibration absorber at eight measurement points on the reflecting mirrors 47 where the vibration levels (accelerations) are particularly high in the initial state (FIG. 5) among the respective measurement points on the optical box 49. In FIG. 13, the vertical axis represents the vibration level, and the horizontal axis represents the measurement points 1, 51, 12, 22, 32, 43, 52, and 50. In an order from the left side, the initial state (FIG. 5), the case where the dynamic vibration absorbers are installed between the reflecting mirrors (FIG. 2), the case where the dynamic vibration absorbers are installed between the fθ lenses (FIG. 11), and the case where the dynamic vibration absorber is installed outside the main scanning light beam paths (FIG. 12) are shown for the vibration level at each measurement point. In the structure of each of FIG. 2 and FIG. 11 in which the dynamic vibration absorbers are disposed within the main scanning light beam paths, it can be confirmed that the vibration level is considerably reduced as compared to the initial state (FIG. 5). In contrast, in the structure of FIG. 12 in which the dynamic vibration absorber is installed outside the main scanning light beam paths, an improvement can be observed over the initial state (FIG. 5), but in comparison with the structures in FIG. 2 and FIG. 11, it is understood that an improvement effect is low at a large number of the measurement points. The above-mentioned results show that, in consideration of the shape of the optical members due to the function of the light scanning apparatus 40, the inside of the main scanning light beam paths 142 to 145 is desirable to install the dynamic vibration absorbers in the optical axis direction, in order for the dynamic vibration absorbers to exert the reduction effect.

According to this embodiment, a dynamic vibration absorber having a thin plate shape has been described. However, the shape is not limited to the thin plate shape as long as the dynamic vibration absorber is installed within the main scanning light beam paths. In other words, also in such a mode of a dynamic vibration absorber as in the related art in which a mass is placed on a damper made of rubber or the like, the same effect is obtained as long as the dynamic vibration absorbers are installed within the main scanning light beam paths. Further, in terms of manufacturing costs, this embodiment assumes press working that can easily achieve mass production and the dynamic vibration absorber being made of metal and having the thin plate shape has been described. However, the dynamic vibration absorber is not limited to the one manufactured by press working. The same vibration reduction effect is obtained even when dynamic vibration absorbers of the same shape are manufactured by cutting from a metal block, for example.

[Second Example of Installation Position of Dynamic Vibration Absorber]

Subsequently, installation locations that allow the vibration reduction effect obtained by the dynamic vibration absorbers to be further enhanced is described in a case where the dynamic vibration absorbers are installed within the main scanning light beam paths. As described above, the vibration reduction mechanism using a dynamic vibration absorber involves setting the frequency of a vibration source to be coincident with the characteristic frequency of the dynamic vibration absorber, to thereby allow the dynamic vibration absorber to efficiently absorb vibration energy of the vibration source and vibrate itself to consume the energy. Therefore, the locations where the dynamic vibration absorbers are to be installed on the optical box 49 need to be locations where the vibration energy from the vibration source is efficiently propagated to the dynamic vibration absorbers and desirably have a relatively larger amplitude level on the optical box 49 by necessity.

Figure 14:
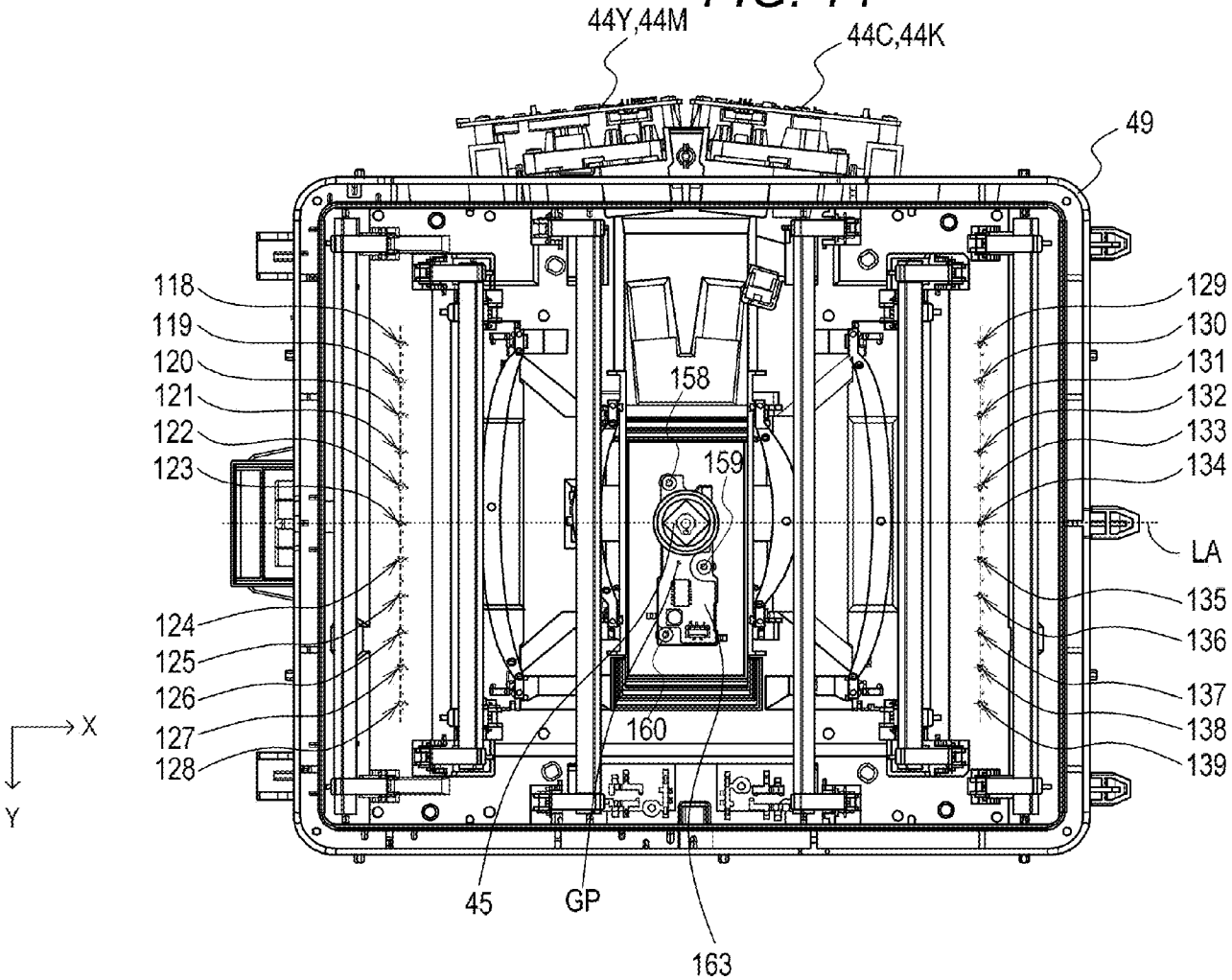
FIG. 14 is a top view for illustrating points of vibration measurement and installation of the dynamic vibration absorbers according to the first embodiment.
Figure 15A:
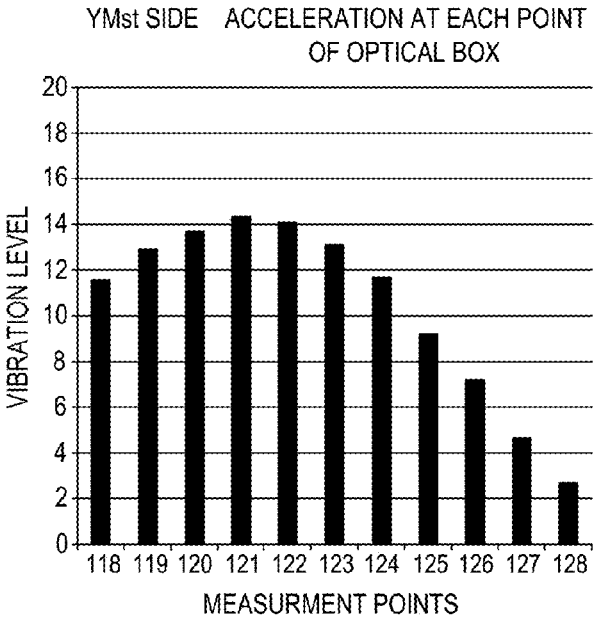
FIG. 15A and FIG. 15B are graphs for showing the vibration level at each measurement point according to the first embodiment.
Figure 15B:
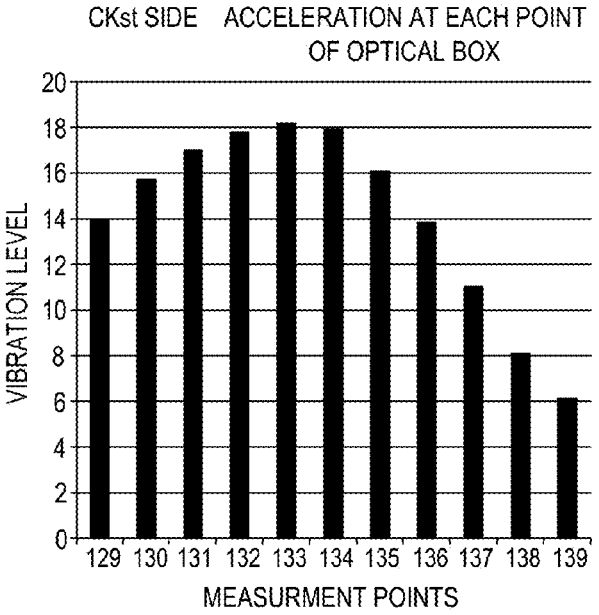

FIG. 15A and FIG. 15B are graphs for showing the levels of vibration of the drive motor 41 at respective measurement points in the longitudinal direction of the optical members illustrated in FIG. 14 within the main scanning light beam paths 142 and 143 of the optical box 49. The measurement points in FIG. 14 are provided in the longitudinal direction (Y-axis direction) in which the dynamic vibration absorbers 100 and 101 are installed in FIG. 2, and measurement points 118 to 128 and measurement points 129 to 139 are provided on the dynamic vibration absorber 100 side and the dynamic vibration absorber 101 side, respectively. The vibration levels at the measurement points 118 to 128 on the optical box 49 on the dynamic vibration absorber 100 side (YMst side) are shown in the bar graph in FIG. 15A, and the vibration levels at the measurement points 129 to 139 on the optical box 49, on the dynamic vibration absorber 101 side (CKst side) are shown in the bar graph in FIG. 15B. In both graphs of FIG. 15A and FIG. 15B, the horizontal axis represents the measurement points on the optical box 49, and the vertical axis represents the vibration level. In FIG. 15A, the measurement point 121 on the optical box 49 indicates a vibration level peak on the YMst side, and in FIG. 15B, the measurement point 133 on the optical box 49 indicates a vibration level peak on the CKst side. It is understood that the overall vibration level is distributed in such a mountain-like shape (in a convex shape) that the vibration level has a peak in the vicinity of the middle in the longitudinal direction of the optical members and decreases as approaching to the end portions.

Such a vibration level distribution is obtained due to the shape of the optical box in which the upright wall portions for hermetically closing the optical box 49 are provided in directions of both end portions to have high rigidity, but scanning beams pass in the vicinity of the middle so that a tall rib like the upright wall portions cannot be provided. In other words, an area moment of inertia with respect to the Y-axis in the Y-Z cross-section is lower in the vicinity of the middle than at the end portions, with the result that the amount of displacement with respect to external force is increased. Therefore, membrane vibration having nodes at the end portions and a vibration antinode in the vicinity of the middle tends to occur, and this phenomenon cannot be avoided in view of the function of the light scanning apparatus 40. In a strict sense, the mountain-like shape of the vibration level is not an upwardly protruding shape having apexes at the measurement points 123 and 134 in the optical box 49 which are at the same positions in the Y-axis direction as the axis of the drive motor 41. In the mountain-like shape of the vibration level in the longitudinal direction of the optical members, the vibration level is relatively higher on the side on which the light source units 44 are disposed because of the shape and arrangement of the circuit board on which the drive motor 41 is disposed.

As illustrated in FIG. 14, a circuit board 163 on which the drive motor 41 is mounted is fastened to the optical box 49 with screws at three points including a first drive motor fastening portion 158, a second drive motor fastening portion 159, and a third drive motor fastening portion 160. Therefore, the propagation of vibration energy from the drive motor 41 to the optical box 49 occurs on bearing surfaces of the three fastening portions as main propagation paths. When the optical box 49 is divided by a dotted line LA in the X-axis direction (optical axis direction) in FIG. 14 based on the rotational axis of the drive motor 41, the three screw fastening positions in the longitudinal direction (Y-axis direction) of the optical members are as follows. More specifically, the first drive motor fastening portion 158 is located on a side on which the light source units 44 are disposed (hereinafter referred to also as "laser side"). In contrast, the second drive motor fastening portion 159 and the third drive motor fastening portion 160 are located on a side on which no light source units 44 are disposed (hereinafter referred to also as "contra-laser side"). The ratio of the screw fastening positions located on the contra-laser side is high, and hence a gravity center position GP formed by the three screw fastening positions is located on the contra-laser side of the divided optical box 49. When those facts are comprehensively taken into account, portions through which vibration energy of the drive motor 41 flows into the optical box 49 can be regarded as the fastening portions on the contra-laser side.

In the longitudinal direction (Y-axis direction) of the optical members, the rotary polygon mirror 45 driven to rotate about the rotational axis of the drive motor 41 is generally disposed substantially at the center on the optical box 49. However, as described above, according to this embodiment, portions through which the vibration energy of the drive motor 41 flows are positioned on the contra-laser side, and the distance from each flowing portion to the upright wall portion of the optical box 49 having high rigidity is larger on the laser side than on the contra-laser side. Therefore, the amplitude (vibration level) tends to be increased more on the laser side (in the case of this embodiment, the side having a smaller number of screw fastening points in the circuit board 163 based on the rotational axis of the drive motor 41) than on the contra-laser side. In view of the phenomenon due to the shape of the optical box 49 as described above, also within the light beam paths, the dynamic vibration absorber is desirably installed in the vicinity of the center of the optical box 49 where a vibration antinode is naturally formed. Further, even in the vicinity of the center, the dynamic vibration absorber is desirably installed on a side on which there is no gravity center of the screw fastening points for fixing the circuit board 163 of the drive motor 41 to the optical box 49, in other words, on the laser side based on the rotational axis of the drive motor 41 where a vibration antinode peak is formed.

Figure 15C:
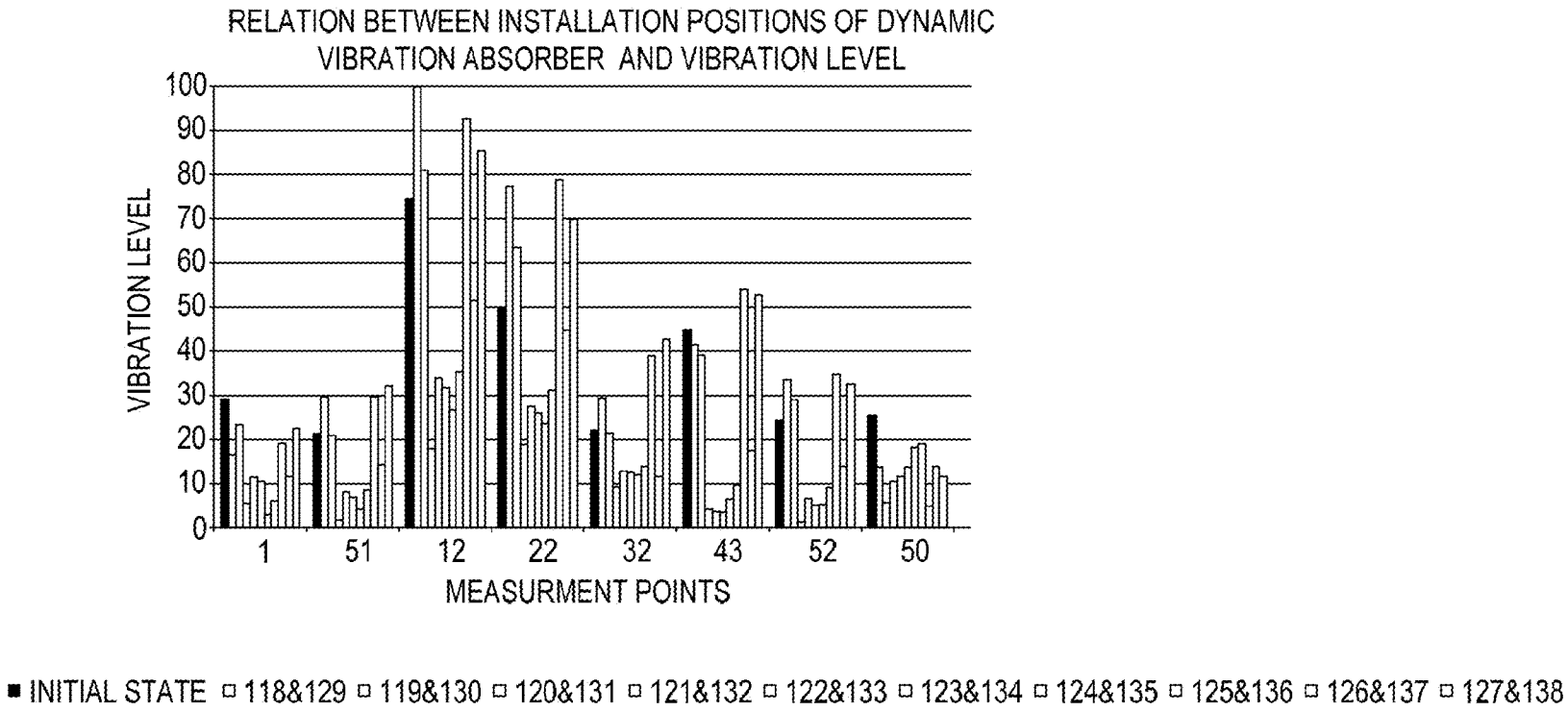
FIG. 15C is a graph for showing a relation between the installation positions of the dynamic vibration absorbers and the vibration level of each reflecting mirror.

FIG. 15C is a bar graph for showing the vibration levels in a case where the dynamic vibration absorbers are installed at the measurement points illustrated in FIG. 14, and the vibration levels are measured at eight measurement points on the reflecting mirrors 47 where the vibration level is particularly high in the initial state. In FIG. 15C, the vertical axis represents the vibration level, and the horizontal axis represents the eight measurement points 1, 51, 12, 22, 32, 43, 52, and 50 where the vibration level is particularly high in the initial state. At each measurement point, the vibration level in the initial state (black) and the vibration levels in ten dynamic vibration absorber installation patterns are indicated by bars. In an order from the left, there are ten dynamic vibration absorber installation patterns starting from a pattern in which the YM-side dynamic vibration absorber 100 and the CK-side dynamic vibration absorber 101 are installed at the measurement points 118 and 129, respectively, and ending by a pattern in which the YM-side dynamic vibration absorber 100 and the CK-side dynamic vibration absorber 101 are installed at the measurement points 127 and 138, respectively.

Referring to FIG. 15C, reduction of the vibration level from the vibration level in the initial state is not observed in some cases when the dynamic vibration absorbers 100 and 101 are installed on the end portion sides. However, as the installation position moves toward the vicinity of the middle, the vibration level of each reflecting mirror 47 is reduced. Then, it is understood that the vibration level tends to be increased again as the installation position of each of the dynamic vibration absorbers 100 and 101 further moves from the vicinity of the middle to the other end portion side. In FIG. 15C, bars at each measurement point do not form a strictly downwardly protruding simple shape having one minimum point because of an influence of the arrangement of ribs disposed on the back surface of the bottom portion 49*a* of the optical box 49. More specifically, it is understood that the dynamic vibration absorbers 100 and 101 tend to have a higher vibration level reduction effect when installed on the laser side from the rotational axis of the drive motor 41.

As described above, when the dynamic vibration absorbers are installed in the optical box 49 of the light scanning apparatus 40 to reduce vibration and noise caused by the drive motor 41, it is suitable for the dynamic vibration absorbers to be installed at the following positions. More specifically, the dynamic vibration absorbers are suitably installed within the main scanning light beam paths in the vicinity of the middle away from the walls in the outer peripheral portion of the optical box 49 in the longitudinal direction of the optical members, and on the side on which there is no gravity center of the fastening points for fixing the circuit board 163 of the drive motor 41 to the optical member 49. Accordingly, energy consumed by vibration of the dynamic vibration absorbers increases, with the result that vibration energy propagating to the scanning imaging optical system such as the fθ lenses and the reflecting mirrors can be suppressed, thereby suppressing image deterioration and noise.

As described above, according to this embodiment, vibration and noise caused concomitantly with rotation of the drive motor can be reduced while achieving downsizing.

Second Embodiment

In the second embodiment, the structure of the dynamic vibration absorber, which is capable of securing a large clearance between the dynamic vibration absorber and a scanning beam passing above the dynamic vibration absorber in the Z-axis direction to reduce the risk that the dynamic vibration absorber may interfere with the scanning beam, is described. The functions of a printer serving as an image forming apparatus and the light scanning apparatus 40 are the same as those in the first embodiment, and hence their description is omitted below and differences from the first embodiment are only described.

[Structure of Dynamic Vibration Absorber]

Figure 16:
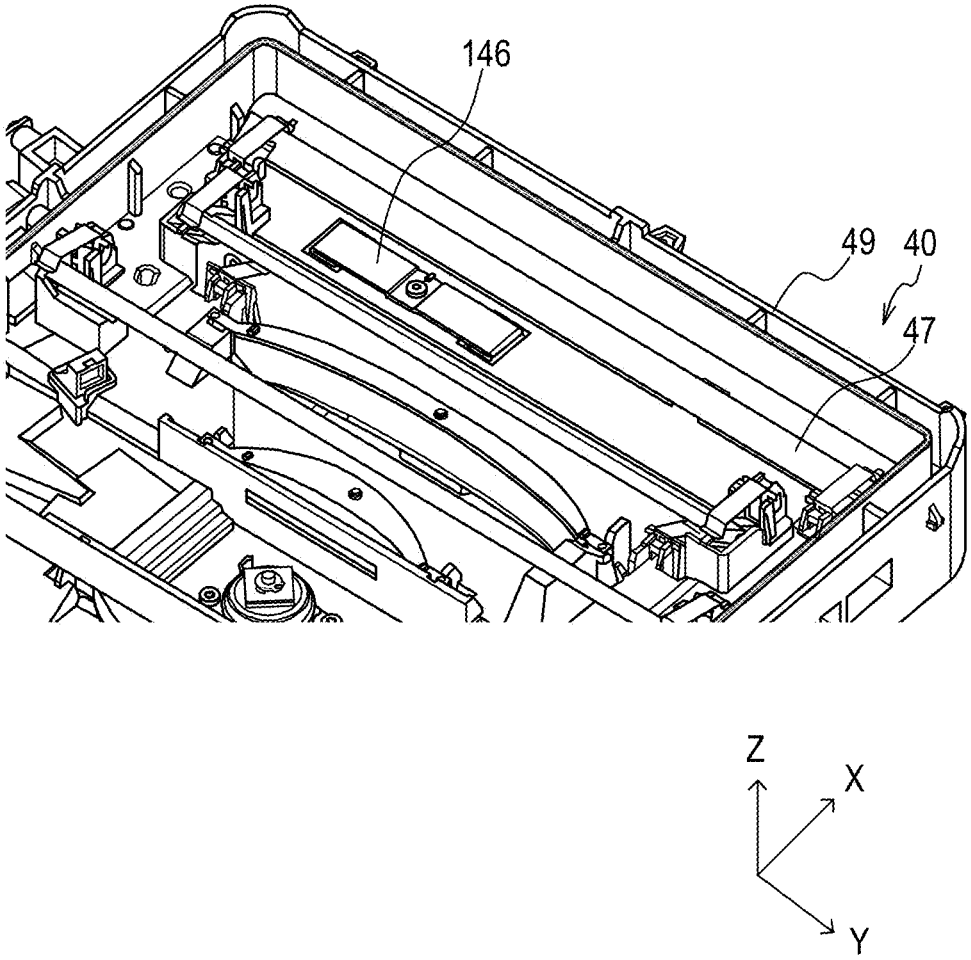
FIG. 16 is a perspective view for illustrating the light scanning apparatus according to the second embodiment.
Figure 17A:
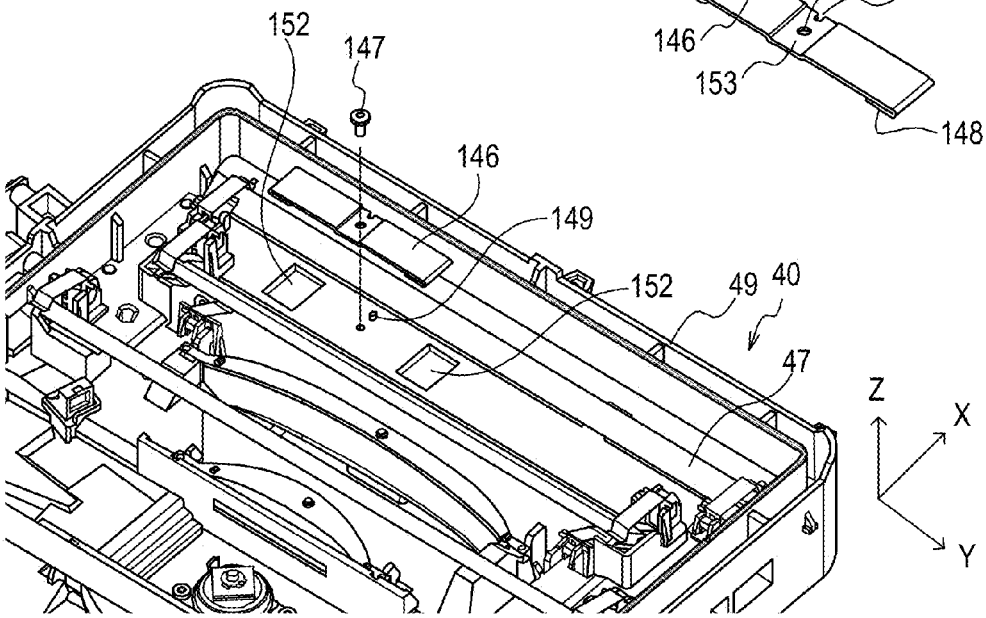
FIG. 17A is a perspective view for illustrating mounting of a dynamic vibration absorber according to the second embodiment.
Figure 17B:
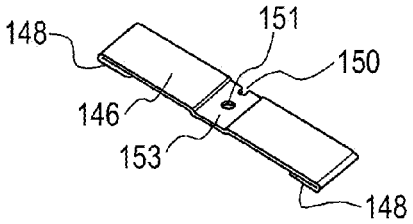
FIG. 17B is a perspective view of the dynamic vibration absorber according to the second embodiment.

FIG. 16 is a perspective view for illustrating, on an enlarged scale, a peripheral portion of a CK-side dynamic vibration absorber 146 (referred to also as "dynamic vibration absorber 146") installed in the optical box 49 according to this embodiment. A position where the CK-side dynamic vibration absorber 146 is installed in the optical box 49 is the same as the position where the CK-side dynamic vibration absorber 101 according to the first embodiment is installed (see FIG. 3A). FIG. 17A is a perspective view for illustrating how the dynamic vibration absorber 146 is mounted to the optical box 49. FIG. 17B is a perspective view for illustrating a shape of the dynamic vibration absorber 146. Although the CK-side dynamic vibration absorber 146 is only illustrated in FIG. 16 and FIG. 17A, a YM-side dynamic vibration absorber (not shown) similar to the CK-side dynamic vibration absorber 146 is installed at the same position as that of the YM-side dynamic vibration absorber 100 according to the first embodiment in FIG. 2. The structure of the YM-side dynamic vibration absorber and a method of mounting the YM-side dynamic vibration absorber to the optical box 49 are the same as those for the CK-side dynamic vibration absorber 146. Accordingly, the CK-side dynamic vibration absorber 146 (hereinafter referred to also as "dynamic vibration absorber 146") is used in the following description.

As illustrated in FIG. 17A and FIG. 17B, the screw hole 151 is formed in the middle of the dynamic vibration absorber 146, and the dynamic vibration absorber 146 is fastened to the optical box 49 with a fastening screw 147. The dynamic vibration absorber 146 according to this embodiment has a cut-out portion 150, and a rotation stopper 149 which is a protrusion formed on the optical box 49 is fitted into the cut-out portion 150 to restrict relative movement in the longitudinal direction (Y-axis direction) of the optical members. Further, the diameter of the screw hole 151 of the dynamic vibration absorber 146 is equal to the screw diameter of the fastening screw 147, and hence the fitting into the cut-out portion 150 plays a role in stopping rotation of the dynamic vibration absorber 146. The cut-out portion 150 is thus formed in the vicinity of the screw hole 151 formed in the middle in the longitudinal direction of the dynamic vibration absorber 146 at a portion where the amplitude in the primary bending mode is the smallest. This allows installation of the dynamic vibration absorbers with a high degree of accuracy while minimizing influence of formation of the rotation stopper 149 on the primary bending mode.

Figure 17C:
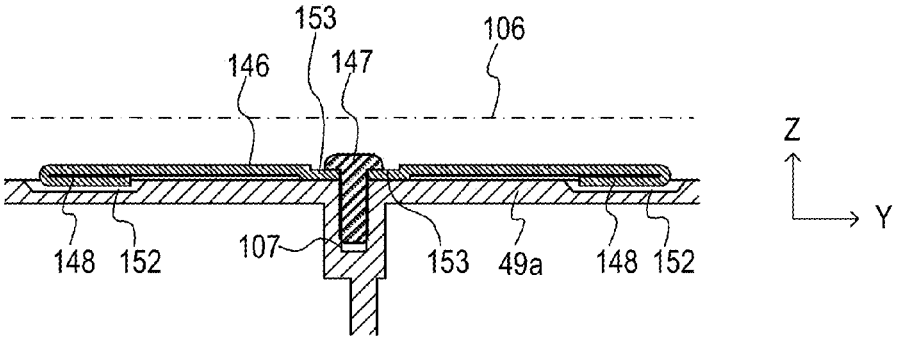
FIG. 17C is a cross-sectional view of the dynamic vibration absorber according to the second embodiment.

The dynamic vibration absorber 146 according to this embodiment has a feature in that a large clearance can be secured between the dynamic vibration absorber 146 and the scanning beam passing above the dynamic vibration absorber 146 to reduce the risk that the dynamic vibration absorber 146 may interfere with the laser light (scanning light). FIG. 17C is a cross-sectional view of the structure in which the CK-side dynamic vibration absorber 146 is fastened to the optical box 49 with the screw, and the CK-side dynamic vibration absorber 146 is taken along its longitudinal direction including a central axis of the fastening screw 147. Instead of forming the convex bearing surface (accuracy bearing surface) on the optical box 49 as in the first embodiment, the dynamic vibration absorber 146 has a step-bent portion 153 (which is formed by so-called Z-bending and hereinafter referred to as "Z-bent portion 153"), which forms a bearing surface as the contact surface with the optical box 49. As illustrated in FIG. 17C, the Z-bent portion 153 has a feature in that a step of the Z-bent portion 153 has a thickness equal to or smaller than a thickness of the dynamic vibration absorber 146. With this structure, a height of a screw head of the fastening screw 147, at which the clearance in a height direction between the scanning beam 106 and the dynamic vibration absorber 146 is the smallest, can be reduced. When the height of the screw head is to be further reduced, for example, a method of using a screw having a countersunk screw head shape may also be used.

As described above, the optical box 49 has no accuracy bearing surface for the dynamic vibration absorber 146, thereby being effective as countermeasures against urgent vibration trouble caused by the drive motor 41. More specifically, when the level of vibration caused by the drive motor 41 needs to be reduced, the vibration level can be reduced by installing the dynamic vibration absorber 146 as long as the optical box 49 has a screw hole for installing the dynamic vibration absorber 146 in advance.

In the first embodiment, both ends of the dynamic vibration absorber 101 are hemmed in an upward direction (Z-axis positive direction). According to this embodiment, in order to secure the clearance to the scanning beam 106, the dynamic vibration absorber 146 has back surface hemmed portions 148 each obtained by changing the bending direction to a downward direction (Z-axis negative direction) facing the bottom surface of the optical box 49. In order to avoid interference of the back surface hemmed portion 148 with the optical box 49, the optical box 49 has relieved portions 152 to prevent the back surface hemmed portion 148 from coming into contact with the optical box 49. The dynamic vibration absorber 146 having the above-mentioned structure can secure the clearance to the scanning beam 106, thereby being capable of improving reliability at the time of installation of the dynamic vibration absorber. The dynamic vibration absorber 146 described in this embodiment may also be applied in the above-described installation position of the dynamic vibration absorber according to the first embodiment.

As described above, according to this embodiment, vibration and noise caused concomitantly with rotation of the drive motor can be reduced while achieving downsizing.

Third Embodiment

According to the first and second embodiments, the dynamic vibration absorbers are installed inside the optical box in which the optical members are supported. According to a third embodiment of the present invention, there is described the structure in a case where dynamic vibration absorbers are installed on a back surface of the optical box on which no optical member is disposed. The functions of a printer serving as an image forming apparatus and the light scanning apparatus 40 are the same as those in the first embodiment, and hence their description is omitted below and differences from the first embodiment are only described.

[Structure of Dynamic Vibration Absorber]

Figure 18:
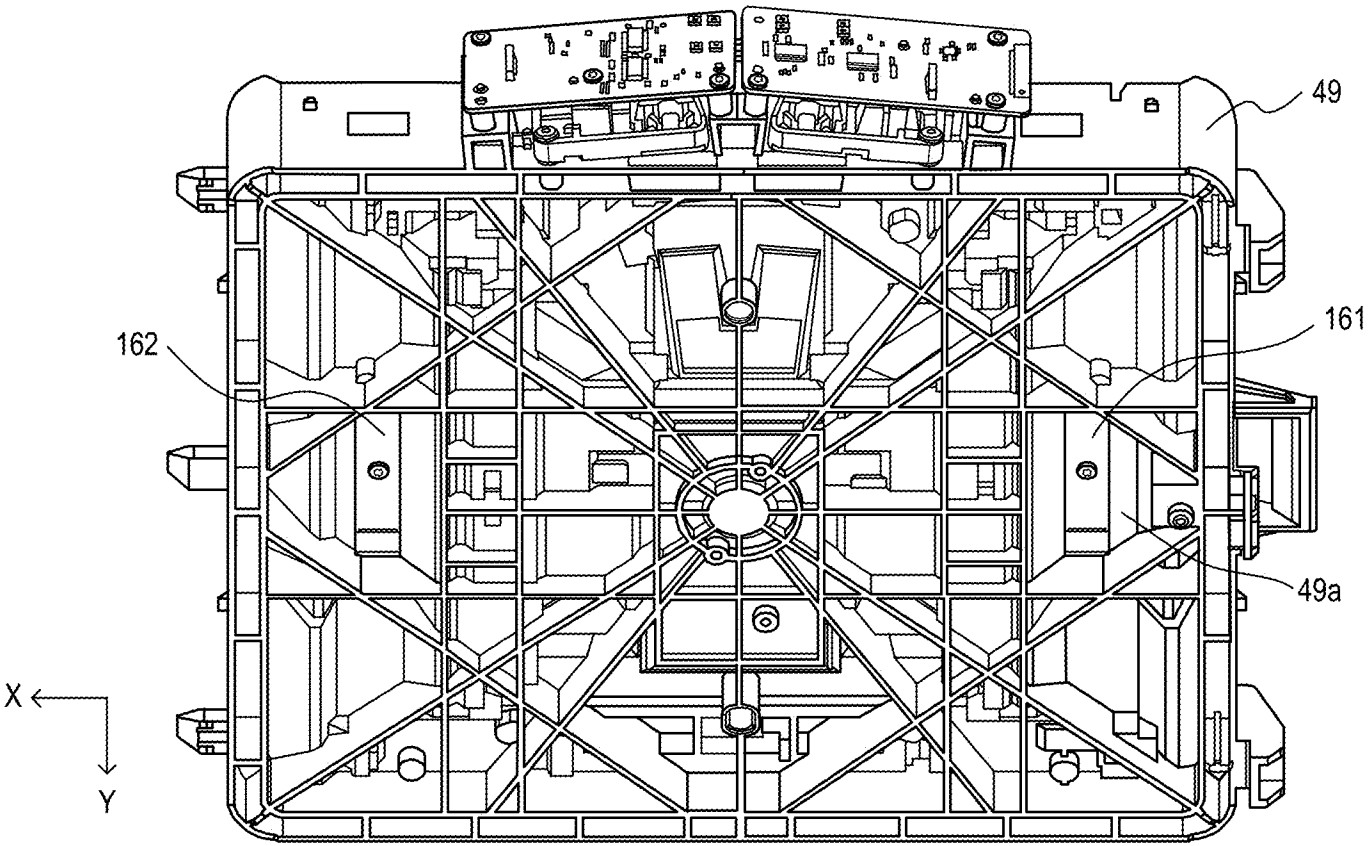
FIG. 18 is a perspective view for illustrating mounting of dynamic vibration absorbers according to the third embodiment.

FIG. 18 is a perspective view of the optical box 49 according to this embodiment when viewed from the back surface side. As illustrated in FIG. 18, dynamic vibration absorbers are fixed to the back surface opposite to the bottom surface of the bottom portion 49*a* of the optical box 49 to which the optical members are fixed. A YM-side back surface dynamic vibration absorber 161 and a CK-side back surface dynamic vibration absorber 162 are installed on the back surface and fastened to the optical box 49 with screws. As described in the first embodiment, in order to reduce vibration energy to be transmitted to an optical member, it is desired that the dynamic vibration absorber be installed in a location which has an effect on the accuracy bearing surfaces at both ends in the longitudinal direction of the optical member, in other words, within the main scanning light beam path situated between the bearing surfaces of the optical member. According to the first embodiment, the dynamic vibration absorbers are installed on the surface (bottom surface) of the bottom portion 49*a* of the optical box 49 on which the optical members are supported. However, substantially the same reduction effect can be obtained even when the dynamic vibration absorbers are installed at the same positions on the back surface of the bottom portion 49*a*.

In general, reinforcement ribs are often formed across the length and breadth of the back surface of the optical box 49 in order to add some strength to the optical box 49. Therefore, when the dynamic vibration absorbers can be installed in space where no reinforcement rib is formed as in FIG. 18, there is no risk of interference of the dynamic vibration absorbers with scanning beams as in the first and second embodiments, and a vibration reduction effect can be obtained. Further, as illustrated in FIG. 18, each of the YM-side back surface dynamic vibration absorber 161 and the CK-side back surface dynamic vibration absorber 162 has both ends with hemmed portions bent on the opposite side to the optical box 49, as in the dynamic vibration absorbers according to the first embodiment. For example, the same structure as that of the dynamic vibration absorber 146 described in the second embodiment may be applied to the YM-side back surface dynamic vibration absorber 161 and the CK-side back surface dynamic vibration absorber 162 to form relieved portions on the back surface of the optical box 49, to thereby prevent interference of the back surface hemmed portions with the optical box 49.

As described above, according to this embodiment, vibration and noise caused concomitantly with rotation of the drive motor can be reduced while achieving downsizing. According to this embodiment, image deterioration and noise due to vibration caused concomitantly with rotation of the drive motor can be reduced with the simple structure.

Fourth Embodiment

A fourth embodiment of the present invention is described below with reference to FIG. 19 to FIG. 31.

[Overview of Image Forming Process in Image Forming Apparatus]

Figure 19:
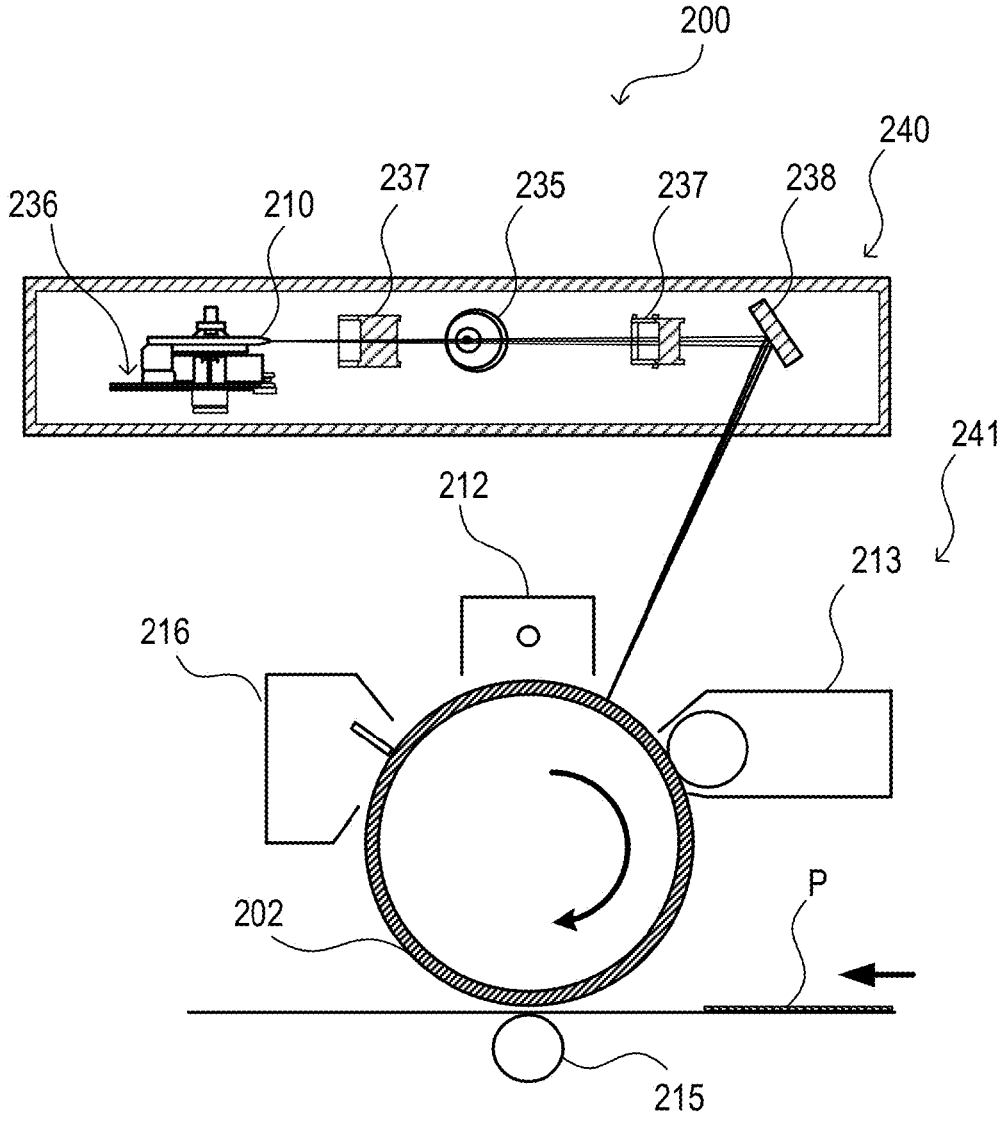
FIG. 19 is a schematic cross-sectional view of an image forming apparatus according to a fourth embodiment of the present invention.

An overview of an image forming process in an image forming apparatus 200 according to the fourth embodiment is described with reference to FIG. 19. FIG. 19 is a schematic cross-sectional view of the image forming apparatus 200 including a light scanning apparatus 240, and an image forming portion 241 including a photosensitive drum 202, a charging device 212, and a developing device 213. In FIG. 19, laser light (light beam) emitted from a light source unit 235 is deflected by a rotary polygon mirror 210 serving as a deflection unit disposed in a drive motor unit 236 (hereinafter referred to also as "deflection device 236"). The rotary polygon mirror 210 is driven to rotate by a drive motor which is a drive unit of the deflection device 236. The laser light deflected by the rotary polygon mirror 210 irradiates the photosensitive drum 202 serving as a photosensitive member through an optical system including various lenses 237 and a reflecting mirror 238. After a surface of the photosensitive drum 202 is uniformly charged by the charging device 212, the photosensitive drum 202 is exposed to the laser light (light beam) emitted from a semiconductor laser of the light source unit 235 in the light scanning apparatus 240 based on input image data. The photosensitive drum 202 rotates at a constant speed in a rotational direction indicated by the arrow (in a clockwise direction) in FIG. 19 so that the photosensitive surface of the photosensitive drum 202 moves in a sub-scanning direction (rotational direction of the photosensitive drum 202 (direction indicated by the arrow in FIG. 19)) with respect to the light beam from the light scanning apparatus 240. An electrostatic latent image based on the image data is thus formed on the photosensitive drum 202.

The electrostatic latent image is developed with toner (developer) in the developing device 213 serving as a developing unit to form a toner image. Then, in a transfer portion including a transfer roller 215 serving as a transfer unit and the photosensitive drum 202, a transfer voltage is applied to the transfer roller 215. The toner image borne on the photosensitive drum 202 is thus transferred to a recording sheet P serving as a recording medium conveyed along a conveyance path in an arrow direction (conveyance direction) in FIG. 19. Then, the recording sheet P having the toner image transferred thereto is conveyed to a fixing device (not shown), where fixation processing is performed by heating to fix the toner image onto the recording sheet P. Toner remaining on the photosensitive drum 202 without being transferred to the recording sheet P is removed by a cleaning device 216.

[Overview of Light Scanning Apparatus]

Figure 20A:
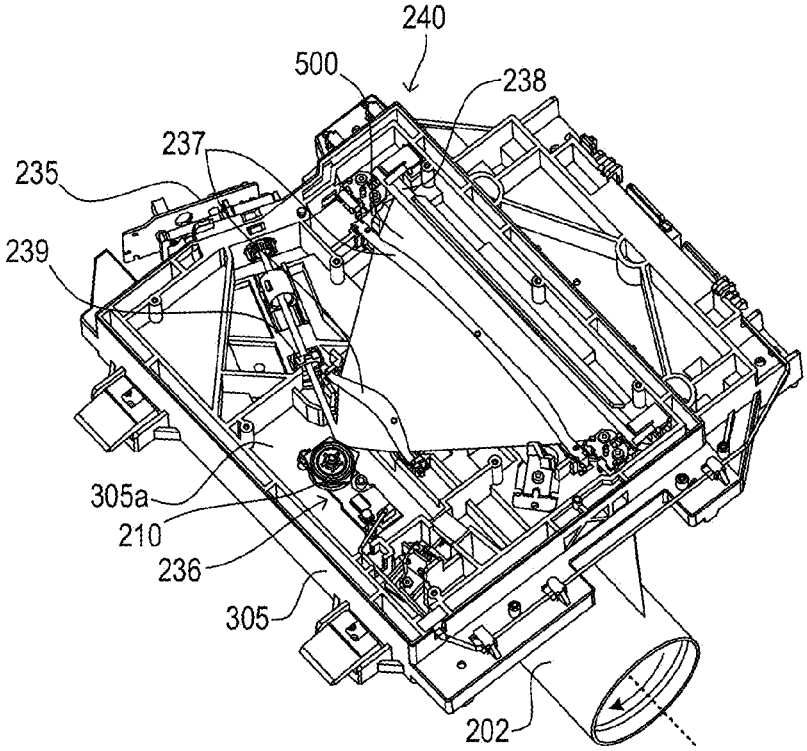
FIG. 20A and FIG. 20B are perspective views for illustrating the internal structure of a light scanning apparatus according to the fourth embodiment.
Figure 20B:
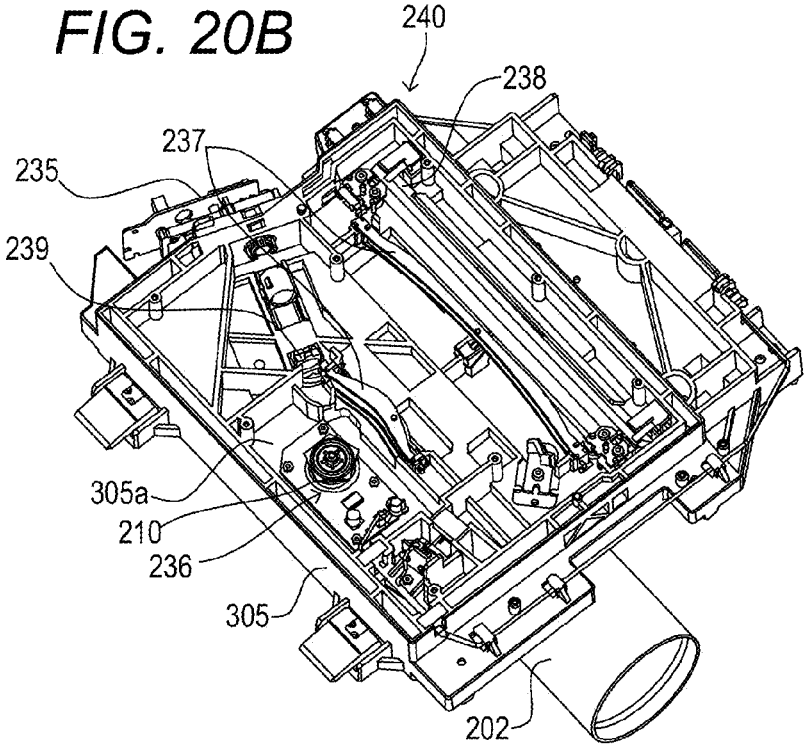

FIG. 20A and FIG. 20B are perspective views of the light scanning apparatus 240 used in image forming apparatus such as a laser beam printer and a digital copying machine configured to perform image formation through the above-mentioned image forming process. FIG. 20A and FIG. 20B are views for illustrating the internal structure of the light scanning apparatus 240 when viewed from an open surface side after removing a cover (not shown) covering the open surface of the light scanning apparatus 240. FIG. 20A is a perspective view for illustrating a light beam 500 emitted from the light source unit 235, and FIG. 20B is a perspective view where the light beam 500 is not illustrated. Below the light scanning apparatus 240 in FIG. 20A and FIG. 20B, the photosensitive drum 202, which is scanned with the light beam 500 (laser light) emitted from the light scanning apparatus 240, is illustrated.

As illustrated in FIG. 20A and FIG. 20B, the light scanning apparatus 240 includes the light source unit 235 in which the semiconductor laser and a collimator lens are unitized, a cylinder lens 239 configured to convert the laser light being a collimated light beam emitted from the light source unit 235 to convergent light in the sub-scanning direction, and the deflection device 236. The drive motor of the deflection device 236 drives the rotary polygon mirror 210 having a plurality of reflection surfaces to deflect the laser light being the light beam emitted from the light source unit 235. Further, the light scanning apparatus 240 includes the lenses 237 configured to image the laser light deflected by the rotary polygon mirror 210 on the surface of the photosensitive drum 202, and the reflecting mirror 238 configured to reflect the laser light to guide the reflected laser light to the photosensitive drum 202. The above-mentioned respective components are placed in an optical box 305 serving as a housing of the light scanning apparatus 240.

As illustrated in FIG. 20A, the light source unit 235 emits the laser light based on the input image data. The laser light passes through the collimator lens and the cylinder lens 239, and thereafter enters a reflection surface of the rotary polygon mirror 210 which is driven to rotate by the drive motor of the deflection device 236. The rotary polygon mirror 210 rotates at a constant speed so that the laser light reflected by the rotary polygon mirror 210 serves as scanning light for scanning the photosensitive drum 202 and passes through the lenses 237 to form the electrostatic latent image on the photosensitive drum 202. The light beam 500 in FIG. 20A represents a trajectory of laser light (scanning light) emitted from the light source unit 235 and deflected by the rotary polygon mirror 210. The light beam 500 indicates that the laser light is guided from the light source unit 235 to the photosensitive drum 202 by the respective optical members such as the lenses 237 and the reflecting mirror 238. The laser light for scanning the surface of the photosensitive drum 202 forms the electrostatic latent image on the photosensitive drum 202 through two scanning processes. One process is main scanning using the rotary polygon mirror 210 (scanning in a rotational axis direction of the photosensitive drum 202 in FIG. 20A) and the other process is sub-scanning through rotation of the photosensitive drum 202 (scanning in the rotational direction of the photosensitive drum 202 in FIG. 20A).

[Structure of Deflection Device]

Figure 21A:
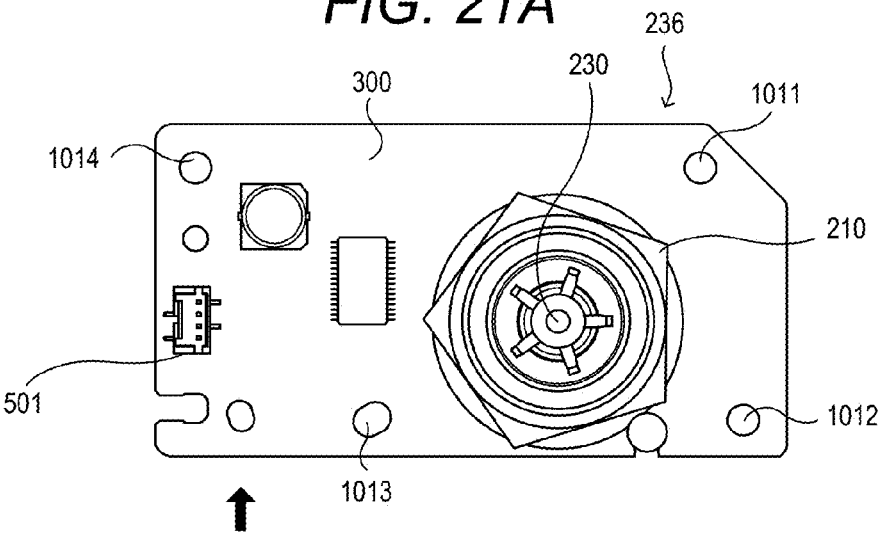
FIG. 21A and FIG. 21B are a top view and a side view of a deflection device according to the fourth embodiment, respectively.
Figure 21B:
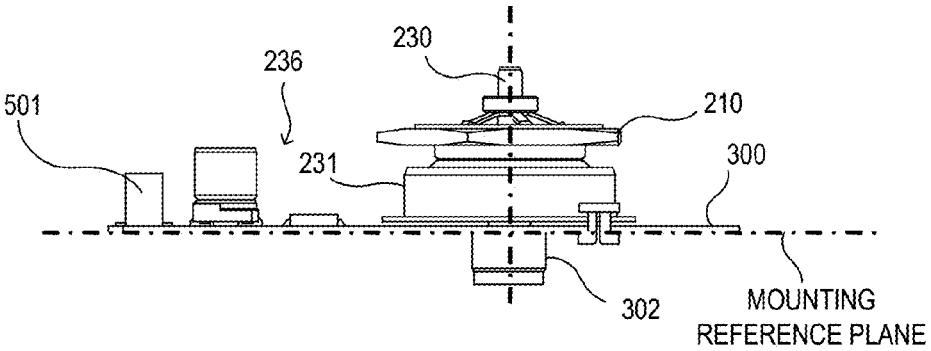
Figure 21C:
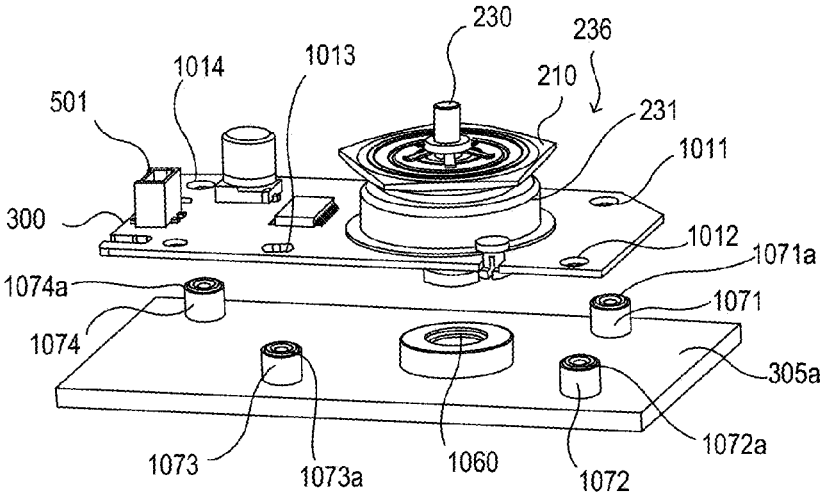
FIG. 21C is a perspective view of an installation surface of an optical box for installing the deflection device.

FIG. 21A, FIG. 21B, and FIG. 21C are views for illustrating an appearance of the deflection device 236 used in this embodiment and for illustrating how the deflection device 236 is fixed to the optical box 305 of the light scanning apparatus 240. FIG. 21A is a top view for illustrating the appearance of the deflection device 236 when viewed from above, and FIG. 21B is a side view for illustrating the appearance of the deflection device 236 when viewed from a direction indicated by the black arrow in FIG. 21A. The deflection device 236 includes the rotary polygon mirror 210, a connector 501 to which a cable (see FIG. 23) having a bundle of signal lines to the image forming apparatus main body that are necessary to drive the drive motor is connected, a drive circuit configured to drive the drive motor, and a drive circuit board 300 on which those components are mounted. The drive circuit board 300 has fixing holes 1011, 1012, 1013, and 1014 which are screw holes configured to fix the drive circuit board 300 to the optical box 305. Further, a positioning boss 302 configured to perform positioning with respect to the light scanning apparatus 240 is joined to the drive circuit board 300 through caulking. Then, a bearing fitted into (or integral with) the positioning boss 302 receives a shaft of a rotor portion 231 of the drive motor and the rotary polygon mirror 210 is mounted coaxially with a rotary shaft 230 of the rotor portion 231. The rotary polygon mirror 210 is pressed from above by a leaf spring to be fixed to the rotor portion 231.

[Mounting of Deflection Device on Light Scanning Apparatus]

FIG. 21C is a perspective view for illustrating the structure of the deflection device 236 according to this embodiment and that of arrangement surface of the optical box 305 for arranging the deflection device 236 in the light scanning apparatus 240. The arrangement surface of the light scanning apparatus 240 on which the deflection device 236 is to be disposed is only illustrated in FIG. 21C. In FIG. 21C, the drive circuit board 300 of the deflection device 236 is made of a material capable of elastic deformation and has the plurality of fixing holes 1011, 1012, 1013, and 1014 configured to fix the drive circuit board 300 onto the arrangement surface of the optical box 305. Further, cylindrical bosses 1071, 1072, 1073, and 1074 which are fixing portions having mounting bearing surfaces 1071*a*, 1072*a*, 1073*a*, and 1074*a*, respectively, are erected from the arrangement surface (bottom surface) of a bottom portion 305*a* of the optical box 305 at positions corresponding to the fixing holes 1011, 1012, 1013, and 1014 of the drive circuit board 300. Further, each of the bosses 1071, 1072, 1073, and 1074 has a screw hole for fastening with a screw to be described later.

The positioning boss 302 of the deflection device 236 is inserted and fitted into a positioning hole 1060 formed in the optical box 305 serving as a supporting member of the light scanning apparatus 240 with a certain degree of accuracy, and the deflection device 236 and the rotary polygon mirror 210 are positioned while ensuring the positional accuracy at the axial centerline. The bearing surfaces 1071*a*, 1072*a*, 1073*a*, and 1074*a* of the bosses 1071, 1072, 1073, and 1074 formed in the optical box 305 with which the drive circuit board 300 of the deflection device 236 comes into contact each have little distortion and few irregularities, and have a high degree of plane accuracy. Likewise, a mounting reference plane (indicated by a chain line in FIG. 21B) of the drive circuit board 300 of the deflection device 236 with which the bosses 1071, 1072, 1073, and 1074 come into contact also has a high degree of plane accuracy. Then, screws are caused to pass through the screw holes formed in the bosses 1071, 1072, 1073, and 1074 of the optical box 305 via the fixing holes 1011, 1012, 1013, and 1014 on the deflection device 236 side, and fastened to fix the deflection device 236 to the optical box 305. The mounting reference plane of the drive circuit board 300 is a plane of the drive circuit board 300 facing the bottom portion 305*a* of the optical box 305 and the rotary shaft 230 is assembled so as to be perpendicular to the mounting reference plane.

Figure 22:
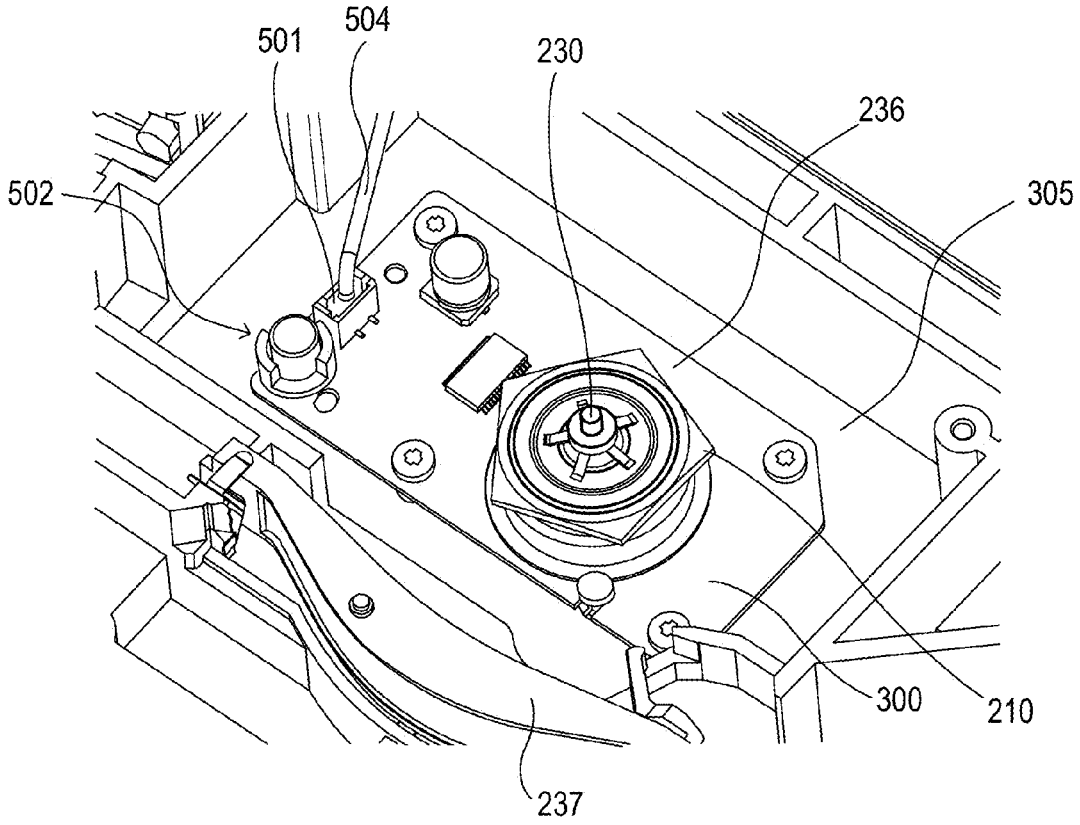
FIG. 22 is a perspective view for illustrating a state in which the deflection device according to the fourth embodiment is installed in the optical box.

FIG. 22 is a perspective view for illustrating a state in which the above-mentioned deflection device 236 is disposed in the optical box 305 of the light scanning apparatus 240. In FIG. 22, the deflection device 236 is fixed to the optical box 305 with the screws inserted through the fixing holes 1011 to 1014 and a dynamic vibration absorber 502 is installed on the drive circuit board 300. Further, a cable 504 which is a conducting cable necessary to the above-mentioned motor drive and has a bundle of signal lines for transmission and reception of signals to and from the image forming apparatus main body is inserted into the connector 501 mounted on the drive circuit board 300.

[Structure of Dynamic Vibration Absorber]

Figure 23:
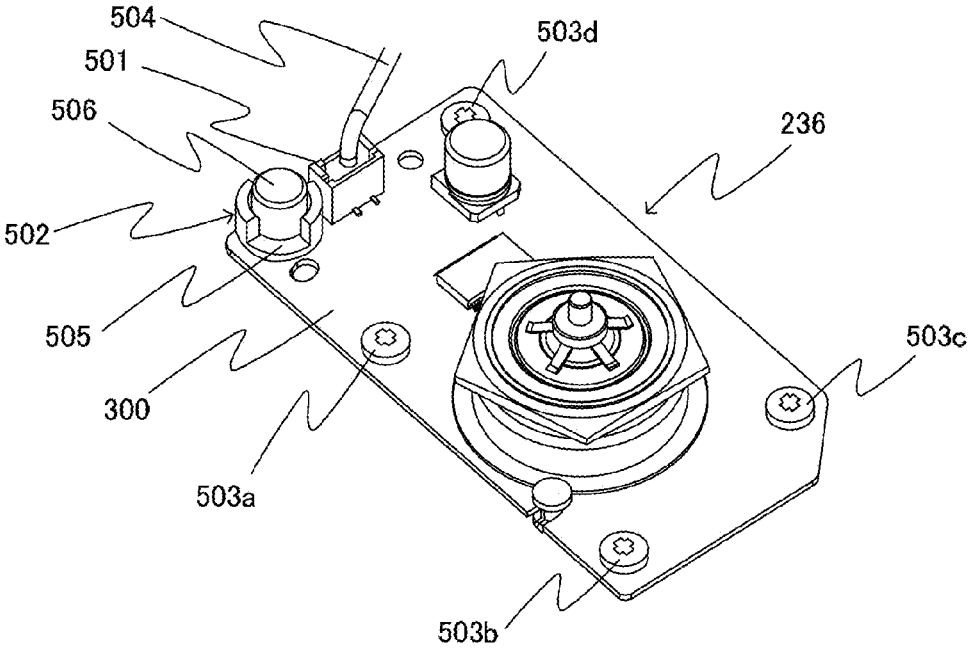
FIG. 23 is a perspective view of the deflection device according to the fourth embodiment.

FIG. 23 is a perspective view for only illustrating the deflection device 236 in FIG. 22, and the optical box 305, the lenses 237, and other components are not illustrated for ease of comprehension in the following description. Screws 503*a*, 503*b*, 503*c*, and 503*d* are illustrated in FIG. 23. The screws 503*a*, 503*b*, 503*c*, and 503*d* are caused to pass through the fixing holes 1013, 1012, 1011, and 1014 of the drive circuit board 300 and the bosses 1073, 1072, 1071, and 1074 of the optical box 305, respectively, to fasten the deflection device 236 and the optical box 305 to each other.

As described above, the dynamic vibration absorber which is a vibration suppressing unit has two elements including a "spring element" and a "mass element", which determine the characteristic frequency of the dynamic vibration absorber. According to this embodiment, the drive circuit board 300 of the deflection device 236 of the light scanning apparatus 240 plays a role as the "spring element" of the dynamic vibration absorber 502. On the other hand, the "mass element" of the dynamic vibration absorber 502 is formed of two members including a mass 506 playing a role as the mass element of the dynamic vibration absorber 502 and a resin holding member 505 playing a role in holding the mass 506 and arranging the mass 506 in the deflection device 236. Through the use of the drive circuit board 300 of the deflection device 236 in the light scanning apparatus 240 as the "spring element" of the dynamic vibration absorber, the number of components forming the dynamic vibration absorber can be reduced. To satisfy a necessary weight of the mass 506 with the smallest possible volume, metals such as stainless steel and copper which are relatively high in density are used.

[Installation Position of Dynamic Vibration Absorber]

Figure 24A:
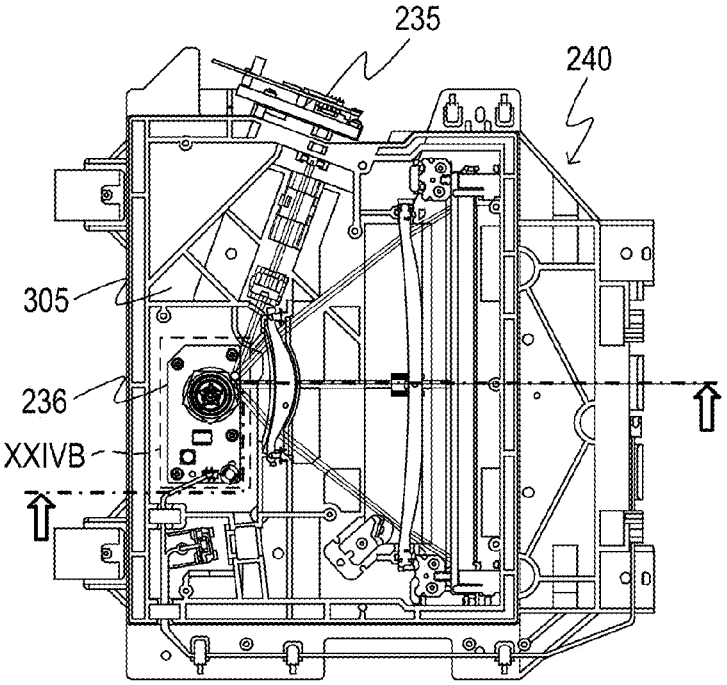
FIG. 24A is a top view of the light scanning apparatus according to the fourth embodiment.
Figure 24B:
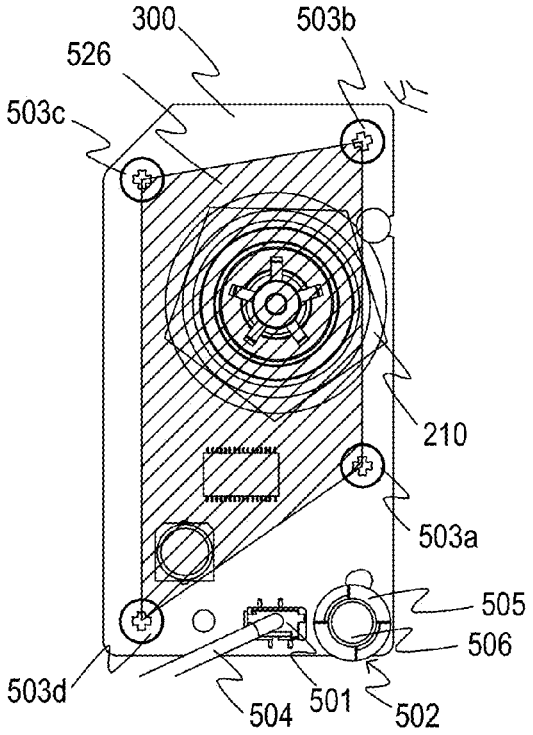
FIG. 24B is a top view of the deflection device.

FIG. 24A and FIG. 24B are views for illustrating a location at which the dynamic vibration absorber 502 is installed on the drive circuit board 300 of the deflection device 236. FIG. 24A is a top view for illustrating an appearance of the light scanning apparatus 240 having the deflection device 236 disposed therein when viewed from above, and FIG. 24B is a top view for illustrating, on an enlarged scale, the deflection device 236 in a region XXIVB surrounded by a broken line in FIG. 24A.

As described above, the drive circuit board 300 of the deflection device 236 is fastened to the optical box 305 using the four screws 503*a*, 503*b*, 503*c*, and 503*d*. In this step, among the fixing holes through which the screws 503 are caused to pass, the fixing holes 1012, 1011, and 1014 through which the screws 503*b*, 503*c*, and 503*d* are caused to pass are formed in outer peripheral corner portions (angular portions) of the drive circuit board 300. On the other hand, the fixing hole 1013 through which the screw 503*a* is caused to pass is formed on an inner side of the drive circuit board 300. Therefore, when a virtual region surrounded by line segments connecting fastening center points, which are fastening positions of the respective screws 503, is defined as a screw fastening region 526, as illustrated in FIG. 24B, the screw fastening region 526 indicated by hatching does not cover the entire surface of the drive circuit board 300. A reason why the fixing holes 1011 to 1014 for causing the respective screws 503 to pass therethrough are formed in the drive circuit board 300 as described above is described later.

A feature of this embodiment is that the dynamic vibration absorber 502 is installed outside the screw fastening region 526 indicated by hatching, as illustrated in FIG. 24B. More specifically, the dynamic vibration absorber 502 is installed in a vibratable area in the drive circuit board 300 except for portions at which the drive circuit board 300 comes into contact with the bosses 1071, 1072, 1073, and 1074 having the bearing surfaces 1071*a*, 1072*a*, 1073*a*, and 1074*a* for fixing the drive circuit board 300, respectively. As illustrated in FIG. 24B, among the four corner portions (angular portions) forming an outer shape (outer peripheral portion) of the drive circuit board 300 having a rectangular shape, the three corner portions (angular portions) of the drive circuit board 300 are fastened to the optical box 305 with the screws 503*b*, 503*c*, and 503*d*. On the other hand, the dynamic vibration absorber 502 is installed in the other corner portion (angular portion) of the drive circuit board 300.

Figure 24C:
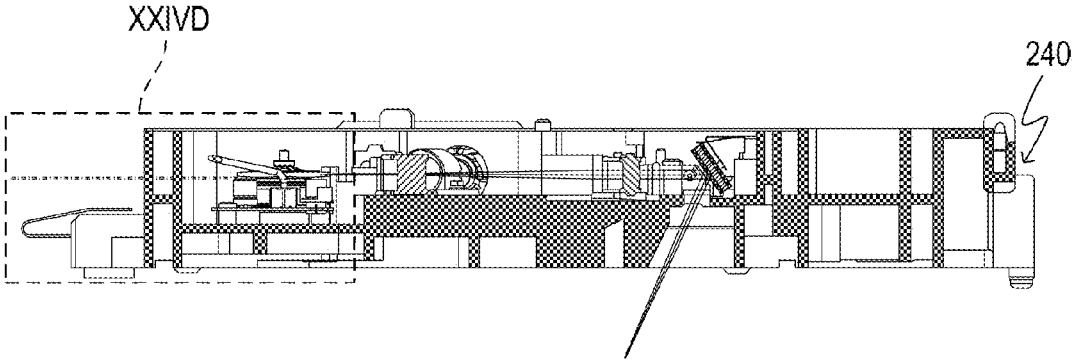
FIG. 24C is a cross-sectional view of the light scanning apparatus.
Figure 24D:
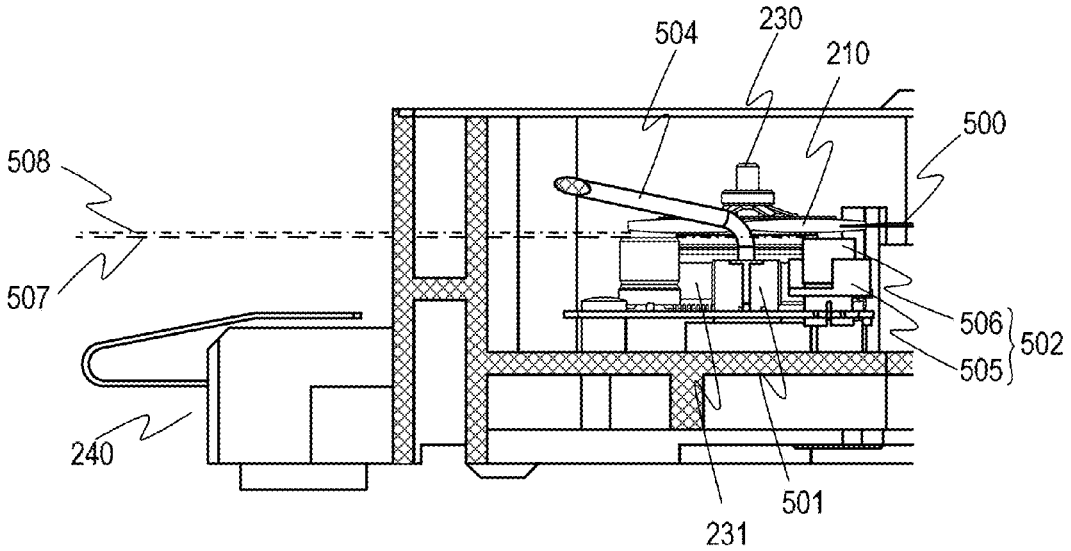
FIG. 24D is an enlarged view of a region XXIVD surrounded by a broken line in FIG. 24C.

FIG. 24C and FIG. 24D are cross-sectional views for illustrating a height of the dynamic vibration absorber 502 installed in the deflection device 236 from the drive circuit board 300. FIG. 24C is a cross-sectional view of the entire light scanning apparatus 240 taken along a chain line as a cutting line indicated by a white arrow at one end portion in FIG. 24A when viewed from a direction of the white arrow. FIG. 24D is a cross-sectional view of a region XXIVD surrounded by a broken line in FIG. 24C on an enlarged scale, and the deflection device 236 and a peripheral portion of the deflection device 236 of the light scanning apparatus 240 are illustrated in cross-section. In FIG. 24D, a height to an upper surface (top surface) of the mass 506 of the dynamic vibration absorber 502 is illustrated as a height 507 (indicated by a broken line in FIG. 24D) of the mass 506 from the drive circuit board 300. On the other hand, a height of the mounting bearing surface of the rotary polygon mirror 210 of the deflection device 236 (surface at which the rotary polygon mirror 210 is mounted on the rotor portion 231 of the drive motor) is illustrated as a height 508 (indicated by a chain line in FIG. 24D) of the mounting bearing surface from the drive circuit board 300. A relation between the height 507 and the height 508 is as follows. The height 508 of the mounting bearing surface of the rotary polygon mirror 210 is higher than the height 507 of the mass 506 (height 508>height 507). The light beam 500 which is laser light emitted from the light source unit 235 and deflected by the rotary polygon mirror 210 is also at a higher position than the height 507 of the mass 506.

The mass 506 is made of metal in terms of density as described above, and hence has a glossy surface. Therefore, the light beam 500 having impinged on the mass 506 may be reflected on the glossy surface to generate scattering light, which is guided onto the photosensitive drum 202 as flare light to cause an image failure. Therefore, generation of flare light can be suppressed by adjusting the height of the light beam 500 from the drive circuit board 300 to be higher than the height 507 of the mass 506. In order to suppress generation of flare light, as illustrated in FIG. 24A, the dynamic vibration absorber 502 is installed on an opposite side of the rotary polygon mirror 210 to a side on which the light source unit 235 is disposed. Generation of flare light is thus reduced to the lowest possible level by installing the dynamic vibration absorber 502 at a position away from the scanning light path of the light beam 500.

[Method of Forming Dynamic Vibration Absorber]

Figure 25A:
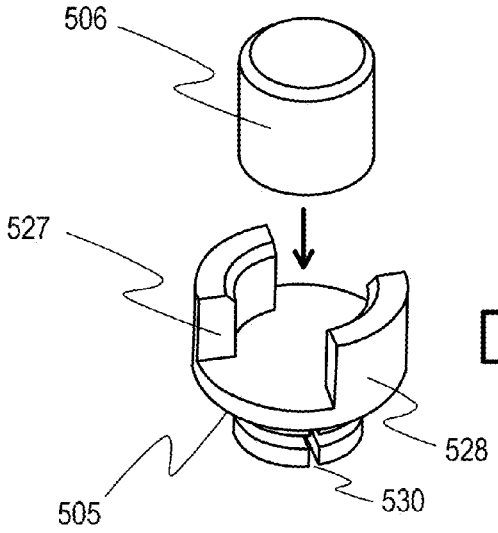
FIG. 25A and FIG. 25B are perspective views for illustrating the structure of a dynamic vibration absorber according to the fourth embodiment.
Figure 25B:
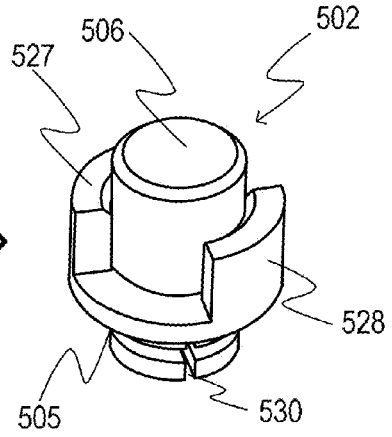

FIG. 25A and FIG. 25B are perspective views for illustrating a method of mounting the mass 506 forming the dynamic vibration absorber 502 to the holding member 505 configured to hold the mass 506. FIG. 25A is an illustration of a state before mounting the mass 506 to the holding member 505, and FIG. 25B is an illustration of a state after mounting the mass 506 to the holding member 505. As illustrated in FIG. 25A, the mass 506 has a cylindrical shape. A rim in an outer peripheral portion on the upper surface (top surface) of the mass is chamfered, and an outer peripheral portion on the bottom surface that faces the holding member 505 when the mass 506 is press-fitted into the holding member 505 is also chamfered (see FIG. 26C). Further, the holding member 505 has two ribs 527 and 528 formed at positions facing each other to hold the mass 506, and the ribs 527 and 528 protrude upward. The inner side of each of the two ribs 527 and 528 has a circular shape so that the ribs 527 and 528 come into contact with the press-fitted cylindrical mass 506 to hold the mass 506.

The circular shape formed by the ribs 527 and 528 has an inner diameter (distance between inner walls of the ribs 527 and 528) which is smaller by several tens of micrometers than an outer diameter of the mass 506. This magnitude relation (inner diameter between the ribs 527 and 528 (inner diameter between the ribs)<outer diameter of the mass 506) allows the mass 506 to be press-fitted between the ribs 527 and 528 of the holding member 505 through insertion while being pressed in an arrow direction indicated in FIG. 25A. As a result, the mass 506 is brought into a state in which the mass 506 is firmly fixed (mounted) to the holding member 505, as illustrated in FIG. 25B. An outer peripheral portion on an inner wall side on an upper surface (top surface) of each of the ribs 527 and 528 is also chamfered so that the mass 506 is smoothly press-fitted into the holding member 505. For example, a method which involves fastening and fixing using a screw may also be used to mount the mass 506 to the holding member 505. However, the number of members forming the dynamic vibration absorber 502 is increased. Therefore, the above-mentioned fixing method using press-fitting is more advantageous in terms of simple assembly. According to the above-mentioned fixing method using press-fitting, the vibration reduction effect obtained by the dynamic vibration absorber is not affected by a weight error due to unevenness in screw shape. A slit 530 is described later.

[Method of Installing Dynamic Vibration Absorber on Drive Circuit Board]

Figure 26A:
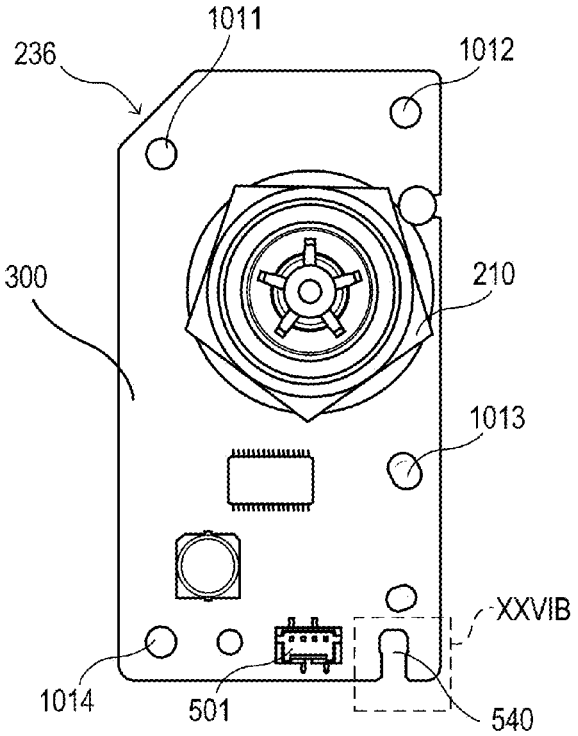
FIG. 26A and FIG. 26B are top views of a drive circuit board according to the fourth embodiment.
Figure 26B:
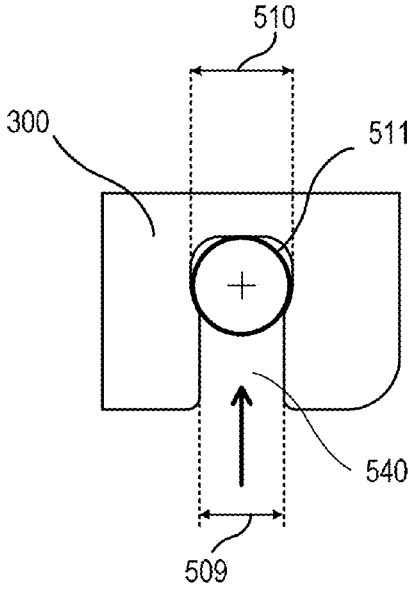

Next, a method of installing the dynamic vibration absorber 502, which has the mass 506 fixed to the holding member 505, on the drive circuit board 300 of the deflection device 236 is described. FIG. 26A is a top view of the drive circuit board 300 of the deflection device 236 when viewed from above, and FIG. 26B is a top view for illustrating, on an enlarged scale, a portion where the dynamic vibration absorber 502 is to be installed, in other words, a peripheral region XXVIB of a slit 540 surrounded by a broken line on the drive circuit board 300 in FIG. 26A. The slit 540, which is a cut-out portion, is formed by cutting out an outer periphery (end portion) of the drive circuit board 300 to form a concave opening. FIG. 26B is an illustration of a state in which the holding member 505, which is a mounting member to the drive circuit board 300, is inserted into the slit 540 in an arrow direction to be fixed (mounted) to the drive circuit board 300. A fixing position 511, which is a predetermined position, indicates a position (location) in the state in which the holding member 505 is fixed to the drive circuit board 300. As illustrated in FIG. 26B, at the fixing position 511 where the holding member 505 is fixed, the holding member 505 comes into contact with the drive circuit board 300 to be disposed with a high degree of accuracy.

As illustrated in FIG. 26A, the drive circuit board 300 has such a characteristic shape that the opening width of the slit 540 is different between an entrance portion formed on an outer periphery of the drive circuit board 300 and the fixing position 511 at which the holding member 505 is to be fixed. More specifically, in FIG. 26B, an opening width 509 refers to a width at the entrance portion of the slit 540, and an opening width 510 refers to a width of the slit 540 at the fixing position 511 at which the holding member 505 is to be fixed. A magnitude relation of opening width 509<opening width 510 is established. As described later, the holding member 505 of the dynamic vibration absorber 502 is pressed from the entrance portion having the opening width 509 in the slit 540 in the arrow direction in FIG. 26B to be fixed at the fixing position 511 at which the slit 540 has the opening width 510.

Figure 26C:
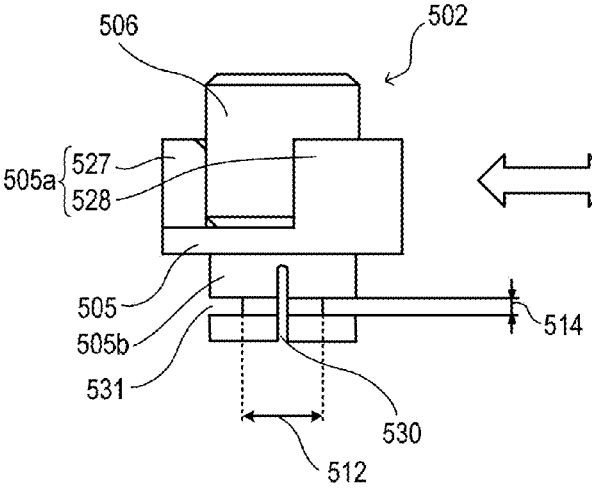
FIG. 26C and FIG. 26D are side views for illustrating an appearance of the dynamic vibration absorber.
Figure 26D:
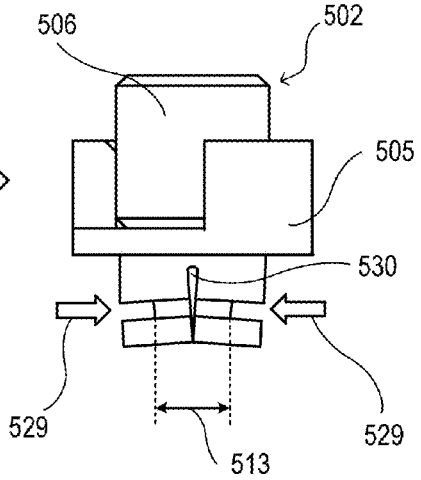

FIG. 26C and FIG. 26D are side views of the dynamic vibration absorber 502 including the mass 506 mounted to the holding member 505 (views of the dynamic vibration absorber viewed from a lateral direction). As described later, the holding member 505 is capable of elastic deformation. FIG. 26C is an illustration of a state of the dynamic vibration absorber 502 before elastic deformation, and FIG. 26D is an illustration of a state of dynamic vibration absorber 502 during elastic deformation. As illustrated in FIG. 26C, the holding member 505 includes a holding portion 505*a* having the ribs 527 and 528, and a supporting portion 505*b* which is a base portion supporting the holding portion 505*a*. Further, in order to insert the dynamic vibration absorber 502 into the slit 540 of the drive circuit board 300, the supporting portion 505*b* has a characteristic shape with a cut-out portion 531 which is a recess portion having a gap width (width in a vertical direction) indicated by a width 514.

The holding member 505 has the slit 530 which passes across a central portion of the cut-out portion 531 to penetrate into the supporting portion of the holding member 505. As described above, the holding member 505 is made of resin. Therefore, as illustrated in FIG. 26D, when the holding member 505 is inserted into the slit 540 of the drive circuit board 300, pressure 529 in a direction (radially inward direction) in which the slit 530 is crushed (pressed) is applied from the drive circuit board 300 side. Then, the pressure 529 is applied to the cut-out portion 531 to narrow an opening entrance in a lower part of the slit 530 (reduce a width on the entrance side). Therefore, a diameter of the cut-out portion 531 before elastic deformation of the holding member 505 is denoted by a diameter 512 before deformation (FIG. 26C), and a diameter of the cut-out portion 531 after elastic deformation of the holding member 505 is denoted by a diameter 513 after deformation (FIG. 26D). The two diameters have a magnitude relation of diameter 512 before deformation>diameter 513 after deformation. The diameter 512 before deformation and the opening width 510 at the fixing position 511 have a magnitude relation of diameter 512 before deformation opening width 510. Further, the diameter 512 before deformation and the opening width 509 at the opening of the slit 540 have a magnitude relation of diameter 512 before deformation>opening width 509.

Figure 27A:
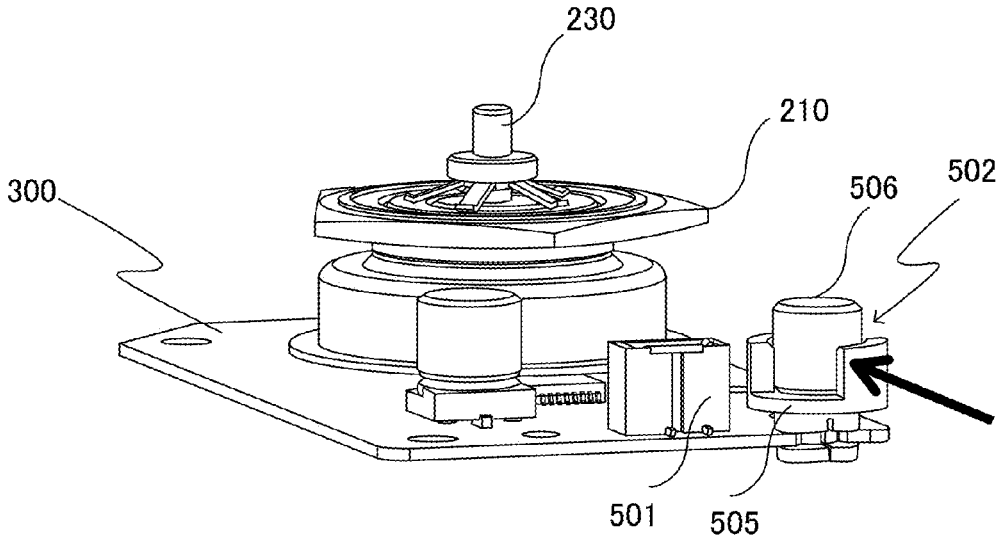
FIG. 27A and FIG. 27B are perspective views for illustrating how the dynamic vibration absorber according to the fourth embodiment is fixed to the drive circuit board.
Figure 27B:
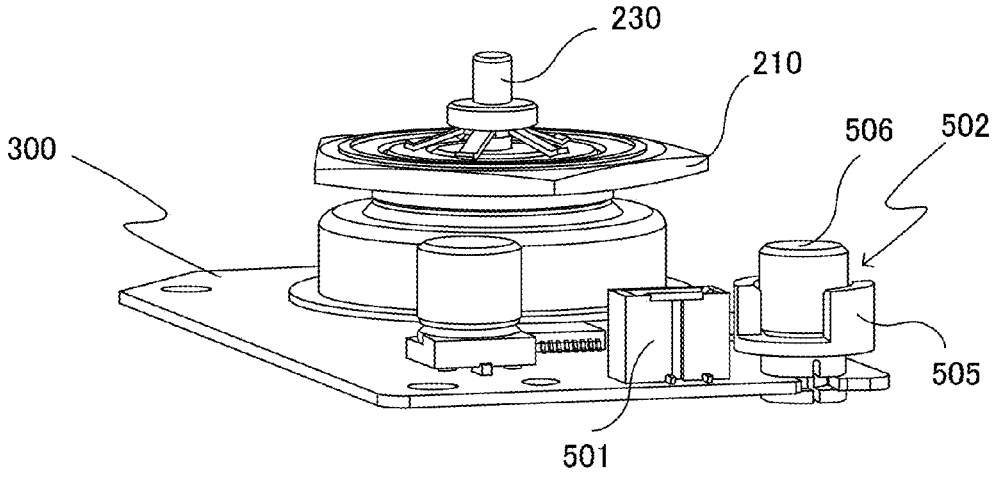

FIG. 27A and FIG. 27B are perspective views for illustrating how the dynamic vibration absorber 502 having the above-mentioned shape is fixed to the drive circuit board 300. FIG. 27A is an illustration of a state in which the holding member 505 of the dynamic vibration absorber 502 is pressed into the slit 540 of the drive circuit board 300 in an arrow direction, and FIG. 27B is an illustration of a state in which the holding member 505 of the dynamic vibration absorber 502 is pressed up to the fixing position 511 to be positioned and fixed. More specifically, in FIG. 27A, the cut-out portion 531 of the holding member 505 is passing through a region having the opening width 509 in the slit 540 of the drive circuit board 300 illustrated in FIG. 26B. As described above, the diameter 512 before deformation when the cut-out portion 531 does not undergo elastic deformation is larger than the opening width 509 of the slit 540 (diameter 512 before deformation>opening width 509). Therefore, the pressure 529 in the direction in which the slit 530 is crushed is applied from the slit 540 side of the drive circuit board 300 to the cut-out portion 531 (FIG. 26D). As a result, the pressure 529 reduces the opening width of the slit 530 so that the diameter 513 after deformation when the cut-out portion 531 undergoes elastic deformation becomes substantially equal to the opening width 509 of the slit 540 (diameter 513 after deformation≈opening width 509). The dynamic vibration absorber 502 is thus pressed into the slit 540 up to the fixing position 511.

Then, as illustrated in FIG. 27B, when the holding member 505 of the dynamic vibration absorber 502 is pressed up to the fixing position 511, the opening of the slit 540 of the drive circuit board 300 enlarges from the opening width 509 to the opening width 510. The opening width 510 and the diameter 512 before elastic deformation of the cut-out portion 531 have a relation of diameter 512 before deformation≈opening width 510 so that the pressure 529 having reduced the width of the opening of the slit 530 is released and the width of the slit 530 of the holding member 505 returns to the initial state, i.e., the state of the diameter 512 before elastic deformation. Further, as illustrated in FIG. 26B, the holding member 505 pressed up to the fixing position 511 is constrained in the degree of freedom in a horizontal direction of the drive circuit board 300 based on the relation of diameter 512 before deformation opening width 510. In addition, the holding member 505 is also constrained in the degree of freedom in the vertical direction (height direction) of the drive circuit board 300 by adjusting the width 514, which is the height (width in the vertical direction) of the gap portion in the cut-out portion 531 of the holding member 505, to be slightly smaller than a thickness of the drive circuit board 300. This structure can be achieved because the holding member 505 is made of resin and has an elastically deformable shape. As described above, the cut-out portion 531 of the holding member 505 is pressed into the slit 540 of the drive circuit board 300 while being elastically deformed in the horizontal and vertical directions. Therefore, it is desirable to use resin having high sliding properties, such as polyacetal, as a material of the holding member 505.

[Vibration Mode of Dynamic Vibration Absorber]

Figure 28A:
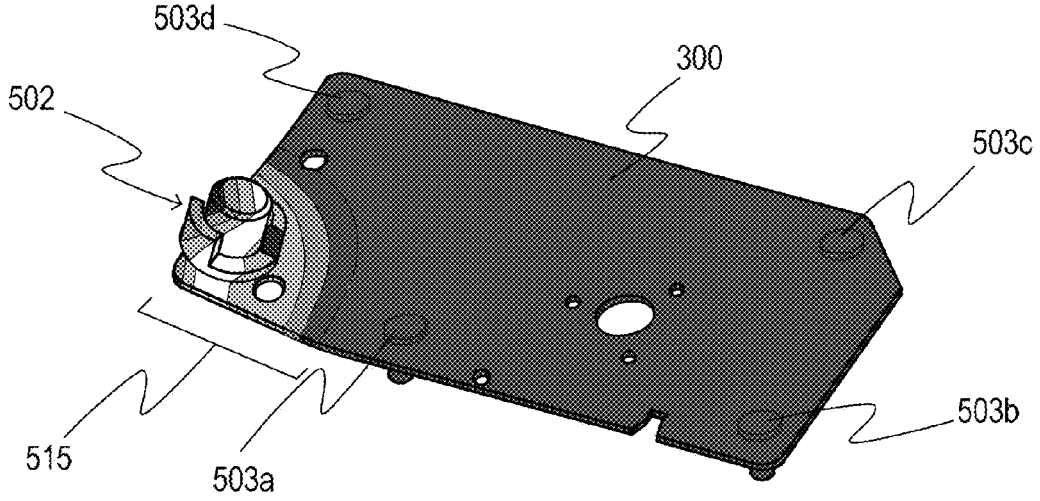
FIG. 28A and FIG. 28B are modal analysis contour diagrams of the dynamic vibration absorber according to the fourth embodiment.
Figure 28B:
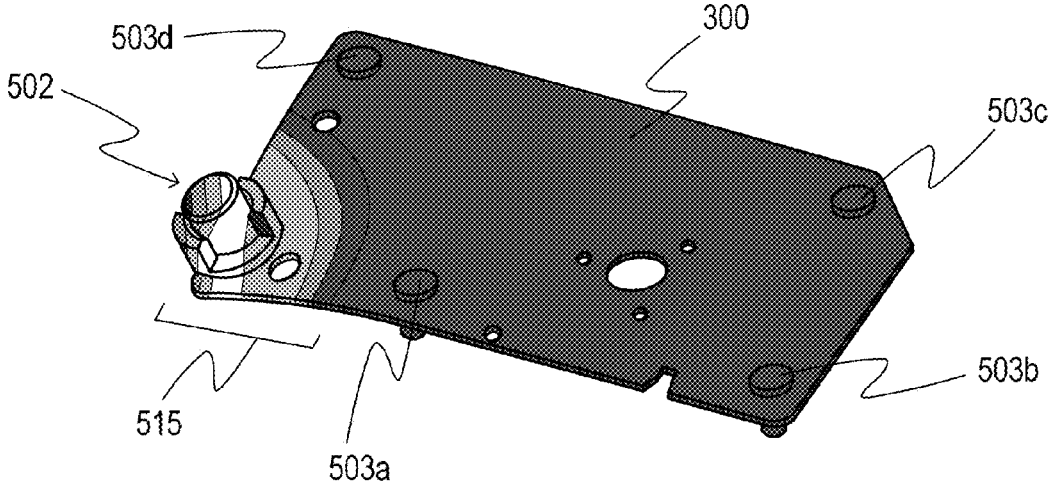

FIG. 28A and FIG. 28B are modal analysis contour diagrams (isoline diagrams) for illustrating in what mode the dynamic vibration absorber 502 positioned and fixed onto the drive circuit board 300 vibrates on the optical box 305. For convenience of description, the optical box 305 is not illustrated in FIG. 28A and FIG. 28B. FIG. 28A and FIG. 28B are illustrations of vibration phases of the drive circuit board 300 and indicate that shapes in FIG. 28A and FIG. 28B are alternately repeated in the vibration mode used as the dynamic vibration absorber.

As can be seen from the contour diagrams illustrated in FIG. 28A and FIG. 28B, the location corresponding to the screw fastening region 526 (see FIG. 24B) surrounded by the screws 503*a* to 503*d* does not vibrate, while the region where fastening with a screw is not performed to install the dynamic vibration absorber 502 has spring properties to vibrate as a vibratable area. The dynamic vibration absorber 502 then has a maximum point of amplitude, which is also characteristic. This can be deemed to be the same as the primary vibration mode when the mass is provided to a cantilevered edge portion. With this, it is understood that the region where the drive circuit board 300 is not fastened with a screw functions as a spring element of the dynamic vibration absorber 502. This region is defined as a spring element portion 515 of the drive circuit board 300. In FIG. 24B, the three fixing holes 1011, 1012, and 1014 for the screws 503 are formed in the three corners (angular portions) of the drive circuit board 300 and the fixing hole 1013 is formed on the inner side of the drive circuit board 300 for the purpose of intentionally forming the spring element portion 515 which is a vibratable area. With this, the function of the "spring element" of the dynamic vibration absorber 502 is provided to the drive circuit board 300 of the deflection device 236, which is an existing device provided in the light scanning apparatus 240, thereby being capable of reducing the number of components forming the dynamic vibration absorber 502.

[Relation Between Weight of Mass and Characteristic Frequency in Vibration Mode]

Figure 29:
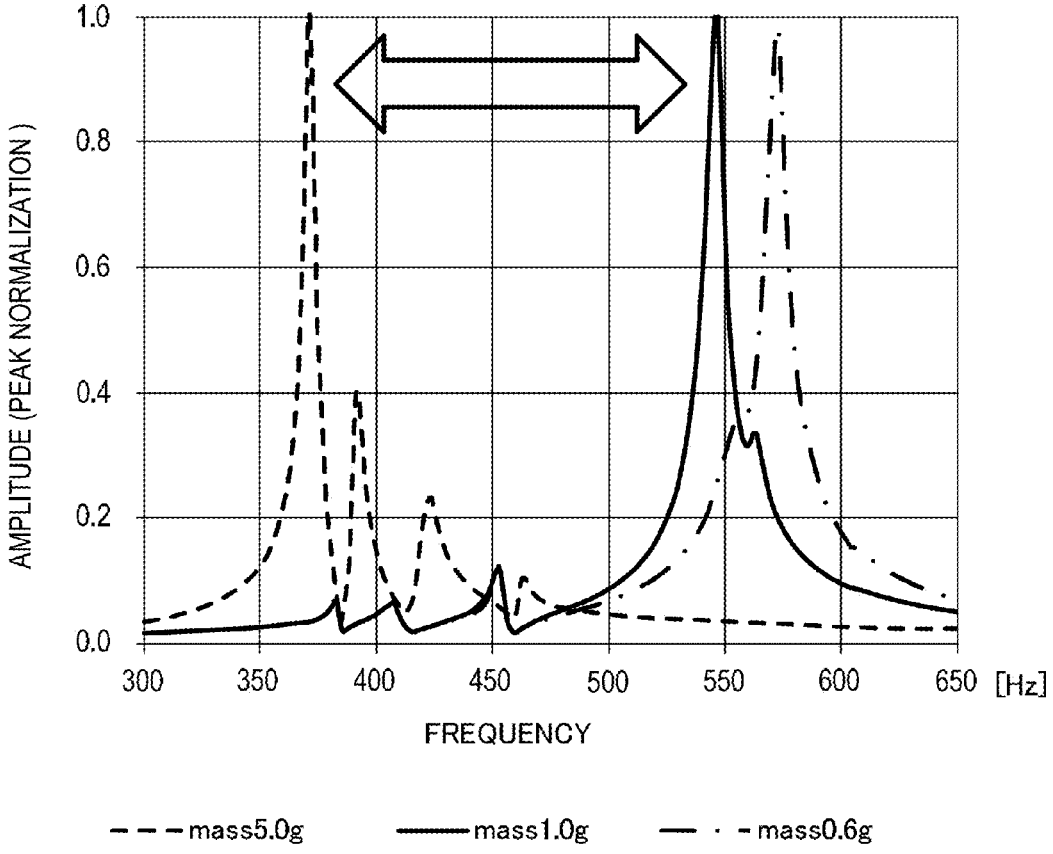
FIG. 29 is a graph for showing a relation between a weight of a mass according to the fourth embodiment and a characteristic frequency in a vibration mode.

FIG. 29 is a graph for showing a relation between a weight of the mass 506 of the dynamic vibration absorber 502 installed in the deflection device 236 according to this embodiment and the characteristic frequency (frequency) in the vibration mode. In FIG. 29, the horizontal axis represents the frequency (characteristic frequency) (unit: Hz (Hertz), and the vertical axis represents an amplitude ratio at each frequency when the amplitude is normalized by taking its peak as 1. FIG. 29 includes three graphs. A graph plotted by a broken line is a graph when the mass 506 has a weight of 5.0 g. A graph plotted by a solid line is a graph when the mass 506 has a weight of 1.0 g. A graph plotted by a chain line is a graph when the mass 506 has a weight of 0.6 g.

With the graphs in FIG. 29, the magnitude of the frequency in the vibration mode, which is characteristic when the characteristic vibration of the dynamic vibration absorber 502 is excited, can be determined. The vibration mode of the dynamic vibration absorber 502 used in this embodiment is a basic primary vibration mode illustrated in FIG. 28A and FIG. 28B, and hence the largest amplitude can be obtained as compared to other vibration modes. In other words, the largest peaks on the graphs in FIG. 29 indicate the primary vibration mode. As shown in FIG. 29, the characteristic frequency (frequency) becomes lower as the mass 506 becomes heavier, and the characteristic frequency (frequency) becomes higher as the mass 506 becomes lighter. This means that the weight of the mass 506 allows the characteristic frequency (frequency) to be changed.

The mass 506 used in this embodiment is made of metal having a high density in order to satisfy a necessary weight with the smallest possible volume. However, the density is preferably lower in terms of suppressing sensitivity to the weight and characteristic frequency due to outer shape errors. Therefore, a material having a lower density may be selected for use in the mass 506 within a range of allowable characteristic frequency errors.

The mass 506 has a cylindrical shape as described in FIG. 25A and FIG. 25B. Therefore, the dynamic vibration absorber 502 having a necessary characteristic frequency can be easily formed by merely cutting out a shaft having a length for use as the mass 506 from a ready-made shaft member. The weight of the mass 506 determines the characteristic frequency of the dynamic vibration absorber 502. The weight of the mass 506 varies depending on the drive frequency (rotational speed) of the drive motor of the deflection device 236 and the characteristic frequency of the light scanning apparatus 240, and hence may be determined through experimental analysis or theoretically.

[Effect of Dynamic Vibration Absorber on Vibration]

Next, an effect of the dynamic vibration absorber 502 in an "resonance" phenomenon in which the characteristic frequency of the light scanning apparatus 240 coincides with the drive frequency of the drive motor of the deflection device 236 to cause the light scanning apparatus 240 to continuously receive vibration energy of the drive motor is described. It is desirable that the characteristic frequency of the light scanning apparatus 240 do not coincide with the drive frequency of the drive motor in order to prevent occurrence of the resonance phenomenon. However, the drive frequency of the drive motor is uniquely determined by an image printing density (resolution) and an electrophotographic processing speed. A plurality of drive frequencies are set in the drive motor in accordance with a printing speed lineup in the image forming apparatus. As a result, the characteristic frequency of the light scanning apparatus 240 and the drive frequency of the drive motor are expected to become frequencies relatively close to each other. Therefore, according to this embodiment, the assumption of drive of the light scanning apparatus 240 at a resonance frequency at which the above-mentioned two frequencies coincide with each other is deemed to be a case suitable to determine the effect of the dynamic vibration absorber on image deterioration and noise.

Figure 30A:
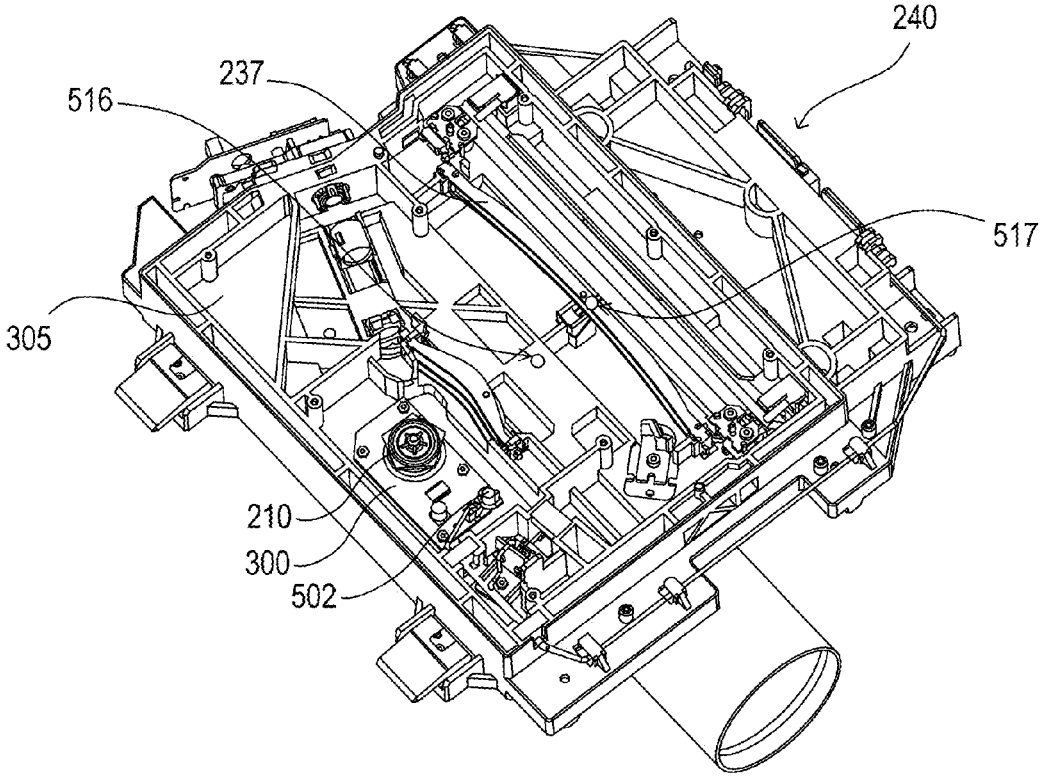
FIG. 30A is a perspective view for illustrating installation locations of acceleration sensors in the light scanning apparatus according to the fourth embodiment.

FIG. 30A is a perspective view for illustrating positions at which acceleration sensors are disposed to monitor vibration in the light scanning apparatus 240 according to this embodiment. For convenience of description, the light scanning apparatus 240 is only illustrated. During measurement, the light scanning apparatus 240 is hermetically closed by an upper cover and is fixed and fastened to the image forming apparatus by a predetermined method with a high degree of accuracy. Among two measurement points where the acceleration sensors are disposed, a measurement point 516 is disposed substantially in the center of the optical box 305, and a measurement point 517 is disposed in the middle of the lens 237 in its longitudinal direction. The acceleration sensors disposed at both the measurement points measure acceleration in a direction of the rotary shaft 230 of the drive motor of the deflection device 236, i.e., acceleration in a sub-scanning direction (vertical direction, gravity direction) of the light scanning apparatus 240. The acceleration substantially in the center of the optical box 305 is measured at the measurement point 516. This is because the amplitude at this point is highly correlated with a noise level of the light scanning apparatus 240. Further, the acceleration in the middle of the lens 237 in its longitudinal direction is measured at the measurement point 517. This is because vibration of the lens 237 in the sub-scanning direction causes an imaging point on the photosensitive drum 202 as well to deviate in the sub-scanning direction, thus leading to image deterioration. Therefore, in order to solve the two problems of "image deterioration" and "noise" due to vibration of the drive motor, the acceleration at the measurement points 516 and 517 is required to be reduced.

Figure 30B:
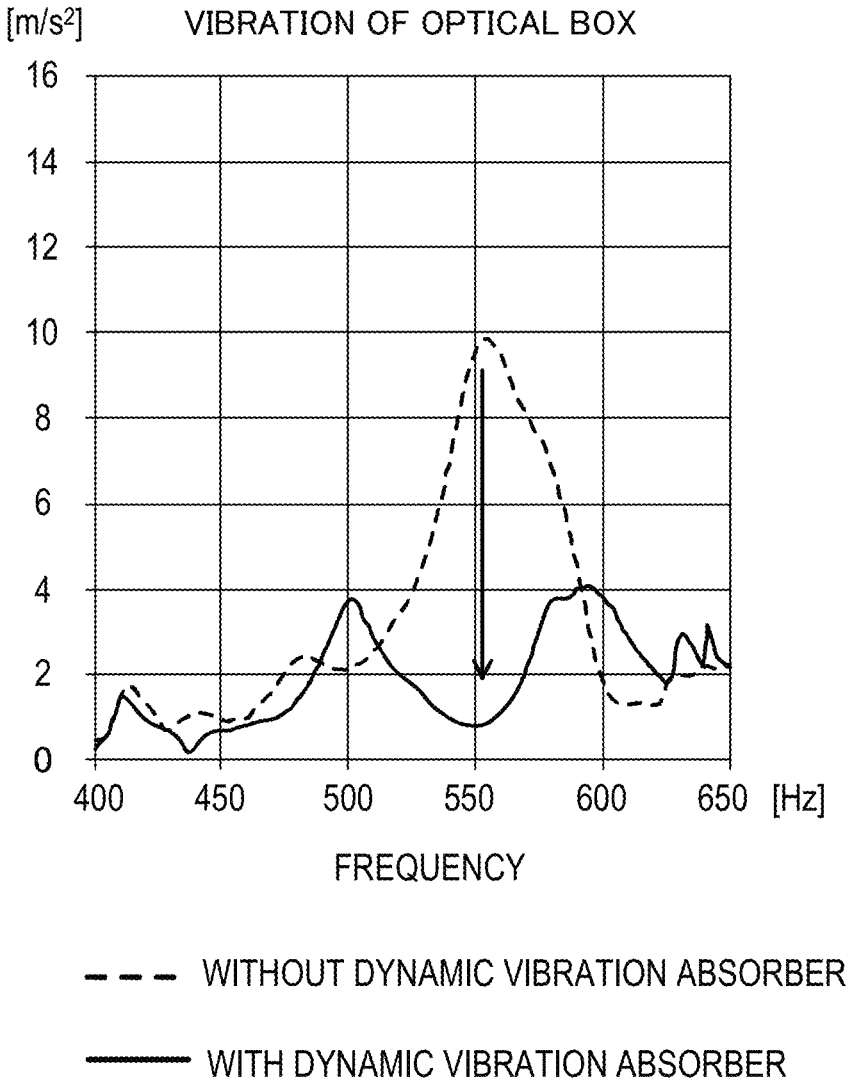
FIG. 30B is a graph for showing measurement results in the optical box using the acceleration sensors.
Figure 30C:
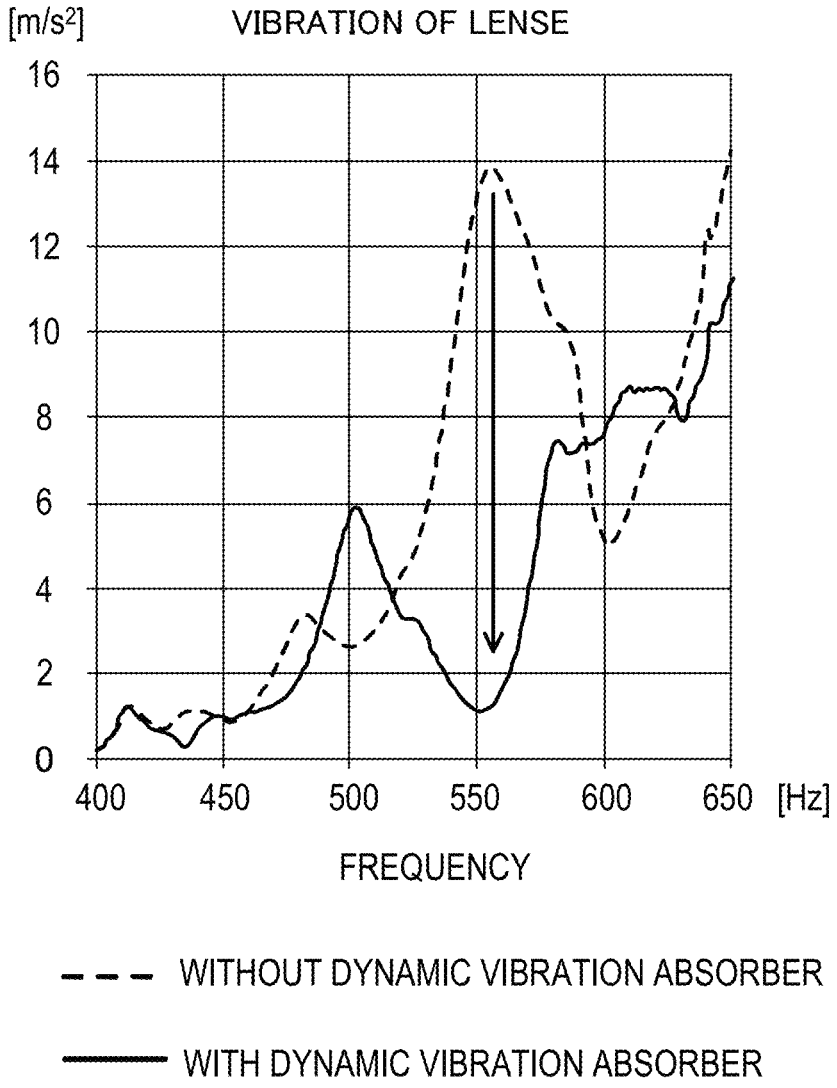
FIG. 30C is a graph for showing lens vibration measurement results.

FIG. 30B and FIG. 30C are graphs for showing measurement results of the acceleration sensors disposed at the two measurement points 516 and 517 in the light scanning apparatus 240. In FIG. 30B and FIG. 30C, graphs indicated by broken lines, respectively, are those when no dynamic vibration absorber is installed, and graphs indicated by solid lines, respectively, are those when the dynamic vibration absorber is installed. FIG. 30B is a graph for showing a frequency response curve representing a relation between the frequency and the acceleration substantially in the center of the optical box 305 as measured at the measurement point 516. In contrast, FIG. 30C is a graph for showing a frequency response curve representing a relation between the frequency and the acceleration in the middle of the lens 237 in its longitudinal direction as measured at the measurement point 517. In each of FIG. 30B and FIG. 30C, the horizontal axis represents the drive frequency (unit: Hz) of the drive motor of the deflection device 236, and the vertical axis represents the acceleration (unit: $m/s^2$) at each measurement point at each drive frequency of the drive motor.

Referring first to the frequency response curves indicated by the broken lines in FIG. 30B and FIG. 30C in the case where no dynamic vibration absorber is installed, the frequency response curves have large peaks at a frequency of about 550 Hz in both the optical box 305 (FIG. 30B) and the lens 237 (FIG. 30C). In other words, when the frequency is about 550 Hz, the optical box 305 vibrates at about 10 $m/s^2$ and the lens 237 vibrates at about 14 $m/s^2$. The frequency of 550 Hz is the resonance frequency in the light scanning apparatus 240, and the drive motor of the deflection device 236 has a rotational speed of 33,000 rpm (=550 Hz×60 seconds) at this frequency.

As described above, according to this embodiment, the "resonance" phenomenon is deemed to be a case that may cause both image deterioration and noise, and the resonance frequency at which the resonance phenomenon occurs is deemed to be a target frequency for reducing the acceleration peaks in the optical box 305 and the lens 237. In other words, according to this embodiment, the dynamic vibration absorber 502 is used to reduce the acceleration peaks at the frequency of 550 Hz, and the frequency response curves in the case where the dynamic vibration absorber 502 is installed correspond to the graphs indicated by the solid lines in FIG. 30B and FIG. 30C. According to the frequency response curves in the case where the dynamic vibration absorber 502 is installed, the characteristic peaks at the frequency of about 550 Hz, which are observed in the case where the dynamic vibration absorber 502 is not installed, disappear by installing the dynamic vibration absorber 502. More specifically, according to FIG. 30B, as for the vibration of the optical box 305 at about 550 Hz, the acceleration is about 9.8 $m/s^2$ in the case where the dynamic vibration absorber 502 is not installed, but is reduced to about 1 $m/s^2$ in the case where the dynamic vibration absorber 502 is installed. Likewise, according to FIG. 30C, as for the vibration of the lens 237 at about 550 Hz, the acceleration is about 13.6 $m/s^2$ in the case where the dynamic vibration absorber 502 is not installed, but is reduced to about 1 $m/s^2$ in the case where the dynamic vibration absorber 502 is installed. An effect of installation of the dynamic vibration absorber 502 can be verified in FIG. 30B and FIG. 30C in terms of vibration. Thus, image deterioration that may be caused by deviation of the imaging point on the photosensitive drum 202 in the sub-scanning direction due to vibration can be suppressed.

In this case, the characteristic frequency of the dynamic vibration absorber 502 which is most effective in reducing the acceleration peaks at the frequency of 550 Hz is about 500 Hz, and the mass 506 used at this frequency has a weight of 2.1 g. In this manner, the optimum effect for the frequency can be obtained by varying the weight of the mass 506 of the dynamic vibration absorber 502 in accordance with the frequency at which vibration is to be reduced. With the dynamic vibration absorber, vibration peaks tend to be formed at frequencies around the frequency at which vibration is to be reduced (550 Hz in this embodiment) because of its characteristics. In the optical box 305, for example, vibration peaks are formed at frequencies of about 500 Hz and about 590 Hz, as shown in FIG. 30B. On the other hand, in the lens 237, vibration peaks are formed at frequencies of about 500 Hz, about 580 Hz, and about 610 Hz to about 620 Hz, as shown in FIG. 30C. It is known that occurrence of such peaks can be suppressed by providing a proper "viscous" element to the dynamic vibration absorber. As described above, installation of the dynamic vibration absorber 502 is effective for the frequency at which vibration is to be reduced, but a new peak may be formed at another frequency band. Therefore, it is essential to select the optimum mass 506 in accordance with the drive frequency of the drive motor of the deflection device 236 to be used.

[Effect of Dynamic Vibration Absorber on Noise]

Figure 31:
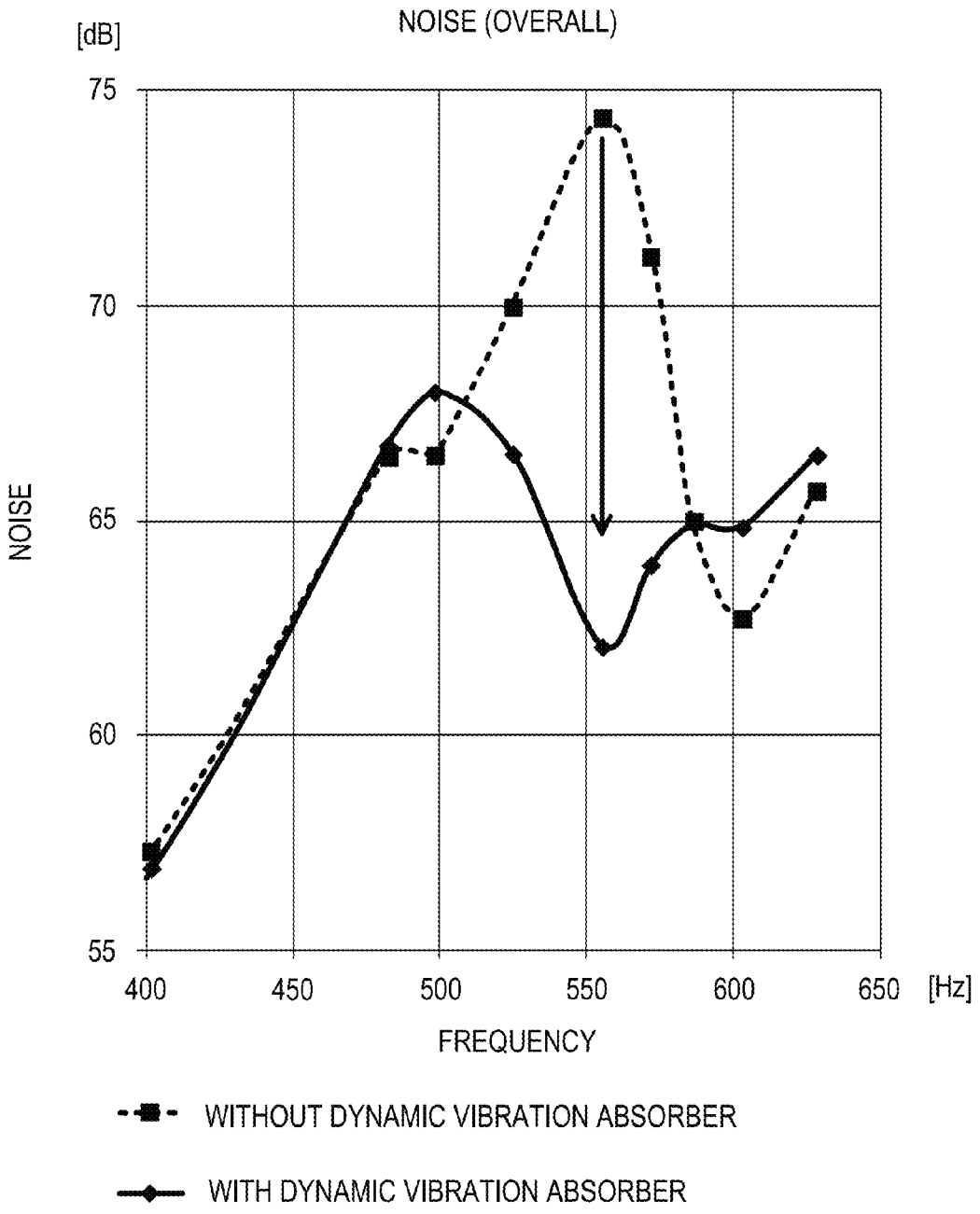
FIG. 31 is a graph for showing a noise level in the light scanning apparatus depending on whether or not the dynamic vibration absorber according to the fourth embodiment is used.

FIG. 31 is a graph for showing a noise level of the light scanning apparatus 240 before and after installing the dynamic vibration absorber 502. The noise level before installing the dynamic vibration absorber 502 is shown in a graph indicated by a broken line, and the noise level after installing the dynamic vibration absorber 502 is shown in a graph indicated by a solid line. The dynamic vibration absorber 502 thus installed is the same as the dynamic vibration absorber 502 used in FIG. 30A. In FIG. 31, the horizontal axis represents the drive frequency (unit: Hz) of the drive motor of the deflection device 236, and the vertical axis represents the noise (unit: dB) at each frequency of the drive motor. A microphone for measuring the noise level is disposed at a position that is 30 cm immediately above the drive motor of the deflection device 236 so as to face the light scanning apparatus 240.

As described above, the amplitude at the measurement point 516 provided substantially in the center of the optical box 305 as shown in FIG. 30B is highly correlated with the noise level of the light scanning apparatus 240. In FIG. 31, as for the noise level before installing the dynamic vibration absorber 502, a large peak of about 74 dB is present at about 550 Hz which is the resonance frequency. However, through installation of the dynamic vibration absorber 502, the noise level at about 550 Hz is reduced to about 62 dB so that the peak in the case where the dynamic vibration absorber 502 is not installed disappears. Accordingly, the effect of installation of the dynamic vibration absorber can be verified as with the vibration described in FIG. 30B and FIG. 30C.

As described above, the two problems of "image deterioration" and "noise" due to vibration of the drive motor can be considerably suppressed by varying the weight of the mass 506 of the dynamic vibration absorber 502 in accordance with the frequency at which vibration is to be reduced. In general, "image deterioration" and "noise" due to vibration of the drive motor often become issues at a rotational speed of 30,000 rpm or more or in the vicinity of the resonance frequency of the light scanning apparatus 240 as described above. In the dynamic vibration absorber 502, the frequency capable of obtaining the vibration reduction effect varies depending on the weight of the mass 506, and hence it is desirable in terms of costs and anti-vibration performance to install the dynamic vibration absorber 502 including the mass 506 having the weight exhibiting a large effect on the rotational speed of the target drive motor.

As described above, according to this embodiment, image deterioration and noise due to vibration of the drive motor can be reduced with the simple structure.

Other Embodiments

According to the above-mentioned fourth embodiment, the dynamic vibration absorber 502 has been described in the mode of the dynamic vibration absorber 502 represented by the one in FIG. 23, but the installation position of the dynamic vibration absorber 502 on the drive circuit board 300, its fixing method, and the shape of the dynamic vibration absorber 502 are not limited to the mode illustrated in FIG. 23. Modified examples of the installation position, the fixing method, and the shape of the dynamic vibration absorber are described below.

(1) Installation Position of Dynamic Vibration Absorber

Figure 32A:
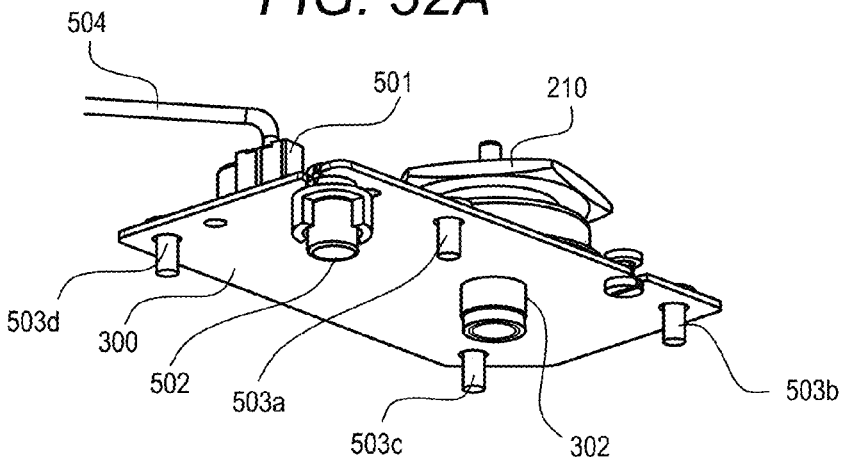
FIG. 32A is a view for illustrating the installation position of a dynamic vibration absorber according to another embodiment of the present invention.

FIG. 32A is a perspective view for illustrating an embodiment of the present invention in which the dynamic vibration absorber 502 is installed on a surface of the drive circuit board 300 opposite to a surface on which the rotary polygon mirror 210 is disposed, in other words, on a back surface of the drive circuit board 300 which is on the opposite side to the front surface on which the rotary polygon mirror 210 is disposed. The vibration mode of the drive circuit board 300 is the same as the vibration mode illustrated in the contour diagrams of FIG. 28A and FIG. 28B irrespective of whether the dynamic vibration absorber 502 is installed on the front surface of the drive circuit board 300 as in FIG. 27A and FIG. 27B or installed on the back surface of the drive circuit board 300 as in FIG. 32A. Therefore, a significant difference does not occur on the vibration reduction effect of the dynamic vibration absorber 502 irrespective of whether the dynamic vibration absorber 502 is installed on the front surface or the back surface of the drive circuit board 300. Further, the above-mentioned generation of flare light can be prevented by installing the dynamic vibration absorber 502 on the back surface of the drive circuit board 300. Therefore, when there is a space (free space) for installing the dynamic vibration absorber 502 between the back surface of the drive circuit board 300 and the bottom surface of the optical box, the dynamic vibration absorber 502 is desirably installed on the back surface of the drive circuit board 300. In other embodiments of the present invention to be described below, an example in which the dynamic vibration absorber 502 is installed on the side of the drive circuit board 300 on which the rotary polygon mirror 210 is disposed is described. However, the dynamic vibration absorber 502 may be installed on the opposite side to the surface on which the rotary polygon mirror is disposed.

(2) Shape of Dynamic Vibration Absorber

Figure 32B:
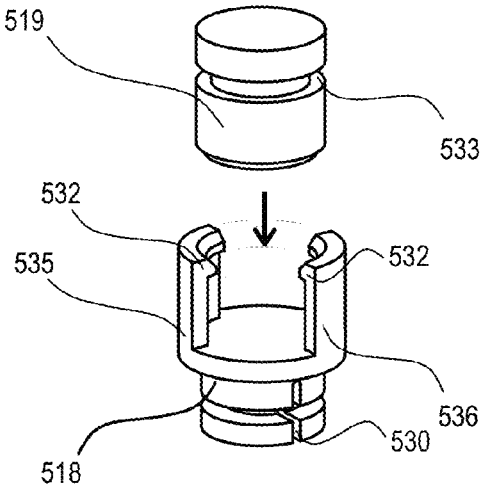
FIG. 32B and FIG. 32C are views for illustrating the structure of the dynamic vibration absorber.
Figure 32C:
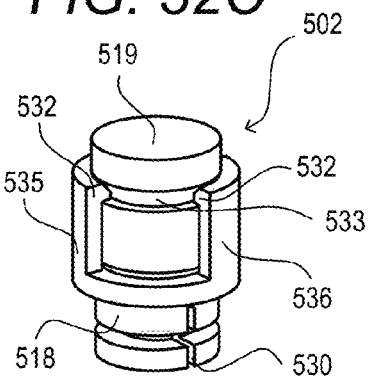

FIG. 32B and FIG. 32C are perspective views for illustrating an example in which a method of mounting a mass forming a mass element of the dynamic vibration absorber 502 to a mounting member configured to hold the mass is modified. FIG. 32B is an illustration of a state before mounting a mass 519 to a holding member 518, and FIG. 32C is an illustration of a state after mounting the mass 519 to the holding member 518. FIG. 25B in the above-mentioned fourth embodiment is different from FIG. 32B and FIG. 32C in that the mass 506 is press-fitted into the holding member 505 to be fixed thereto in FIG. 25B, while the mass 519 is snap-fitted into the holding member 518 to be fixed thereto in FIG. 32B and FIG. 32C. Snap-fitting is an assembly method in which protruded portions (hereinafter referred to as "snap-fit portions") 532 formed in the holding member 518 are caught in and fitted into a recessed portion (hereinafter referred to as "slit") 533 of the mass 519 to be fixed thereto through a good use of elasticity of the member.

In FIG. 32B, the holding member 518 has two ribs 535 and 536 formed at positions facing each other to hold the mass 519, and the ribs 535 and 536 protrude upward. The pair of convex snap-fit portions 532 are formed on the inner side at respective upper portions of the ribs 535 and 536 so as to face each other. On the other hand, the mass 519 has a cylindrical shape and has the concave slit 533 formed at a position corresponding to the snap-fit portions 532. In FIG. 32B, when the mass 519 is inserted while being pressed in an arrow direction, the mass 519 is pressed into the holding member 518 while the ribs 535 and 536 are elastically deformed so as to enlarge toward the outer side (in a radially outward direction) of the holding member 518. Then, the snap-fit portions 532 of the holding member 518 return to their original initial state at a position of engagement with the slit 533 of the mass 519, and the mass 519 is fixed to the holding member 518 as in FIG. 32C. The method of fixing the mass 519 to the holding member 518 in this way through snap-fitting has an advantage over the above-mentioned fixing method using press-fitting in FIG. 25B in that a special tool for fixation is not necessary. In addition, in the case of snap-fitting, the mass can be mounted and dismounted more easily than in the case of fixation through fastening with a screw. Further, in the case of snap-fitting, the vibration reduction effect obtained by the dynamic vibration absorber is not affected by a weight error due to unevenness in screw shape.

(3) Weight Indication on Mass

Figure 32D:
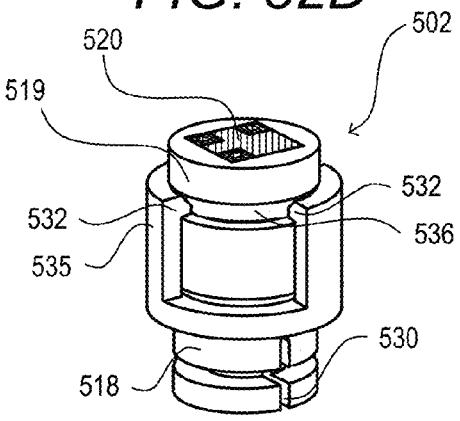
FIG. 32D is a view for illustrating weight indication on a mass.

FIG. 32D is a perspective view for illustrating an example in which an indication of a type of the mass (e.g., a two-dimensional bar code 520 indicating a weight of the mass) is printed on an upper surface (top surface) of the mass 519 held in the holding member 518 of the dynamic vibration absorber 502 illustrated in FIG. 32C. Even when the drive motor of the deflection device 236 to be subjected to vibration reduction is different in rotational speed, the holding member 505 illustrated in FIG. 25A and FIG. 25B and the holding member 518 illustrated in FIG. 32C may be used in common. However, as described above, in the dynamic vibration absorber 502, the frequency exhibiting the vibration reduction effect varies depending on the weight of the mass 519. In other words, the optimum weight is selected as the weight of the mass 519 in accordance with a rotational speed lineup in the drive motor. Therefore, a plurality of types of masses 519 which are the same in shape but different in weight may be mass-produced. Accordingly, in order to properly select the mass 519 having the optimum weight and mount the selected mass 519 to the holding member 518, there arises the need to take stratified measures so that the weight of the mass 519 can be visually recognized.

Then, as illustrated in FIG. 32D, the two-dimensional bar code 520 such as QR code (trademark) is printed on the upper surface (top surface) of the mass 519. Whether or not the selected rotational speed of the drive motor and the weight of the mass 519 of the dynamic vibration absorber 502 are combined correctly can be thus visually checked on a mass production line in a factory. Further, the indication of the type of the mass may be placed not only on the upper surface but also on the bottom surface or the lateral surface of the mass 519, thereby facilitating management, for example, when a different mass is to be mounted for each rotational speed of the drive motor to be used.

(4) Method of Installing Dynamic Vibration Absorber on Drive Circuit Board

In the above-mentioned fourth embodiment, as illustrated in FIG. 27A and FIG. 27B, the structure capable of installing the dynamic vibration absorber 502 by pressing the holding member 505, which holds the mass 506, into the slit 540 of the drive circuit board 300 is described. However, the installation method is not limited thereto. A modified example of the method of fixing the dynamic vibration absorber to the drive circuit board is described below. In the above-mentioned fourth embodiment, the mass element of the dynamic vibration absorber 502 is formed of the mass 506 and the holding member 505, and the holding member 505 holding the mass 506 is fixed to the drive circuit board 300 to form the dynamic vibration absorber 502. In contrast, in an example to be described below, an installation method which involves fixing the mass to the drive circuit board 300 with a bolt is described.

Figure 33A:
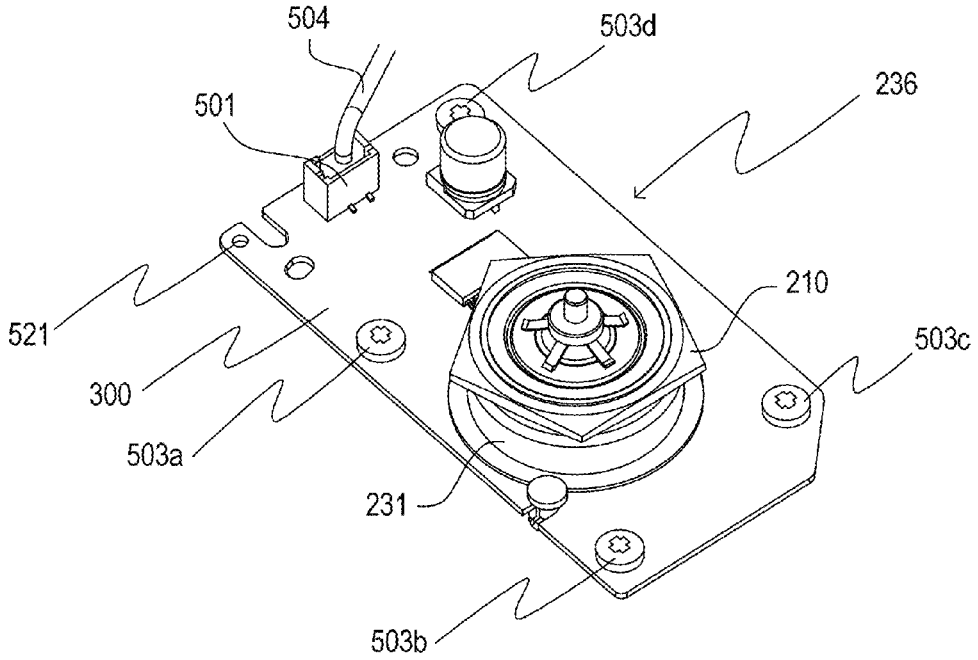
FIG. 33A, FIG. 33B, and FIG. 33C are views for illustrating an example in which an opening is formed in a drive circuit board according to another embodiment of the present invention.

FIG. 33A is a perspective view for illustrating an example in which an opening 521 is formed in a corner portion (angular portion) among the four corners of the drive circuit board 300, at which no fixing hole for fixing the drive circuit board 300 to the optical box 305 is formed. For example, the drive circuit board 300 illustrated in FIG. 33A is only different from the drive circuit board 300 illustrated in FIG. 26A in that the opening 521 is formed. In order to fasten the drive circuit board 300 to the optical box 305, the four screws 503*a* to 503*d* are disposed on the drive circuit board 300 at the same positions as described above.

Figure 33B:
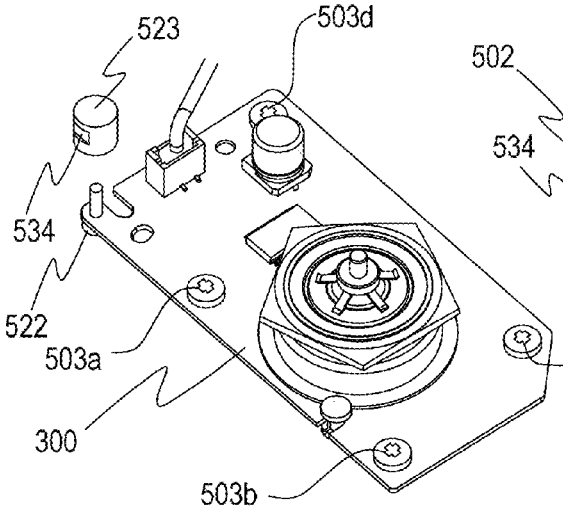
Figure 33C:
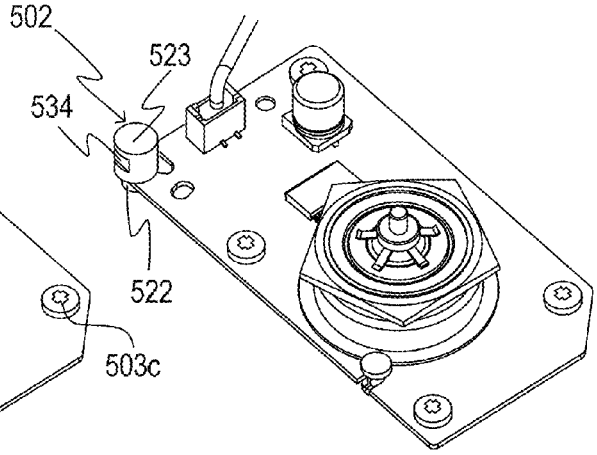

FIG. 33B and FIG. 33C are perspective views for illustrating an example in which a mass 523 is mounted to the drive circuit board 300 described in FIG. 33A. FIG. 33B is an illustration of a state before mounting the mass 523 to the drive circuit board 300, and FIG. 33C is an illustration of a state after mounting the mass 523 to the drive circuit board 300. In FIG. 33B, a bolt 522 is engaged with the opening 521 of the drive circuit board 300, and the bolt 522 has a screw portion (not shown). On the other hand, the mass 523 having a screw hole (not shown) at a position corresponding to the screw portion (not shown) of the bolt 522 is illustrated above the bolt 522. A pair of opposed planar portions 534 are formed in a side surface of the mass 523. As described later, the planar portions 534 are formed to hold the mass 523 with a tool so as to prevent the mass 523 from rotating when the bolt 522 is rotated to be fastened to the mass 523. When the mass 523 is fixed to the drive circuit board 300 with the bolt 522, the screw portion of the bolt 522 is engaged with the screw hole of the mass 523, and the bolt 522 is rotated from below the drive circuit board 300 with the pair of planar portions 534 held with the tool. In this way, the bolt 522 and the mass 523 are fixed to each other with the screw so that the mass 523 is mounted to the drive circuit board 300.

The mass 523 is mounted to the drive circuit board 300 with the bolt 522 in this example. However, the method of fixing the mass 523 to the drive circuit board 300 is not limited to the above-mentioned structure. For example, a method involving causing the mass 523 to adhere to the drive circuit board 300 using solder to fix the mass 523 to the drive circuit board 300 may be used. Further, the opening 521 formed in the drive circuit board 300 is subjected to burring processing to form an upright portion on the periphery of the opening. Processing for forming a screw portion on the inner side of the upright portion is performed, and a screw portion protruding toward the opening 521 is formed in the mass 523. Then, the screw portion of the mass 523 is engaged with the opening 521 and rotated to allow the mass 523 to be mounted to the drive circuit board 300 without using the bolt 522.

Figure 34A:
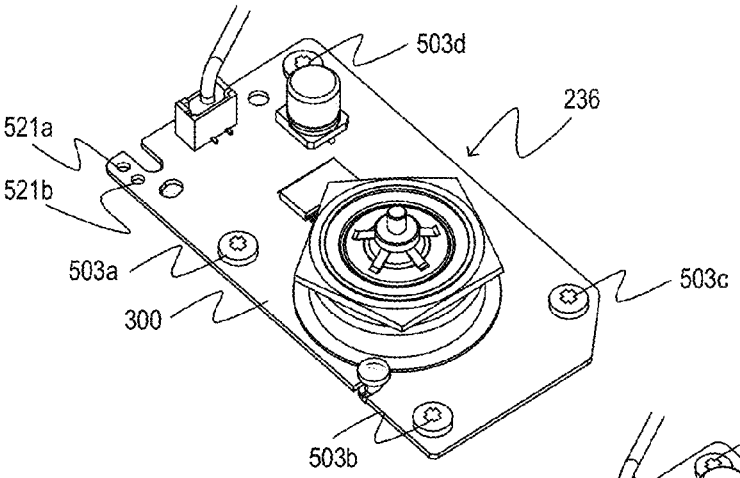
FIG. 34A, FIG. 34B, FIG. 34C, and FIG. 34D are views for illustrating examples in each of which a plurality of openings are formed in the drive circuit board according to another embodiment of the present invention.

FIG. 34A is a perspective view for illustrating another modified example different from that in FIG. 33A, that is, an example in which a plurality of openings 521 (openings 521*a* and 521*b* in FIG. 34A) through which the mass 523 of the dynamic vibration absorber 502 can be mounted are formed in the drive circuit board 300. The two openings 521*a* and 521*b* are formed so as to be adjacent to each other. The opening 521*a* is formed on a side farther away from the screw 503*a*, and the opening 521*b* is formed on a side closer to the screw 503*a*. In the description given above, when the characteristic frequency of the dynamic vibration absorber 502 is to be changed, the weight of the mass 506 is changed to change the characteristic frequency. However, the characteristic frequency may also be changed by changing the position for fastening the mass 506 to the drive circuit board 300 even when the mass 506 having the same weight is used.

Figure 34D:
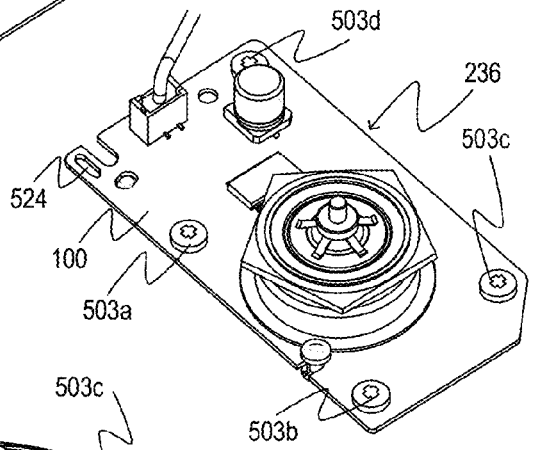
Figure 34B:
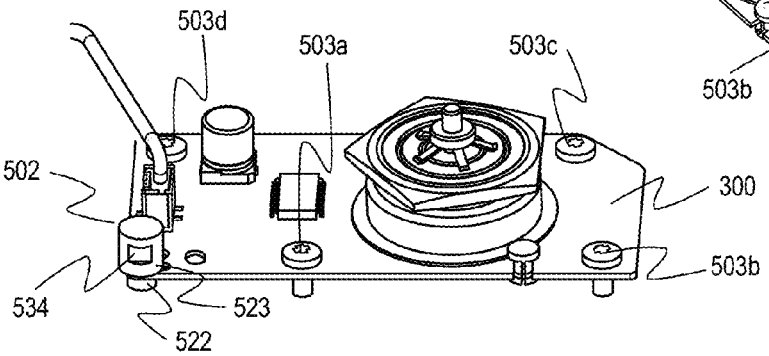
Figure 34C:
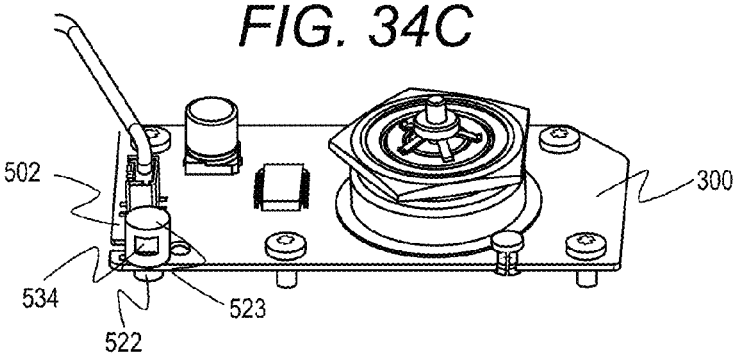

FIG. 34B and FIG. 34C are perspective views for illustrating how the mounting position of the mass 523 of the dynamic vibration absorber 502 is switched between the plurality of openings 521*a* and 521*b* using the drive circuit board 300 illustrated in FIG. 34A. FIG. 34B is a perspective view for illustrating a case where the mass 523 is mounted to the opening 521*a*, and FIG. 34C is a perspective view for illustrating a case where the mass 523 is mounted to the opening 521*b*. The rotational speed of the drive motor in the deflection device 236 of the light scanning apparatus 240 is known in advance, and the characteristic frequency of the dynamic vibration absorber 502 which allows the vibration reduction effect to be obtained in response to the rotational speed is also known in advance. Therefore, vibration reduction at different drive frequencies of the drive motor can be achieved by using the mass 523 having the same weight and switching the mounting positions on the drive circuit board 300 for fastening the mass 523. As a result, the structure with a smaller number of components for the mass 523 is adaptable to a larger number of rotational speeds of the drive motor.

FIG. 34D is a perspective view for illustrating still another modified example different from in FIG. 34A. In FIG. 34A, the drive circuit board 300 has the two openings 521*a* and 521*b*. In FIG. 34D, however, the openings 521*a* and 521*b* are united together to form a single elliptical opening 524 having an oval hole. In FIG. 34A, the characteristic frequency of the dynamic vibration absorber 502 can be switched in accordance with the number of openings (two in FIG. 34A) where the mass 523 of the dynamic vibration absorber 502 can be mounted. In contrast, in FIG. 34D, the opening 524 is an oval hole so that the mounting position for fixing the mass 523 of the dynamic vibration absorber 502 is an arbitrary position in a longitudinal direction of the oval hole. Thus, the opening 524 has a higher degree of freedom than in the case in FIG. 34A. As a result, the structure in FIG. 34D is adaptable to the rotational speed of the drive motor of the deflection device 236 more flexibly than in FIG. 34A.

(5) Spring Element Portion

In the above description of the light scanning apparatus 240, the drive circuit board 300 of the deflection device 236 is fastened to the optical box 305 using the four screws 503*a* to 503*d* as illustrated in FIG. 23. In this step, the fastening positions of the four screws 503*a* to 503*d* are not at four corners of the drive circuit board 300. The screws 503*b* to 503*d* are positioned at corner portions (angular portions) of the drive circuit board 300, and the screw 503*a* is positioned on the inner side of the drive circuit board 300. Such intentional positioning of the screws has the effect of forming, in the drive circuit board 300, the spring element portion 515 which is a vibratable area, as illustrated in FIG. 28A and FIG. 28B. However, the spring element portion to be intentionally formed in the drive circuit board 300 is not limited thereto.

Figure 35A:
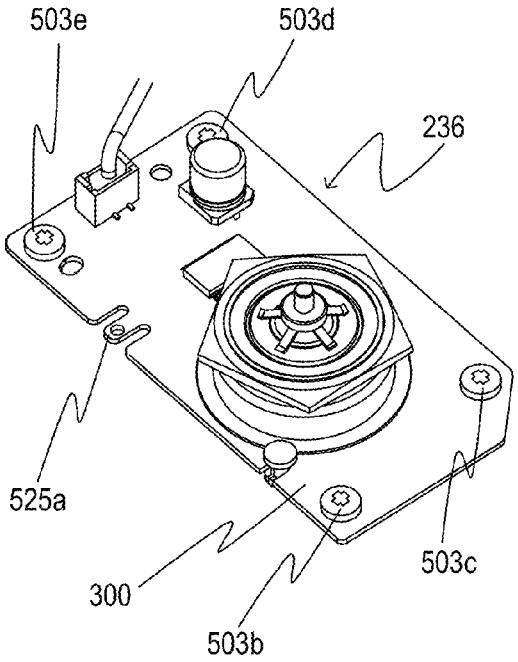
FIG. 35A, FIG. 35B, FIG. 35C, and FIG. 35D are views for illustrating examples in each of which a cantilever portion is formed in the drive circuit board according to another embodiment of the present invention.
Figure 35B:
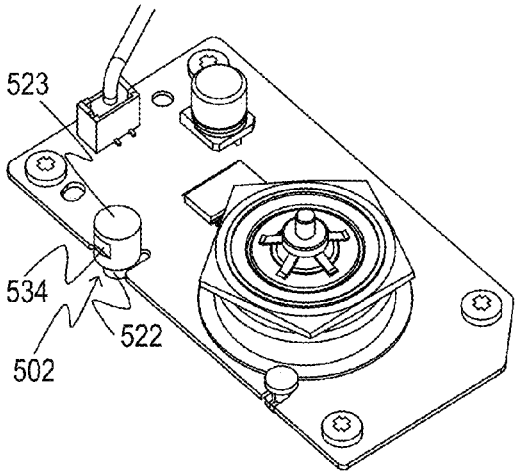

FIG. 35A and FIG. 35B are perspective views for illustrating an example in which a spring element portion, which is a vibratable area, is formed when fixing holes for the screws 503*b* to 503*e* are formed at the four corners (angular portions) of the drive circuit board 300 to fasten the drive circuit board 300 to the optical box 35. In FIG. 35A, the fixing hole for the screw 503*a* illustrated in FIG. 23, which is formed on the inner side of the drive circuit board 300, is not formed, but the fixing hole for the screw 503*e* is newly formed in the corner portion where a screw fixing hole is not formed in FIG. 23. FIG. 35A is a perspective view for illustrating a shape of the drive circuit board 300 before mounting the mass 523, and FIG. 35B is a perspective view for illustrating a state of the dynamic vibration absorber 502 after mounting the mass 523.

In FIG. 35A, a cantilever portion 525*a* having an opening through which the bolt 522 for screwing the mass 523 is caused to pass and slits formed on both sides of the opening is disposed in an outer peripheral portion of the drive circuit board 300 between the screw 503*e* and the screw 503*b*. FIG. 35B is an illustration of a state in which the mass 523 is fixed to the drive circuit board 300 by being fastened with the bolt 522 through the opening of the cantilever portion 525*a*. The spring element portion of the dynamic vibration absorber 502 can be thus easily formed by arranging the cantilever portion 525*a* on the drive circuit board 300 as in FIG. 35A. In this regard, the spring constant of the spring element portion of the dynamic vibration absorber 502 is determined by a thickness of the drive circuit board 300, an area moment of inertia determined by a width of the cantilever portion 525*a*, a length of the cantilever portion, and a Young's modulus of the plate. Therefore, the cantilever portion 525*a* is preferably formed to have such a shape that the spring element portion has a proper spring constant.

Figure 35C:
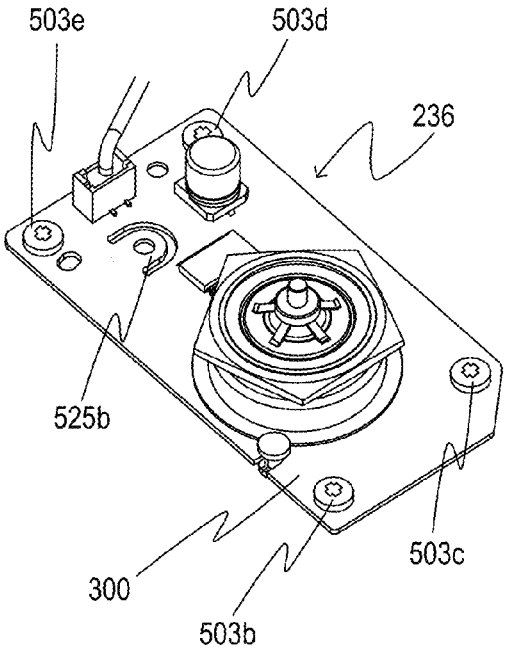
Figure 35D:
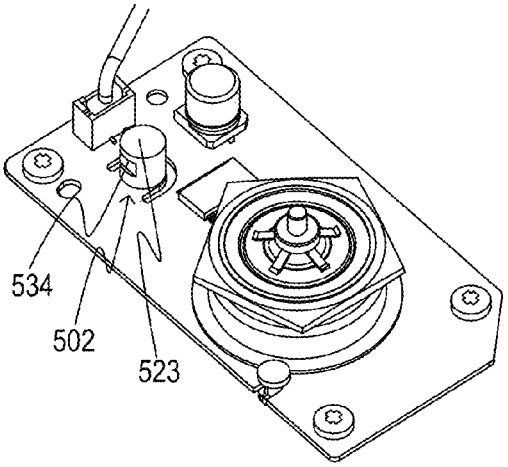

FIG. 35C and FIG. 35D are perspective views for illustrating an example in which the cantilever portion is formed on the inner side of the drive circuit board 300. FIG. 35C is a perspective view for illustrating a shape of the drive circuit board 300 before mounting the mass 523, and FIG. 35D is a perspective view for illustrating a state of the dynamic vibration absorber 502 after mounting the mass 523. In FIG. 35C, there is formed a cantilever portion 525*b* which has a semicircular slit formed on the inner side of the drive circuit board 300 and also has, at a semicircular portion formed by the semicircular slit, an opening through which the bolt 522 for screwing the mass 523 is caused to pass. FIG. 35D is an illustration of a state in which the mass 523 is fixed to the drive circuit board 300 by being fastened with the bolt 522 through the opening formed in the cantilever portion 525*b*.

A common point between the cantilever portion 525*a* in FIG. 35A and the cantilever portion 525*b* in FIG. 35C is that an elastically deformable portion of the drive circuit board 300 used as the spring element portion of the dynamic vibration absorber 502 uses the outer peripheral portion (end portion) or the region adjacent to the opening in the drive circuit board 300. The drive circuit board 300 can be used as the spring element by intentionally forming such a region relatively readily causing vibration on the drive circuit board 300. Further, the cantilever portions 525*a* and 525*b* illustrated in FIG. 35A and FIG. 35C, respectively, are formed on the inner side of the drive circuit board 300, but may have such a shape that a cantilever beam portion is protruded from the drive circuit board 300, for example. In other words, the cantilever portion may have any shape as long as a part of the drive circuit board 300 is used as the spring element portion of the dynamic vibration absorber 502.

As described above, also according to other embodiments of the present invention, image deterioration and noise due to vibration of the drive motor can be reduced with the simple structure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110404, filed May 29, 2015, and Japanese Patent Application No. 2015-110405, filed May 29, 2015 which are hereby incorporated by reference herein in their entirety.

What is claimed is:

1. A light scanning apparatus, comprising:

a light source;

a rotary polygon mirror configured to deflect a light beam emitted from the light source;

a plurality of optical members configured to guide the light beam, which has been deflected by the rotary polygon mirror, to a photosensitive member;

a drive motor configured to rotate the rotary polygon mirror;

an optical box to which the light source is attached, the optical box containing the rotary polygon mirror, the drive motor, and the plurality of optical members; and a dynamic vibration absorber mounted inside the optical box and configured to be vibrated by vibrations of the optical box, wherein the plurality of optical members are supported on a bottom portion of the optical box, and wherein the dynamic vibration absorber includes a fixing portion, a first arm portion, and a second arm portion, wherein the fixing portion is fixed to the bottom portion of the optical box at a position between at least two adjacent optical members among the plurality of optical members, wherein the first arm portion extends from the fixing portion along the bottom portion of the optical box and along a longitudinal direction of the plurality of optical members, is disposed out of contact with the bottom portion of the optical box, and vibrates by vibration energy received from the bottom portion of the optical box through the fixing portion, and wherein the second arm portion extends from the fixing portion in a direction opposite to the first arm portion along the bottom potion of the optical box and along the longitudinal direction of the plurality of optical members, is disposed out of contact with the bottom portion of the optical box, and vibrates by the vibration energy received from the bottom portion of the optical box through the fixing portion.

2. A light scanning apparatus according to claim 1, wherein the plurality of optical members comprise a pair of optical members facing each other across the rotary polygon mirror, and wherein the dynamic vibration absorber is disposed at each of positions in a longitudinal direction of the pair of optical members, the positions facing each other across the rotary polygon mirror.

3. A light scanning apparatus according to claim 1, wherein the plurality of optical members comprise a lens through which the light beam transmits, and wherein the dynamic vibration absorber is disposed so that a longitudinal direction of the dynamic vibration absorber is parallel to a longitudinal direction of the lens.

4. A light scanning apparatus according to claim 1, wherein the plurality of optical members comprise a mirror configured to reflect the light beam, and wherein the dynamic vibration absorber is disposed so that a longitudinal direction of the dynamic vibration absorber is parallel to a longitudinal direction of the mirror.

5. A light scanning apparatus according to claim 1, wherein the plurality of optical members comprise:

a lens through which the light beam transmits; and a mirror configured to reflect the light beam, and wherein the dynamic vibration absorber is disposed so that a longitudinal direction of the dynamic vibration absorber is parallel to a longitudinal direction of the lens and a longitudinal direction of the mirror.

6. A light scanning apparatus according to claim 1, wherein both end portions of each of the plurality of optical members are fixed to the optical box.

7. A light scanning apparatus according to claim 6, wherein the dynamic vibration absorber is disposed on an inner side of the both end portions of each of the plurality of optical members in a longitudinal direction of each of the plurality of optical members.

8. A light scanning apparatus according to claim 1, further comprising a circuit board to which the rotary polygon mirror and the drive motor are attached, wherein the circuit board is fixed to a plurality of bearing surfaces provided in the optical box, and wherein when the optical box is divided into two sides along a plane passing through a rotational axis of the rotary polygon mirror and extending in an optical axis direction of the deflected light beam, an attachment position of the dynamic vibration absorber in the longitudinal direction of the plurality of optical members is located on a side of the optical box different from a side of the optical box on which a gravity center of the circuit board, which is formed by the plurality of bearing surfaces, is located.

9. A light scanning apparatus according to claim 1, wherein the dynamic vibration absorber is formed of a thin metal plate, and is fastened to the bottom portion of the optical box by a screw at the fixing portion.

* * * * *